US012287111B1

(12) United States Patent
Schofel

(10) Patent No.: US 12,287,111 B1
(45) Date of Patent: Apr. 29, 2025

(54) VENT TERMINATION

(71) Applicant: Richard A. Schofel, West Long Branch, NJ (US)

(72) Inventor: Richard A. Schofel, West Long Branch, NJ (US)

( * ) Notice: Subject to any disclaimer, the term of this patent is extended or adjusted under 35 U.S.C. 154(b) by 38 days.

(21) Appl. No.: 18/734,858

(22) Filed: Jun. 5, 2024

Related U.S. Application Data

(60) Provisional application No. 63/559,732, filed on Feb. 29, 2024.

(51) Int. Cl.
*F24F 13/02* (2006.01)
*E03D 9/04* (2006.01)

(52) U.S. Cl.
CPC ..... *F24F 13/0227* (2013.01); *E03D 9/04* (2013.01)

(58) Field of Classification Search
CPC ..... F24F 13/0227; F24F 7/02; F24F 7/013; F24F 7/025; E03D 9/04; E04D 13/152; E04D 13/178; E04D 13/172
USPC ..... 454/270, 364–366, 341
See application file for complete search history.

(56) References Cited

U.S. PATENT DOCUMENTS

| | | | | |
|---|---|---|---|---|
| 442,273 | A | 12/1890 | Pestell | |
| 2,878,743 | A | 3/1959 | Trunnell | |
| 3,051,071 | A | 8/1962 | Leigh | |
| D206,421 | S | 12/1966 | Kilbourn | |
| 3,934,383 | A | 1/1976 | Perry et al. | |
| 5,095,942 | A | 3/1992 | Murphy | |
| 5,167,578 | A * | 12/1992 | Legault | F24F 7/00 454/359 |
| 5,498,204 | A | 3/1996 | Anderson et al. | |
| 5,662,522 | A | 9/1997 | Waltz | |
| 5,711,091 | A * | 1/1998 | Bos | D06F 58/20 52/220.8 |
| 5,762,551 | A * | 6/1998 | Lachapelle | F24F 13/1406 454/359 |
| 5,791,985 | A | 8/1998 | Schiedegger et al. | |
| 5,934,362 | A | 8/1999 | Barker, II | |

(Continued)

FOREIGN PATENT DOCUMENTS

GB 175821 A 3/1922

OTHER PUBLICATIONS

International Search Report and Written Opinion Applicaiton No. PCT/2020042938 dated Sep. 30, 2020 consists of 20 pages.

(Continued)

*Primary Examiner* — Ko-Wei Lin
(74) *Attorney, Agent, or Firm* — Patterson + Sheridan, LLP

(57) ABSTRACT

Vent terminations and building structures having vent terminations are described herein. The vent terminations efficiently vent air laterally away from the building structures in which the vents are mounted. The vent terminations may be configured as through soffit vents and through fascia vents. In one example, a vent termination is configured as soffit vent includes a plenum box, a collar, and a nose section. The plenum box has a plenum partially defined between top and bottom surfaces. The collar extends from the top surface and provides an air inlet into the plenum. The collar is located closer to the back side than the front side. A first side of the nose section is connected to the front side of the plenum box. A second side of the nose section is offset below the first side relative the top surface and forms an air outlet of the plenum.

21 Claims, 44 Drawing Sheets

(56) References Cited

U.S. PATENT DOCUMENTS

| | | | | |
|---|---|---|---|---|
| 5,971,847 | A | 10/1999 | Webb | |
| 5,984,776 | A | 11/1999 | Berger | |
| 6,149,516 | A * | 11/2000 | Mantyla | F24F 7/007 454/367 |
| 6,293,862 | B1 | 9/2001 | Jafine et al. | |
| 6,487,826 | B1 * | 12/2002 | McCorsley | E04D 13/172 52/95 |
| 6,682,415 | B1 | 1/2004 | Vagedes | |
| D488,857 | S | 4/2004 | Wintersteen et al. | |
| 6,767,281 | B2 | 7/2004 | McKee | |
| D511,377 | S | 11/2005 | Erwan et al. | |
| 7,004,832 | B2 | 2/2006 | Thomas | |
| 7,022,011 | B1 | 4/2006 | Rickman et al. | |
| 7,108,600 | B1 | 9/2006 | Krzyskowski et al. | |
| 7,410,416 | B2 | 8/2008 | Fettkether | |
| D620,585 | S | 7/2010 | Adair et al. | |
| 7,980,266 | B2 | 7/2011 | Niedermair | |
| D675,719 | S | 2/2013 | Eicher | |
| D678,994 | S | 3/2013 | Miyake et al. | |
| D731,047 | S | 6/2015 | Leonard | |
| 9,062,454 | B1 | 6/2015 | Borgman et al. | |
| 9,341,291 | B2 | 5/2016 | Sandman et al. | |
| D779,650 | S | 2/2017 | Poehlman et al. | |
| 9,657,962 | B2 | 5/2017 | Mosley | |
| D846,086 | S | 4/2019 | Naber | |
| 10,731,891 | B2 | 8/2020 | Khalil | |
| D918,374 | S * | 5/2021 | Schofel | D23/393 |
| 2005/0003755 | A1 | 1/2005 | Koessler | |
| 2006/0240762 | A1 | 10/2006 | Railkar et al. | |
| 2007/0010191 | A1 | 1/2007 | Vanden Bosch et al. | |
| 2010/0124877 | A1 | 5/2010 | Sukup | |
| 2011/0312265 | A1 | 12/2011 | Leblanc | |
| 2012/0052792 | A1 | 3/2012 | Sinur et al. | |
| 2013/0247480 | A1 | 9/2013 | Ridgway | |
| 2016/0193635 | A1 * | 7/2016 | Mate | B23Q 11/0046 454/63 |
| 2017/0204610 | A1 * | 7/2017 | Nagan | F24F 13/06 |
| 2018/0087280 | A1 * | 3/2018 | Dysart | E04B 7/02 |
| 2018/0156482 | A1 * | 6/2018 | Khalil | F24F 7/08 |
| 2018/0216845 | A1 | 8/2018 | Whitehead | |
| 2019/0195520 | A1 | 6/2019 | King, Jr. | |
| 2020/0011555 | A1 * | 1/2020 | Mills | F24F 7/065 |
| 2021/0018196 | A1 * | 1/2021 | Schofel | E04D 13/1407 |

OTHER PUBLICATIONS

International Preliminary Report on Patentability Applicaiton No. PCT/2020042938 dated Feb. 3, 2022 consists of 8 pages.

"Soffit Intake/Exhaust Vent" Jan. 26, 2011, Heyoka Solutions, site visited Oct. 23, 2020: < http://www.heyokasolutions.com/> ProductDetails.asp?ProductCode=PRMX%2DSV2801 (Year: 2011).

"Lambro Industries 143WP" Sep. 10, 2006 Amazon, site visited Oct. 28, 2020: https://www.amazon.com/dp/BOOOH5PTSG <http://www.amazon.com/dp/BOOOH5PTSG> / (Year: 2006).

* cited by examiner

VENT TERMINATION

FIELD

Embodiments of the disclosure relate to vent terminations for venting interior spaces of a building structure, and more particularly, to vent terminations for venting moisture and/or other gases through from an exhaust fan and/or applicant.

BACKGROUND

Roof vents are typically the termination of the bathroom exhaust fan system used to vent air from a bathroom to the exterior of a building structure, such as a house, office, hospital, commercial building, arena condominium, apartment and the like. The roof vent is attached to the ductwork that extends from the exhaust fan. The roof vents are typically chosen to exhaust moisture laden air from a bathroom or other interior space of a building structure because flowing air into the environment outside of the building structure above the eaves of the roof prevents the moisture laden air from undesirably entering the attic space through vents located in along the soffit of the structure. Moisture from bathroom exhaust when present in an attic may undesirably promote mold growth, which can be harmful to health and expensive to remediate.

Despite these benefits, roof vents generally have significant installation costs as the roof vent is very often located remotely from the bathroom. Additionally, affixing the roof vent to the roof may undesirably compromise the integrity of the roof.

Thus, there is a need for improved technology for venting internal spaces within a structure, and particularly from bathrooms and appliances.

SUMMARY

Described herein are vent terminations and building structures having vent terminations that are designed to efficiently vent air and/or other gases laterally away from the building structures in which the vents are mounted. In some examples described herein, the vent terminations are configured to extend through a soffit while other examples are configured to extend through a fascia of a building structure.

In one example, a vent termination is provided configured as a soffit vent. The soffit vent includes a plenum box, a collar, and a nose section. The plenum box has top and bottom surfaces, and front and back sides. The plenum box has a plenum partially defined between the top and bottom surfaces. The collar extends from the top surface and provides an air inlet into the plenum. The collar is located closer to the back side than the front side. A first side of the nose section is connected to the front side of the plenum box. A second side of the nose section is offset below the first side relative the top surface. The second side of the nose section forms an air outlet of the plenum.

In another example, a building structure having a vent termination is provided. The building structure includes an interior of the building structure and soffit defining a portion of an exterior of the building structure. The vent termination is provided configured as a soffit vent. The soffit vent is coupled by a duct to a fan operable to ventilate the interior of the building structure or an appliance disposed in the building structure. The soffit vent includes a plenum box, a collar, and a nose section. The plenum box has top and bottom surfaces, and front and back sides. The plenum box has a plenum partially defined between the top and bottom surfaces. The top surface of the plenum box is mounted to the soffit of the building structure. The collar extends from the top surface and provides an air inlet into the plenum. The collar extends through the soffit from the top surface and provides an air inlet into the plenum. The collar is coupled to the duct and located closer to the back side than the front side of the plenum box. Or as alternatively described, collar is coupled to the duct at a location closer to the back of the top surface of the plenum box than the front of the plenum box. A first side of the nose section is connected to the front side of the plenum box. A second side of the nose section is offset below the first side relative the top surface. The second side of the nose section forms an air outlet of the plenum.

In another example, a vent termination is provided configured as a through fascia vent. In some examples, 100% of the passage defined through the through fascia vent is swept. In some examples, the shape of the through fascia vent may be changed in at least one plane by rotating one end of the through fascia vent relative another end of the through fascia vent.

In still another example, a building structure having a vent termination is provided. The building structure includes an interior of the building structure and fascia defining a portion of an exterior of the building structure. The vent termination is provided configured as a through fascia vent.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

FIGS. 15-32 are various views of the vent termination depicted in FIG. 14.

FIG. 26 is an exploded view of the flexible collar extender illustrated in FIG. 24B.

FIG. 27 is an exploded side view of a vent termination that includes an extender disposed between a plenum box and a nose section of the vent termination.

FIG. 29 is a cross sectional view of the extender depicted in FIG. 27.

FIGS. 30 and 31 are side views of extenders that may be disposed between a plenum box and a nose section of a vent termination.

FIG. 32 schematic side view of one example of a building structure, such as a house, office, hospital, commercial building, arena condominium, apartment and the like, having a vent termination located through a fascia of an eave of a roof.

To facilitate understanding, identical reference numerals have been used, where possible, to designate identical elements that are common to the figures. It is contemplated that elements of one embodiment may be beneficially incorporated in other embodiments.

DETAILED DESCRIPTION

Figure 1:
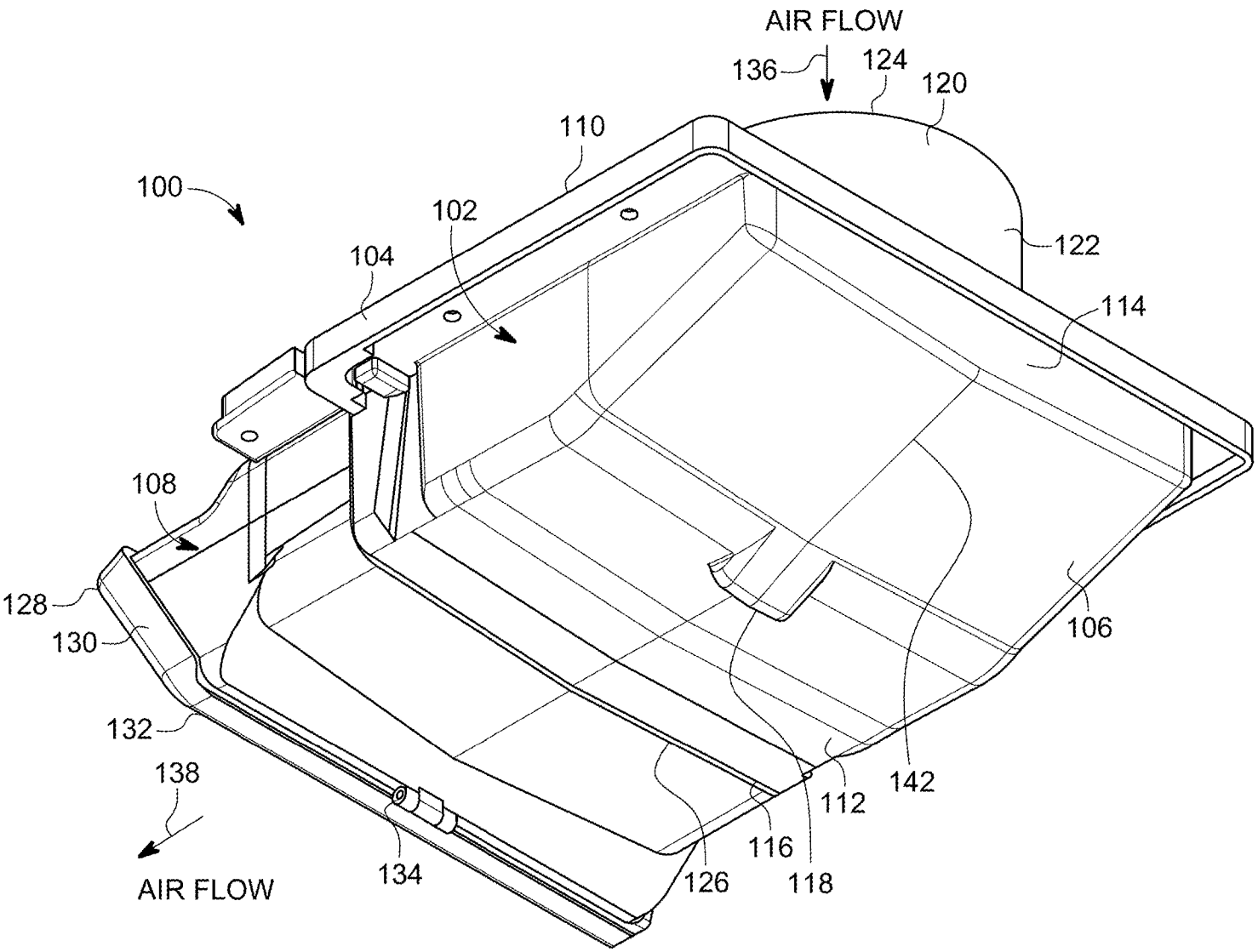
FIG. 1 is a schematic bottom isometric view of one example of a vent termination suitable for venting internal spaces within a building structure, particularly bathrooms and appliances.

A vent termination can serve as a termination of a bathroom exhaust fan system or other system exhausting a room or appliance within a building structure. In some examples described herein, the vent terminations are configured to extend through a soffit while other examples are configured to extend through a fascia of a building structure. The exemplary vent terminations direct air and other gases outwardly from the building structure from under the soffit or through the fascia of the building structure such that the exhausted are enters the environment outside of the building structure at or beyond the fascia of the building structure, making the probability of moisture laden air entering the attic through other vents in the soffit or other portions of the building structure highly unlikely. Although the exemplarily examples are illustrated as through soffit and through fascia vent terminations, it is contemplated the vent terminations described herein may be adapted to be utilized on other portions of a building structure.

In one example, the vent termination is configured as a soffit vent. The soffit vent includes an air inlet that is located in close proximity to the back side of the plenum box of the soffit vent. The bottom surface of the plenum box is also spaced at least 0.75, at least 1.0, or at least 1.06 or more inches from the top surface of the plenum box where the bottom surface transitions to the back side of the soffit vent. Each of these features help reduce the strength and size of vortexes formed between the air inlet and the back side of the plenum box. Reducing the size and strength of vortexes present in the plenum of the plenum box significantly improves the ease of air flow through the soffit vent, e.g., reduces conductance, which beneficially reduces the amount of fan energy consumption needed to flow air through the soffit vent. The back offset location of the air inlet defined where the collar is connected to the top surface additionally provides greater swept volume, which additionally contributes to reduced fan energy consumption, reduced probability of insect presence and/or biological growth within the plenum box, and reduced flow conductance that enables smaller and less expensive fans to the used in the exhaust system. In some examples, the back side and bottom surface transition is about 1.3 inches from the top surface and the collar is about 1¼ inches closer to the back of the plenum box relative to the front of the plenum box (or alternatively, collar is about 1¼ inches closer to the back of the top surface relative to the front of the top surface, wherein the air outlet of the soffit vent defines the front). As used herein, about infer a tolerance of plus/minus 1/16 of an inch.

Since the plenum box of the soffit vent is placed under the soffit, the reaction of the extracted moist air exiting the building and contacting the cooler temperature of the exposed soffit vent, causes the fan motor to work harder. With the position of the collar and air inlet in close proximity to the back side, the warmer air will bounce off the back side and flow more easily out the air exit disposed at the front of the soffit vent with reduced resistance compared to designs having a centrally located air inlet. Thus, the fan motor will require less power while providing a more direct and efficient air movement within the interior of the soffit vent.

In one example, the collar has, but is not limited to, a 4 inch diameter. The 4 inch diameter can support 4 and 6 inch ductwork. In some examples, the air outlet of the soffit vent has a sectional area of at least about 12.5 square inches, such as over 13.0 square inches. This sectional area enables higher cubic feet per minute (CFM) flows from larger ductwork to be utilized with smaller collar sizes, thereby allowing one size soffit vent to be utilized across a wide range of CMF requirements, which beneficially reduces tooling, manufacturing and logistical costs. Additionally, having an outlet in excess of 12.5 square inches enables the soffit vent to be utilized to exhaust most appliances. Examples of appliances include, but are not limited to, hot water heaters, ovens, ranges, microwave ovens, dryers, heaters and the like.

In some examples, the air outlet is interfaced with a grill. The grill has a hinge that enables the grill to be opened while always remaining attached to the soffit vent. Being attached to the soffit vent is beneficial as servicing of the soffit vent is often done from a ladder, which prevents the grill from inadvertently falling to the ground. The soffit vent includes a reservation (space, slot, etc.) in the air outlet behind the grill for spark arrestor or spark shield to protect against ambers entering the soffit vent.

The air outlet is located in a nose section of the soffit vent. The nose section has a first side and a second side connected by top, bottom and side surfaces. The first side of nose section is connected to the front side of the plenum box. The second side of the nose section is offset below the first side relative the top surface of the plenum box. Stated differently, a portion of the top and bottom surfaces at the first side of the nose section are stepped down below a portion of the top and bottom surfaces of the nose section at the first side of the nose section. The second side of the nose section forming an air outlet of the plenum.

The downward offset of the air outlet to be positioned below the fascia of the building structure. This enables air exiting the soffit vent to pass the exterior side of the fascia. The air outlet is generally below or just beyond the fascia. The air outlet does not to exceed a width of the gutter such that the air outlet defined at the end of the nose section will always be protected from inclement weather. As the air outlet is generally below or just beyond the fascia, extracted moist air exiting the soffit vent is never drawn back into the soffit or attic areas through other passive air flow vents.

In one example as soffit vent includes a plenum box, a collar, and a nose section. The plenum box has top and bottom surfaces, and front and back sides. The plenum box has a plenum partially defined between the top and bottom surfaces. The collar extends from the top surface and provides an air inlet into the plenum. The collar is located closer to the back side than the front side. A first side of the nose section is connected to the front side of the plenum box. A second side of the nose section is offset below the first side relative the top surface. The second side of the nose section forms an air outlet of the plenum.

In another example, a building structure having a vent termination configured as a soffit vent is provided. The building structure includes an interior of the building structure and soffit defining a portion of an exterior of the building structure. The soffit vent coupled by a duct to a fan operable to ventilate the interior of the building structure or an appliance disposed in the building structure. The soffit vent includes a plenum box, a collar, and a nose section. The plenum box has top and bottom surfaces, and front and back sides. The plenum box has a plenum partially defined between the top and bottom surfaces. The top surface of the plenum box is mounted to the soffit of the building structure. The collar extends from the top surface and provides an air inlet into the plenum. The collar extends through the soffit from the top surface and provides an air inlet into the plenum. The collar is coupled to the duct and located closer to the back side than the front side of the plenum box. Or alternatively described, collar is coupled to the duct at a location closer to the back of the top surface of the plenum box than the front of the plenum box. A first side of the nose section is connected to the front side of the plenum box. A second side of the nose section is offset below the first side relative the top surface. The second side of the nose section forms an air outlet of the plenum.

In any of the above examples, the following may also be optionally incorporated.

In some examples, the second side of the nose section extend less than 2 inches from a fascia of building structure.

In some examples, a gutter is mounted to a fascia of building structure. The second side of the nose section defining the air inlet does not extend beyond the gutter.

In some examples, the second side of the nose section extend less than 2 inches from a fascia of building structure.

In some examples, a grill is coupled to the second side of the nose section and covering the air outlet of the plenum. The grill has grates orientated to direct air exiting the air outlet in a direction laterally outward of a fascia of the building structure and below a plane of the soffit.

In some examples, the grill is hingedly coupled to the nose section.

In some examples, a removable spark arresting material is disposed in a reservation (space, slot, etc.) formed in the grill or the nose section proximate the grill. The spark arresting material may be steel wool or other material suitable for a spark arrestor or a spark shield that prevents ambers entering the soffit vent through the air outlet.

In some examples, an outside diameter of a cylindrical wall of the collar located within 1 inch of the back side of the plenum box. The centerline of the collar is closer to the back of the top surface of the plenum box than a front surface of the plenum box. The centerline of the collar may also be over a sloped portion of a bottom surface of the plenum box. Placing the center of the collar closer to the back side of the plenum box substantially reduces back pressure caused by excessive the air turbulence as the air exits the collar into the plenum of the plenum box. Thus, having the collar disposed off-center on the top surface of the plenum box towards the back side of the soffit vent significantly reduces the load on the exhaust fan motor by reducing the back pressure. In contrast, conventional plenum boxes having top center air inlet feeds with side air exits exhibit significant vortex and eddy generation to the detriment of fan motor performance and reduced flow through the plenum box.

In some examples, a transition between a wall forming the back side and the bottom surface of the plenum is at least 0.75 inches from the top surface of the plenum box. In other examples, the transition between a wall forming the back side and the bottom surface of the plenum is at least 1.0 inches from the top surface of the plenum box. In still other examples, the transition between a wall forming the back side and the bottom surface of the plenum is at least 1.06 inches from the top surface of the plenum box.

In some examples, the bottom surface is closer to the top surface at the transition than at a centerline of the collar.

The above features are illustrated in FIGS. 1-13.

Turning now to FIG. 1, a bottom isometric view of a soffit vent (e.g., a vent termination) 100 is illustrated. In the example depicted in FIG. 1 the soffit vent 100 includes a plenum box 102 coupled with a nose section 108. Air (or gas flow), shown by arrow 136, enters the with plenum box 102 and lease the soffit vent through the nose section 108, as shown by arrow 138. The plenum box 102 includes a housing 106 and a top plate 104. The housing 106 and the top plate 104 may be separate or a single piece of material. The housing 106 and the top plate 104 enclose a plenum (labeled 306 in FIG. 3) within the soffit vent 100. The top plate 104 includes collar 120 configured to be coupled to ductwork, as later illustrated in FIG. 13. The collar The soffit vent 100 has a top surface 110, a bottom surface 112, a back side 114, a front side 128 and a left side 140. The front side 128 of the soffit vent is also the front side 128 of the nose section 108. The example of the soffit vent 100 shown in FIG. 1 is depicted from the left side 140. The soffit vent 100 includes a centerline 142 that extends between the front and the back sides 128, 114 down the middle of the bottom surface 112 of the soffit vent 100. The portion of the bottom surface 112 defined by the housing 106 may be planar or have a convex or V-shape. Having a convex or V-shape assists channeling water or other condensation towards a drain 118 formed in the bottom surface 112. The nose section 108, top plate 104 and housing 106 of the soffit vent 100 may be formed from sheet metal, cast metal, plastic, or other suitable material.

As briefly discussed above the soffit vent 100 includes a plenum box 102. The plenum box includes a front side 116. The back side 114 of the soffit vent 100 defines the back side 114 of the plenum box 102 (and the housing 106). The bottom surface 112 of the soffit vent 100 defines the bottom surface 112 of the plenum box 102 (and the housing 106). The bottom surface of the plenum box 102 includes a drain 118. The centerline 142 of the soffit vent 100 is also the centerline 142 of the plenum box 102. The top surface 110 of the soffit vent 100 defines the top surface 110 of the plenum box 102 (and the top plate 104). The plenum box 102 includes a collar 120 extending from the top surface 110 of the top plate 104. The collar 120 has a cylindrical wall 122 which defines an air inlet 124. The air inlet 124 allows for air flow 136 to enter the plenum box 102 of the soffit vent 100. The centerline of collar 120 is located closer to the back side 114 than the front side 116 of the plenum box 102. The cylindrical wall 122 of collar 120 is also located much closer to the back side 114 of the top plate 104 than the front side of the top plate 104.

As briefly described above the soffit vent 100 includes the nose section 108. The nose section 108 includes an interior side 126 and a front side 128. The second side 128 of the nose section 108 is offset below the interior side 126 relative to the top surface 110 of the plenum box 102. The centerline 142 of the soffit vent 100 is also the centerline 142 of the nose section 108. In the example depicted in FIG. 1, the interior side 126 of the nose section 108 is coupled to the front side 116 of the plenum box 102. In the example depicted in FIG. 1 the second side 128 of the nose section 108 is coupled to a grill 130. Optionally the grill 130 is attached to the nose section 108 with a hinge 134 (also shown as hinge 770). Other types of attachment may be alternatively utilized as commonly known or later developed to attach the grill 130 to the nose section 108, such as press or snap fit, among others. The second side 128 of the nose section 108 defines an air outlet 132. Air flow 138 exits the soffit vent 100 through the air outlet 132. In some examples, a removable spark arresting material is disposed in a reservation (space, slot, etc.) formed in the grill or the nose section proximate the grill. The spark arresting material may be steel wool or other material suitable for a spark arrestor or a spark shield that prevents ambers entering the soffit vent through the air outlet.

Figure 2:
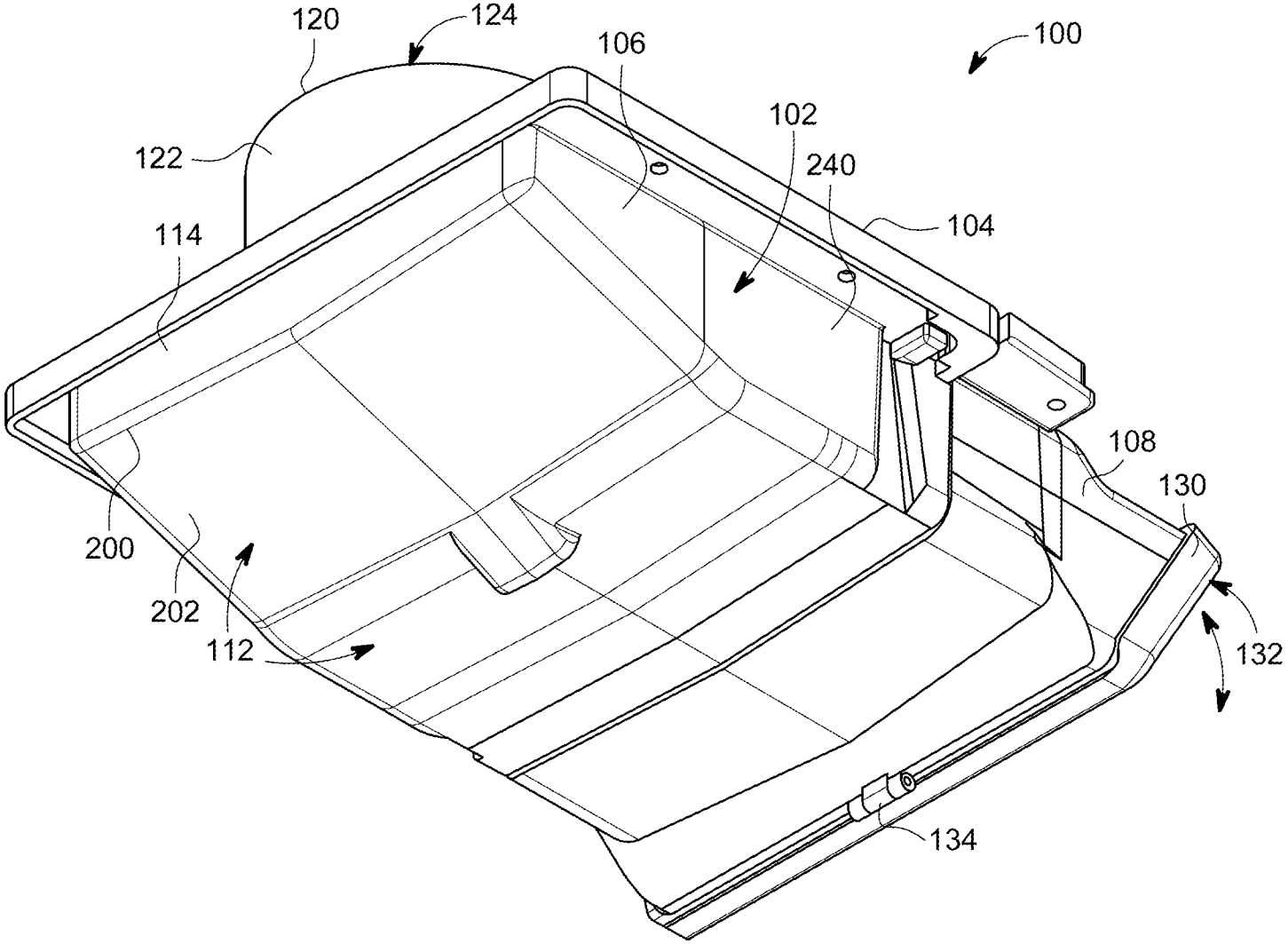
FIGS. 2-12 are various views of the vent termination depicted in FIG. 1.

FIG. 2 depicts a bottom isometric view of the soffit vent 100 illustrated in FIG. 1. The right side 240 of the soffit vent 100 is shown in FIG. 2. As briefly described above the housing 106 if the plenum box 102 defines a portion of the bottom surface 112 of the soffit vent 100. A portion 202 of the bottom surface 112 is slanted outwards towards the top surface 110. The slanted portion 202 of the bottom surface 112 meets the back side 114 of the housing 106 at a transition 200.

Figure 3:
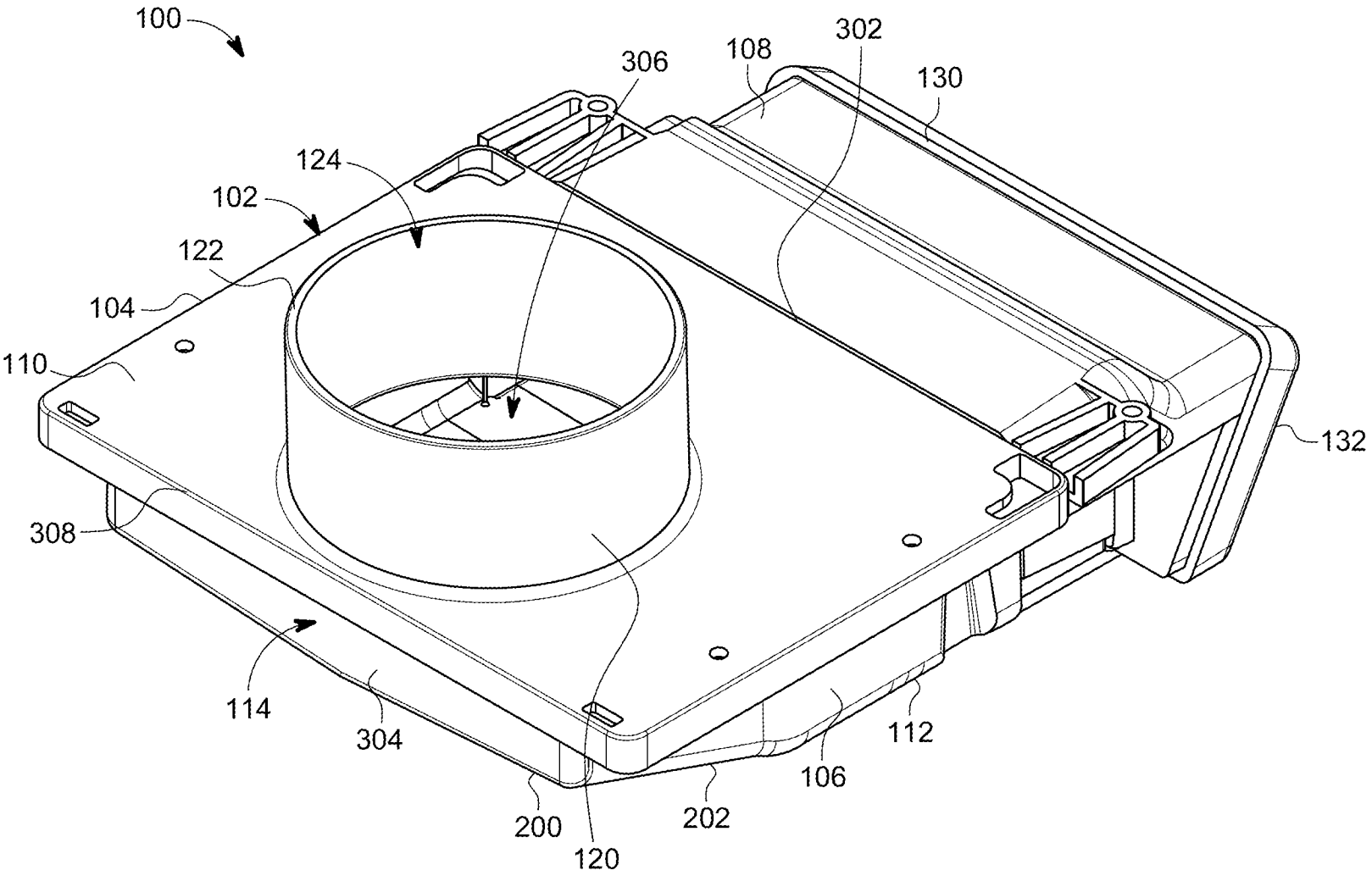

Turning now to FIG. 3, a top isometric view of the soffit vent 100 is illustrated, showing the back and right sides 114, 240. A plenum 306 defined inside the plenum box 102 between the top plate 104 and the bottom surface 112 of the housing 106 can be seen through the air inlet 124 of the collar 120. The top plate 104 of the plenum box 102 has a front side 302 and a back side 308. The back side 308 of the top plate 104 is also part of the back side 114 of the soffit vent 100. The front side 302 of the top plate 104 is proximate and adjacent to the nose section 108. A back wall 304 of the plenum box 102 also defined part of the back side 114 of the soffit vent 100. The back wall 304 of the housing 106 of the plenum box 102 is coupled to and may be located slightly forward of the back side 308 of the top surface 110 of the top pate 104. In the example depicted in FIG. 1, back wall 304 of the housing 106 is shown as vertical. Alternatively, the back wall 304 of the housing 106 could be at an acute angle with respect to the top surface 110. That is, the back wall 304 of the housing 106 may extend from the top plate 104 at an acute angle with respect to the top surface 110 towards the nose section 108 until the back wall 304 meets the slanted portion 202 of the bottom surface 112 at the transition 200. As discussed above the collar 120 which forms the air inlet 124 is positioned in closer proximity to the back side 308 than the front side 302 of the top plate 104.

Figure 4:
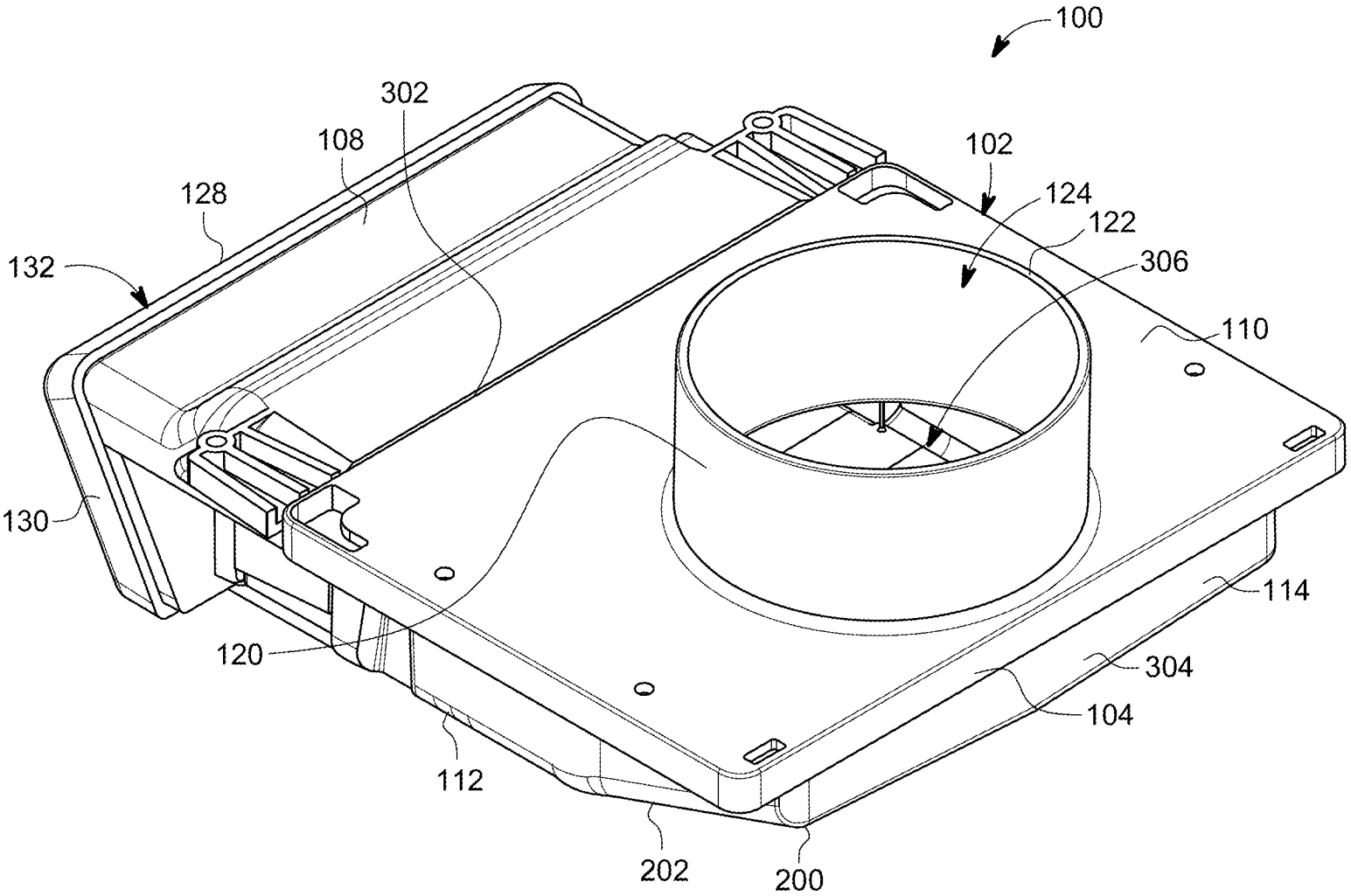

FIG. 4 depicts a top isometric view of the soffit vent 100 illustrated in FIG. 3, showing the back and the left sides 114, 140.

Figure 5:
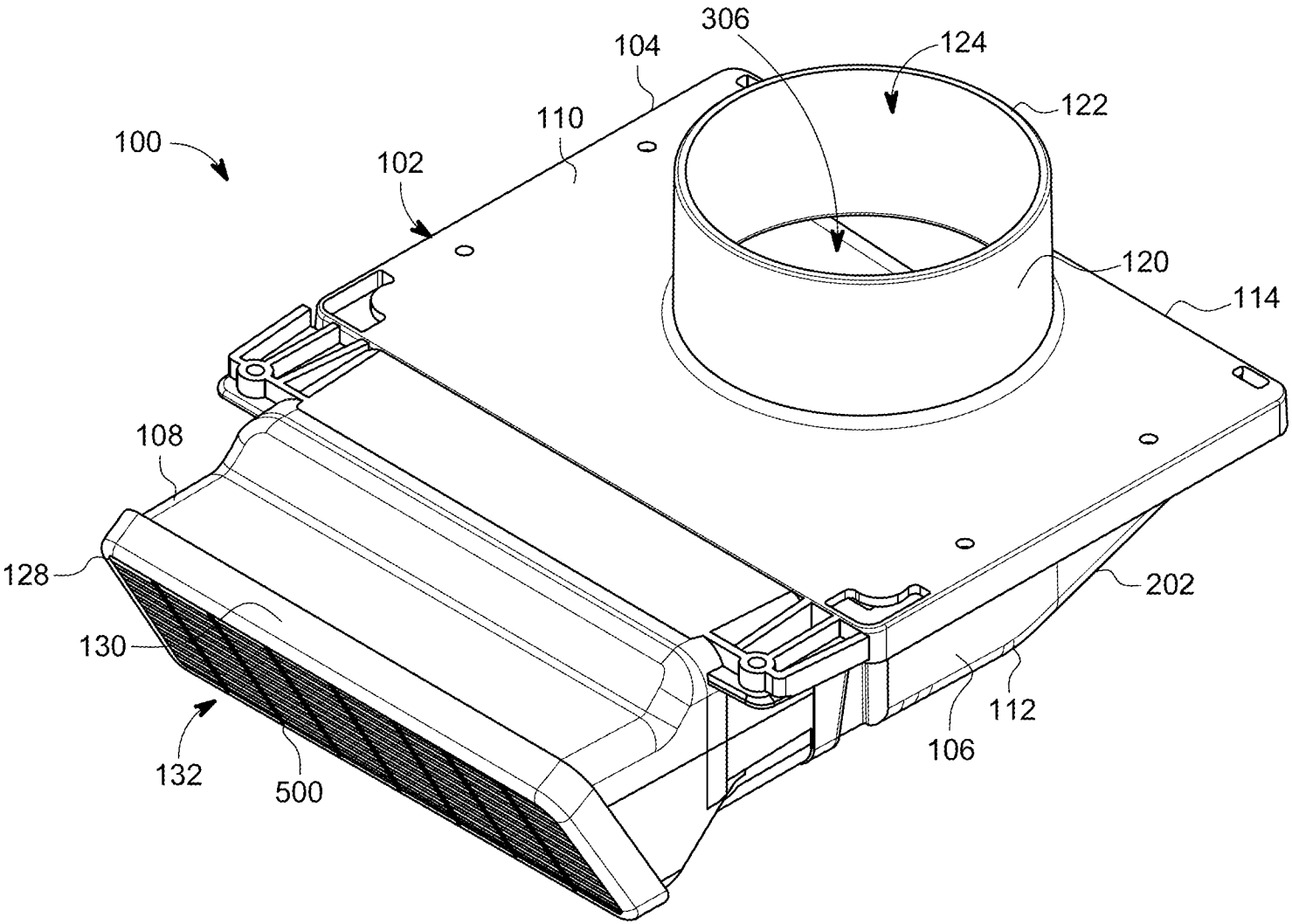
Figure 6:
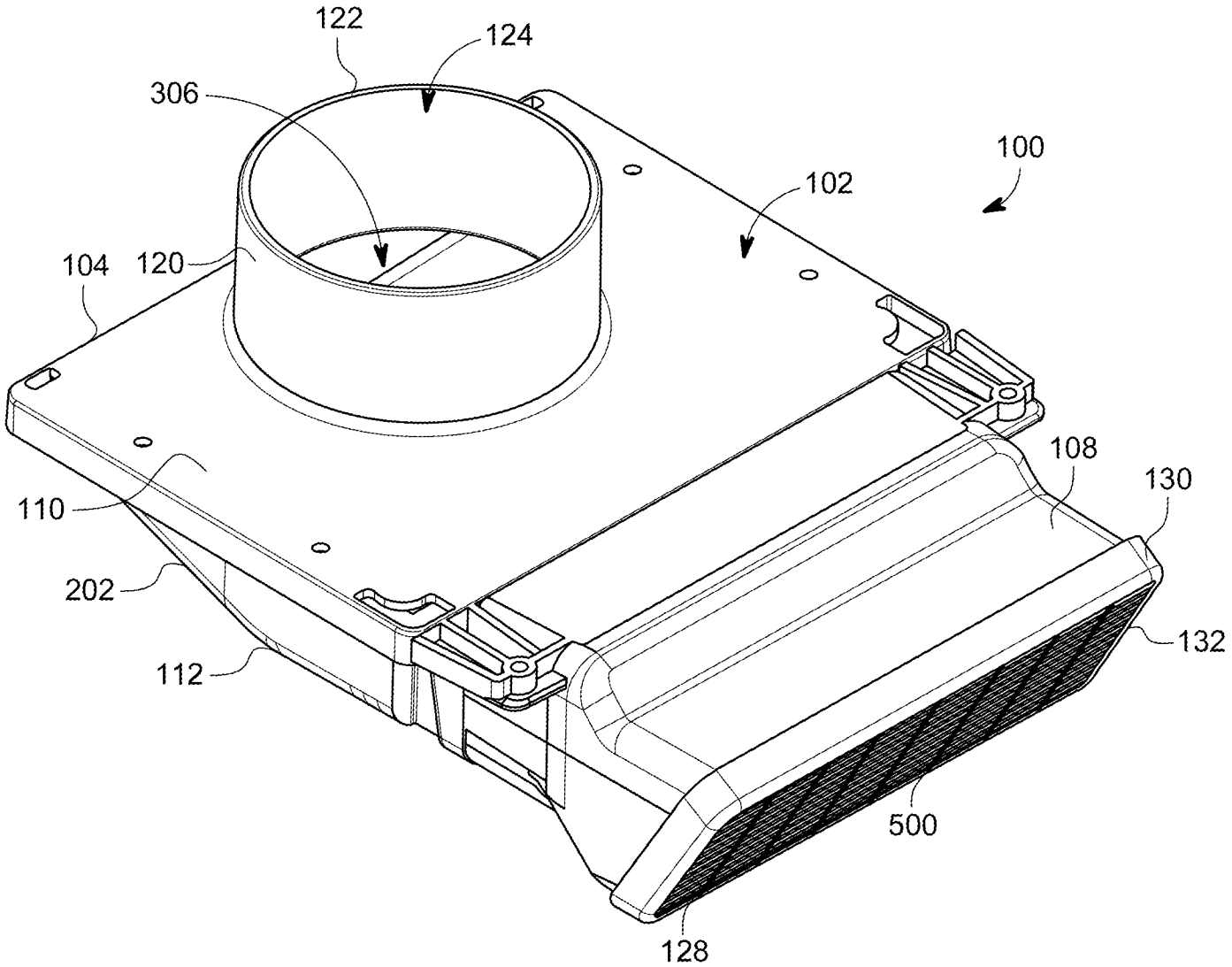

FIGS. 5 and 6 depicts a top isometric view of the soffit vent 100 illustrated in FIG. 4. The front and the left sides 128, 140 of the soffit vent 100 are shown in FIG. 5. The front and the right sides 128, 240 of the soffit vent 100 are shown in FIG. 6. As briefly described above, the nose section 108 of the soffit vent 100 forms the air outlet 132 of the soffit vent 100. The air outlet 132 allows air flow 138 to exit the plenum 306 disposed within the plenum box 102. In the example shown in FIG. 5, the air outlet 132 of the nose section 108 is covered by a grill 130. The grill 130 may be press fit, snap fit, or coupled by a hinge or latch, to the nose section 108. The grill 130 includes openings (i.e. grates) 500 which are designed to prevent debris, and insects from passing through the air outlet 132 and into the soffit vent 100. The openings between the grates 500 of the grill 130 are additionally designed to direct air flow 138 from the air outlet 132 upward or parallel relative to the top surface 110. As depicted in FIG. 5 the plenum box 102 features a sloped portion 202 of the bottom surface 112.

Figure 7:
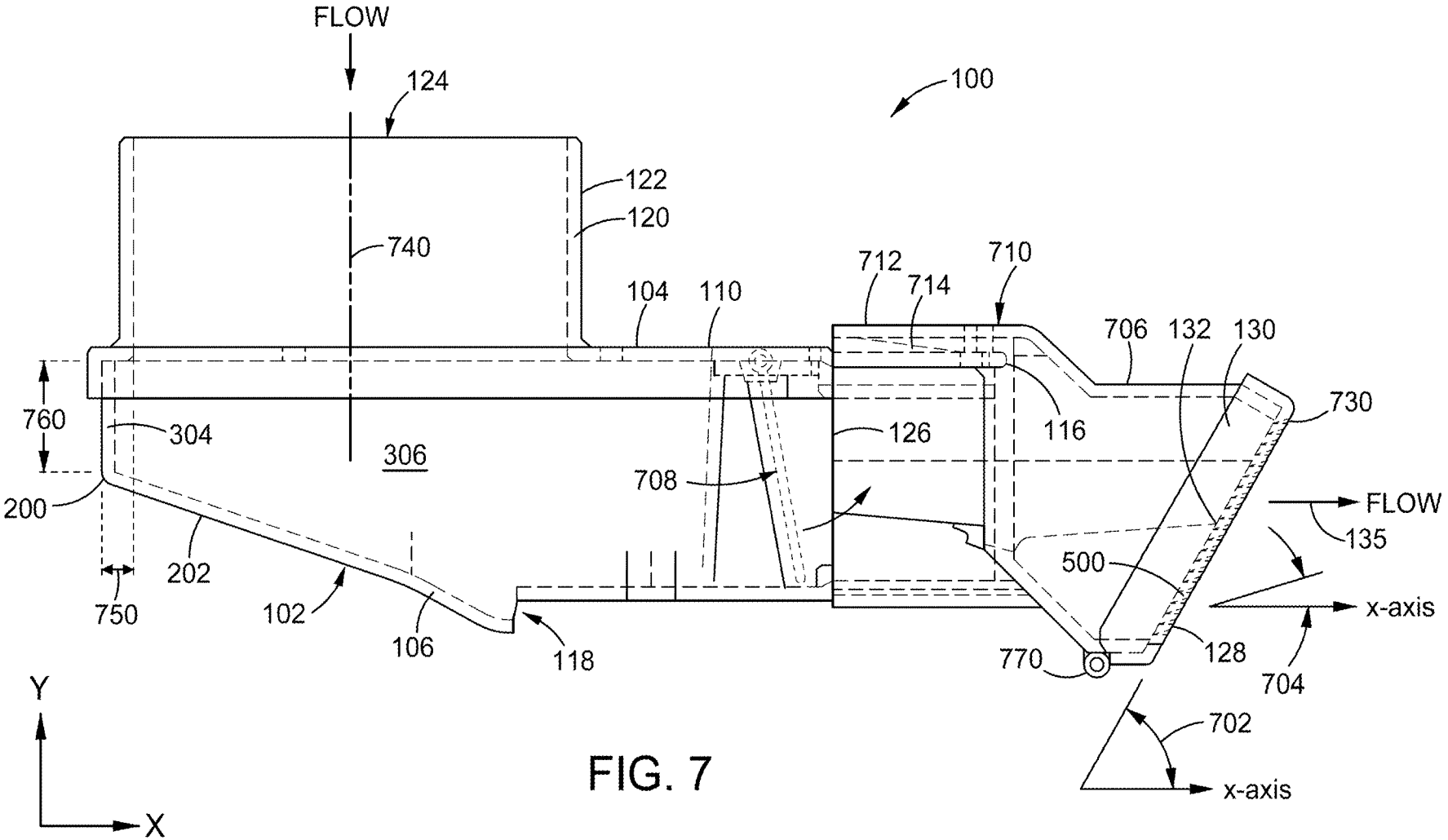

Turning now to FIG. 7, which depicts a cross sectional view of the soffit vent 100. As described above the soffit vent 100 includes the plenum box 102 coupled to the nose section 108. The plenum box 102 coupled to the nose section 108 via a press fit, snap fit, weld, bond, latch, fasteners or other suitable technique. In the example depicted in FIG. 7, the plenum box 102 includes female inner tube 714 that slides into a male sleeve 710 of the nose section 108.

As described above the plenum box 102 includes the top plate 104. The top surface 110 of the top plate 104 is generally planar and parallel to the x-axis such that the top plate 104 of the soffit vent 100 may be mounted flush against the soffit as later illustrated in FIG. 13. As described above, the collar 120 is located in close proximity to the back wall 304 of the plenum box 102. The collar 120 has a centerline 740 that is perpendicular to the top surface 110 of the top plate 104, and thus, is generally aligned with the y-axis. As mentioned above in one example the back wall 304 is vertical and shown perpendicular to the x-axis. In another example, the back wall 304 is at angle less than 90 degrees with respect to the x axis, with the end of the back wall 304 being closer to the nose section 108 relative to the end of the back wall 304 that is proximate the top plate 104.

The transition 200 couples the back wall 304 to the sloped portion 202 of the bottom surface 112. The drain 118 is coupled to the sloped portion 202 of the bottom surface 112. The sloped portion 202 of the bottom surface 112 is closer to the top surface 110 at the transition 200 than at the drain 118. The sloped portion 202 of the bottom surface 112 directs condensation that may be present within the plenum 306 towards the drain 118 and out of the soffit vent 100. As the plenum box 102 is kept free of condensation, there is a reduced probability of biological growth, such as mold, mildew and the like, within the soffit vent 100.

The bottom surface 112 of the plenum box 102 at the transition 200 is spaced at least 0.75 inches, at least 1.0 inches, or at least 1.06 inches or more from the top plate 104 of the plenum box 102. Stated differently, the back wall 304 of the housing 106 has a length 760 from the transition 200 to the edge of the housing 106 that abuts the top plate 104 of at least 0.75 inches, at least 1.0 inches, or at least 1.06 inches or more. Additionally, the centerline 740 of the collar 120 is much closer to the back wall 304 of the housing 106 than the nose section 108. The close proximity of the cylindrical wall 122 of the collar 120 to the back wall 304 and the spacing of the top surface 110 to the bottom surface 112 of the plenum box contributes to reducing the strength and size of vortexes formed between the air inlet 124 and the back wall 304 of the plenum box. Reducing the size and strength of vortexes present in the plenum 306 of the plenum box 102, significantly improves the ease of the air flow through the soffit vent 100, thus allowing for smaller fans and reduced energy consumption. Moreover, the close position of the collar 120 relative to the back wall 304 results an greater swept volume and reduced dead spaces, and consequently, less propensity to support undesirable biological growth within the soffit vent 100.

At least one of the plenum box 102 and nose section 108 includes a damper flap 708. The damper flap 708 is configured to prevent air flow from the air outlet 132 towards the air inlet 124. In the example depicted in FIG. 7, the damper flap 708 is disposed in the plenum box 102 near the front side 116. The damper flap 708 is hinged near the top plate 104 of the plenum box 102 such that gravity closes the damper flap 708. Air passing out of the plenum 306 towards the nose section 108 opens the damper flap 708. When there is no flow out of the plenum 306 or flow in the reverse direction, the damper flap 708 returns to the closed position which effectively prevents water, animals and insects from entering the plenum 306 in the plenum box 102.

As described above the front side 116 of the plenum box 102 is coupled to the interior side 126 of the nose section 108. The second side 128 of the nose section 108 is offset below the interior side 126 relative to the top surface 110 of the plenum box 102. The offset results in a lower portion 706 of the top surface 710 of the nose section 108 proximate the second side 128 and air outlet 132 being below an upper portion 712 of the nose section 108 proximate the interior side 126 and the plenum box 102.

As described above, the second side 128 of the nose section 108 includes the air outlet 132 that is connected the plenum 306. Air flow out of the air outlet 132 is illustrated by arrow 138. The air outlet 132 of the second side 128 of the nose section 108 is interfaced with the optional grill 130. In the example depicted in FIG. 7, the grill 130 is coupled by a hinge 134 to the nose section 108. The hinge 134 allows the grill 130 to be opened that the interior of the nose section 108 can be inspected and/or cleaned.

The grill 130 includes grates 500 which is designed to direct air flow 138 in a direction upward or parallel relative to the top surface 110 of the plenum box 102. An exposed face 730 of the grill 130 is disposed at an angle 702 relative to the x-axis. The angle 702 may be between zero and 90 degrees, and in one example, is an acute angle, such as between 45 and 75 degrees. The grates 500 are disposed at an angle 704 relative to the x-axis. The angle 704 may be between-60 and 60 degrees, and in one example, is an acute angle, such as between 30 and 75 degrees. The angles 702, 704 may alternatively have other values. In an alternative example, the grates 500 can rotate to function as a damper to open and close the air outlet 132.

FIG. 7 also illustrates the back offset location of the collar 120 on the top plate 104 and plenum box 102. The centerline 740 of the collar 120 is about 1¼ inches closer to the back wall 304 of the housing 106 of the plenum box 102 relative to the front side 116 of the plenum box 102. In the example depicted in FIG. 7, the cylindrical wall 122 of the collar 120 is disposed at a horizontal distance 750 from the back wall 304 of the housing 106. The distance 750 may be from zero to about 1 inch, for example, less than 0.75 inches or less than 0.50 inches. The distance 750 may be measured from the inner surfaces of the back wall 304 and cylindrical wall 122 of the collar 120, alternatively, from the outer surfaces of the back wall 304 and cylindrical wall 122 of the collar 120.

Figure 8:
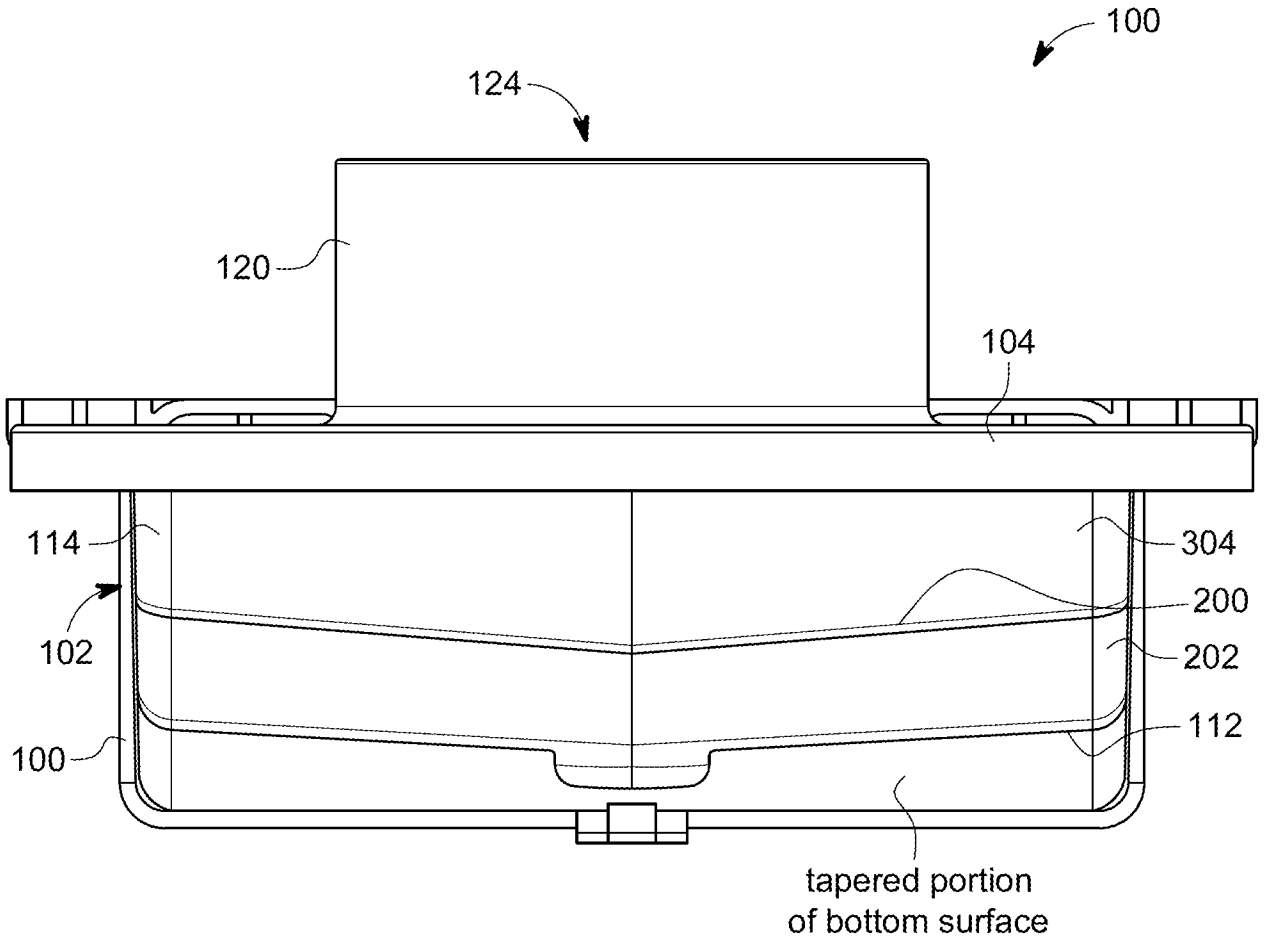
Figure 9:
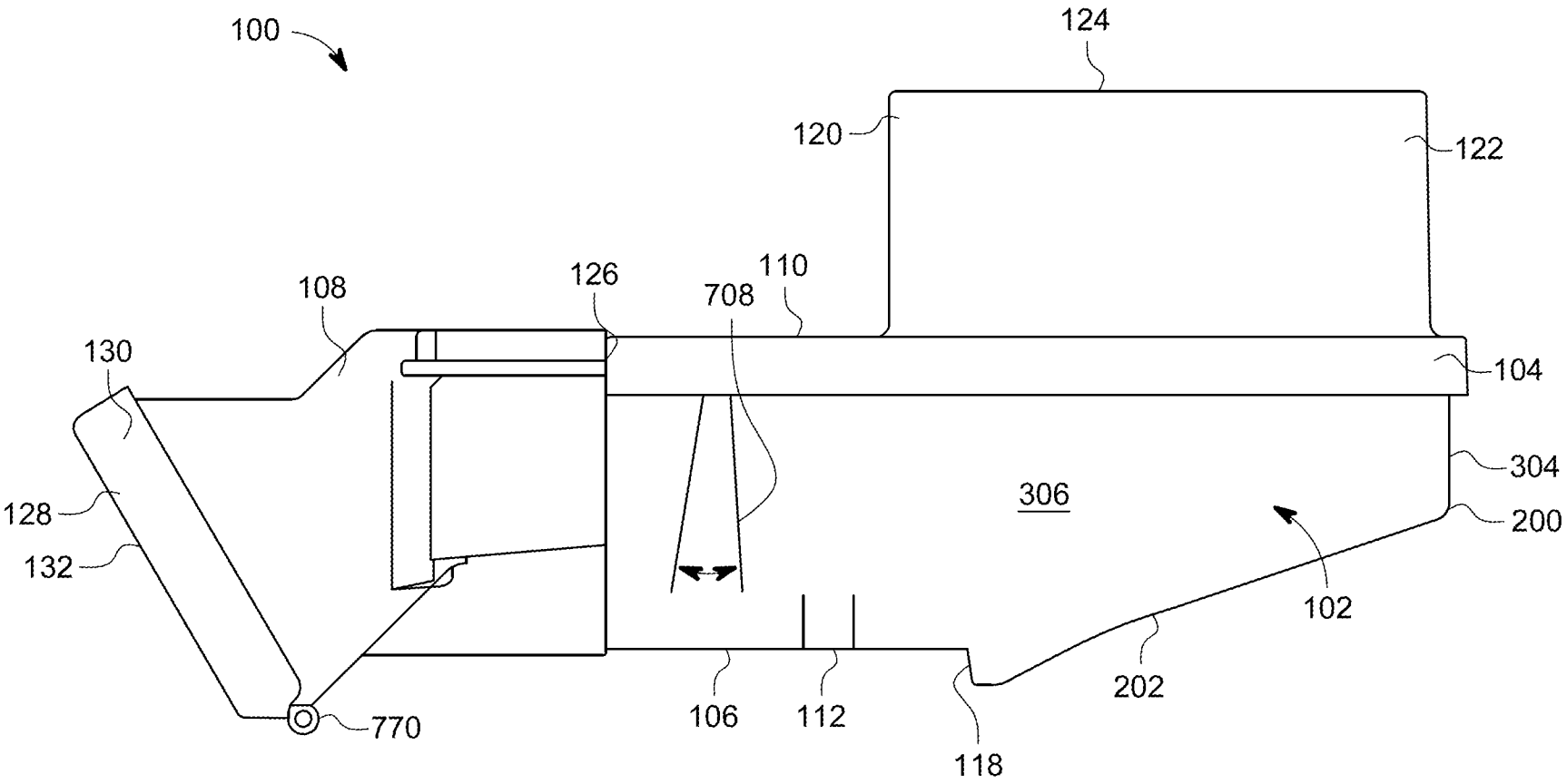
Figure 10:
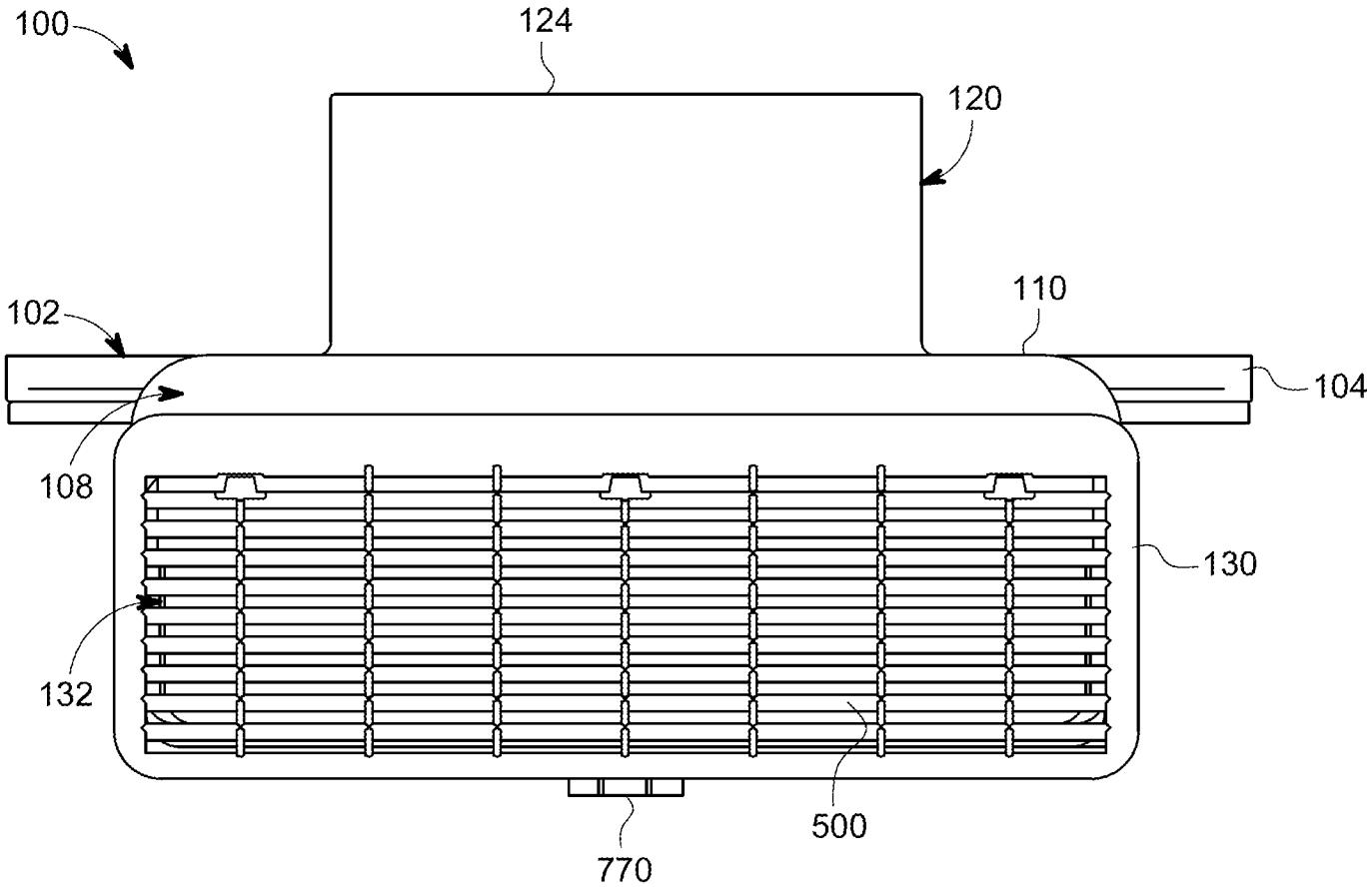
Figure 12:
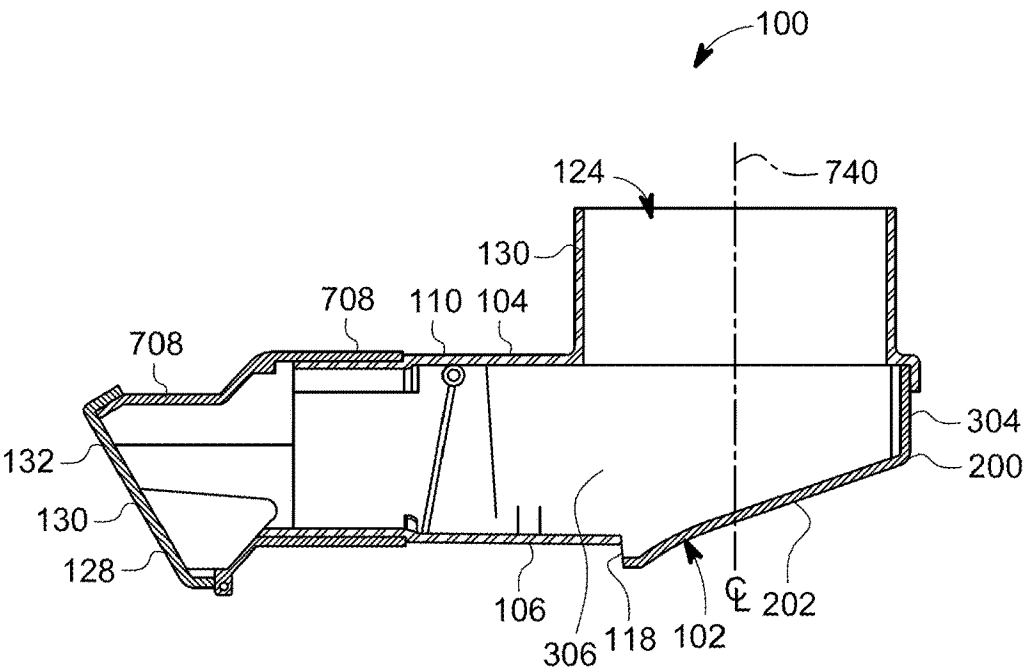
Figure 11:
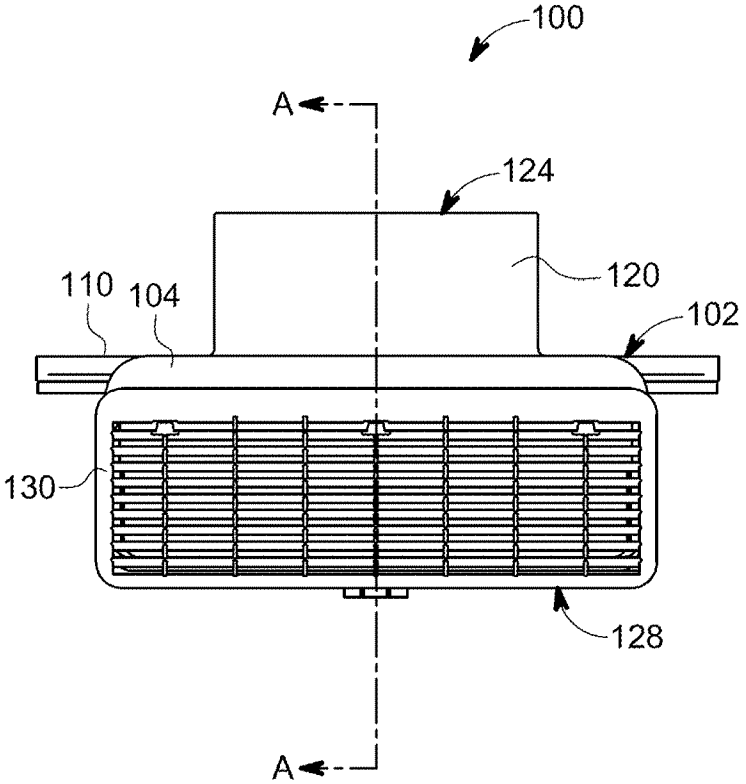

FIGS. 8, 9 and 10 are rear, sectional and front views of the soffit vent 100 illustrated in FIG. 1. FIG. 11 is a front view of the soffit vent 100 illustrated in FIG. 1 including a section line A-A. FIG. 12 is a sectional view of the soffit vent 100 taken along section line A-A in FIG. 11. FIGS. 8-12 are provided to more clearly illustrate the overall look and character of the soffit vent 100.

Figure 13:
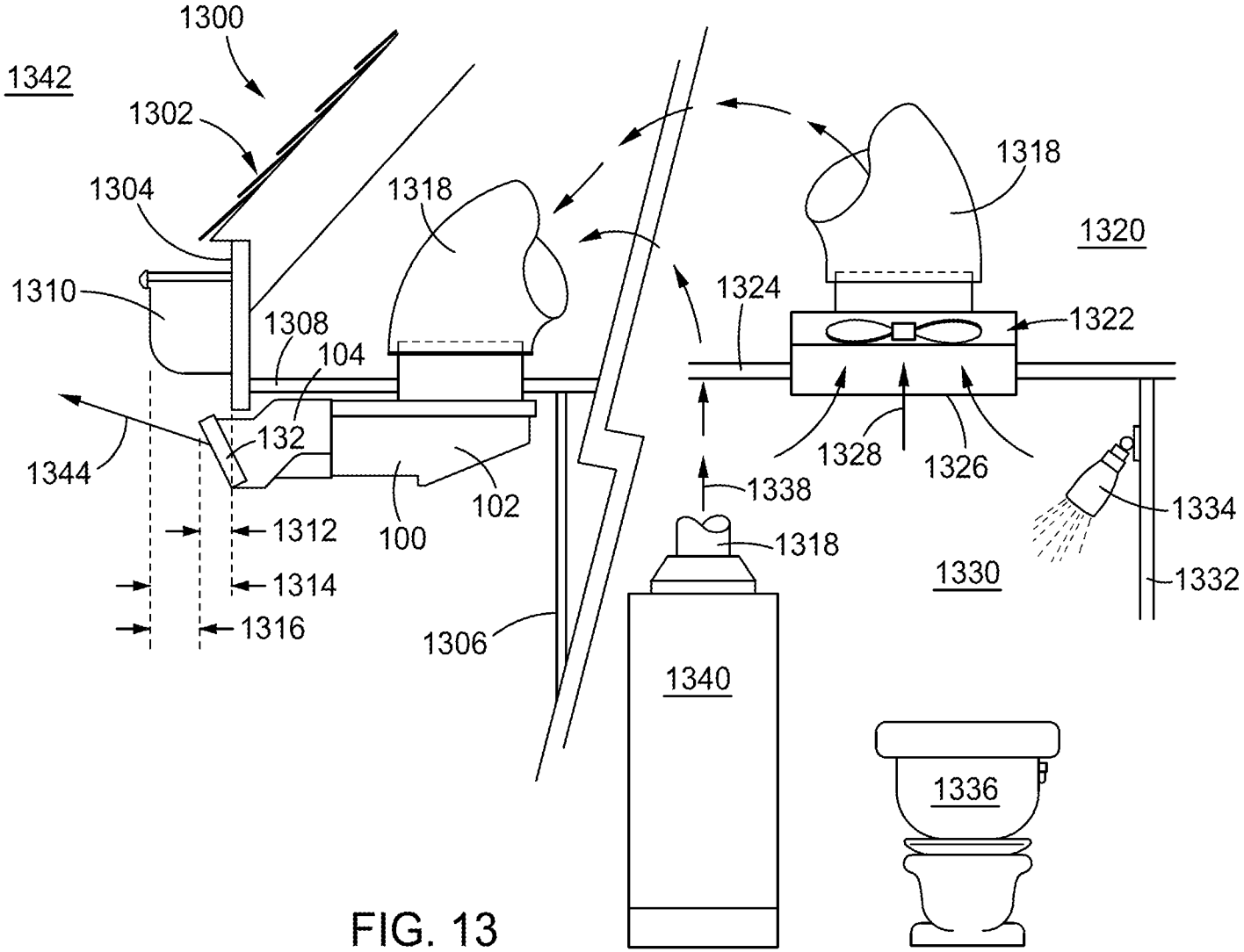
FIG. 13 schematic side view of one example of a building structure, such as a house, office, hospital, commercial building, arena condominium, apartment and the like, having a vent termination located below an eave of a roof through a soffit.

FIG. 13 depicts an example of a building structure 1300 having a soffit vent 100. The building structure 1300 has an interior 1320 that is separated from the outside environment 1342 by the roof 1302 and exterior walls 1306 of the building structure 1300. The interior 1320 may also include an interior room 1330 to be vented and/or having appliances to be vented via the soffit vent 100. The building structure 1300 generally includes eaves defined between the roof 1302 and exterior walls 1306. The eaves includes a fascia 1304 and a soffit 1308. The soffit vent 100 is mounted to the soffit 1308. The soffit vent 100 coupled by a duct (e.g., ductwork) 1318 to an exhaust fan 1322 operable to ventilate the interior space 1330 of the building structure 1300 though a vent 1326 or an appliance 1340 disposed within the inside 1320 the building structure 1300.

Examples of an interior room 1330 include but are not limited to a bathroom, a utility room, a kitchen, and the like. The interior space 1330 includes a ceiling 1324 and interior wall 1332. In one example the interior space 1330 is a bathroom and includes at least one of a toilet 1336 or a shower 1334. The shower 1334 may be attached to an interior wall 1332. The use of at least one of the toilet 1336 or the shower 1334 may result in the presence of moisture laden air 1328 within the interior space 1330, which in some examples, is removed from the interior space 1330 via a vent 1326 coupled by ductwork to the soffit vent 100.

Optionally the interior 1320 includes an appliance 1340. Examples of appliances include, but are not limited to, hot water heaters, ovens, ranges, microwave ovens, dryers, heaters and the like. The appliance 1340 generally has an exhaust that is desirable and/or required by building code to be exhausted to the environment 1342 outside of the building structure 1300, which in some examples, via the soffit vent 100.

The plenum box 102 of the soffit vent 100 is mounted to the underside of the soffit 1308. The collar 120 of the plenum box 102 of the soffit vent 100 extends into the interior 1320 of the building structure 1300 through a hole formed through the soffit 1308. The collar 120 is coupled to the duct 1318. The duct 1318 is coupled o the exhaust fan 1322 and/or exhaust of the appliance 1340.

The exemplary soffit vent 100 described herein directs the air outwardly from the building structure 1300 from under the soffit 1308 of the building structure such that the exhausted are enters the environment outside of the building structure at or beyond the fascia of the building structure, making the probability of moisture laden air entering the attic through other vents in the soffit or other portions of the building structure highly unlikely.

Since the plenum box of the soffit vent is placed under the soffit, the reaction of the extracted moist air exiting the building and contacting the cooler temperature of the exposed soffit vent, causes the fan motor to work harder. With the position of the collar and air inlet in close proximity to the back side, the warmer air will bounce off the back side and flow more easily out the air exit disposed at the front of the soffit vent with reduced resistance compared to designs having a centrally located air inlet. Thus, the fan motor will require less power while providing a more direct and efficient air movement within the interior of the soffit vent.

A gutter 1310 is optionally attached to the fascia 1304 and is positioned below the roof 1302. The gutter 1310 extends a distance 1314 from the fascia 1304. The nose section 108 of the soffit vent 100 extends a distance 1312 from the fascia 1304. In some examples, the second side of the nose section 108 extend less than 2 inches from a fascia 1304 of building structure 1300. The second side of the nose section 108 defining the air outlet 132 does not extend beyond the gutter 1310. In one example, the nose section 108 of the soffit vent 100 is recessed a distance 1316 from the gutter 1310. This allows the gutter 1310 to shield the air outlet 132 of the nose section 108 of the soffit vent 100 from the elements (i.e., rain, snow, etc.).

In some examples, the grill is coupled to the second side of the nose section and covers the air outlet 132 of the soffit vent 100. The grill has grates orientated to direct air exiting the air outlet in a direction 1344 laterally outward of a fascia 1304 of the building structure 1300 and below a plane of the soffit 1308.

Figure 14:
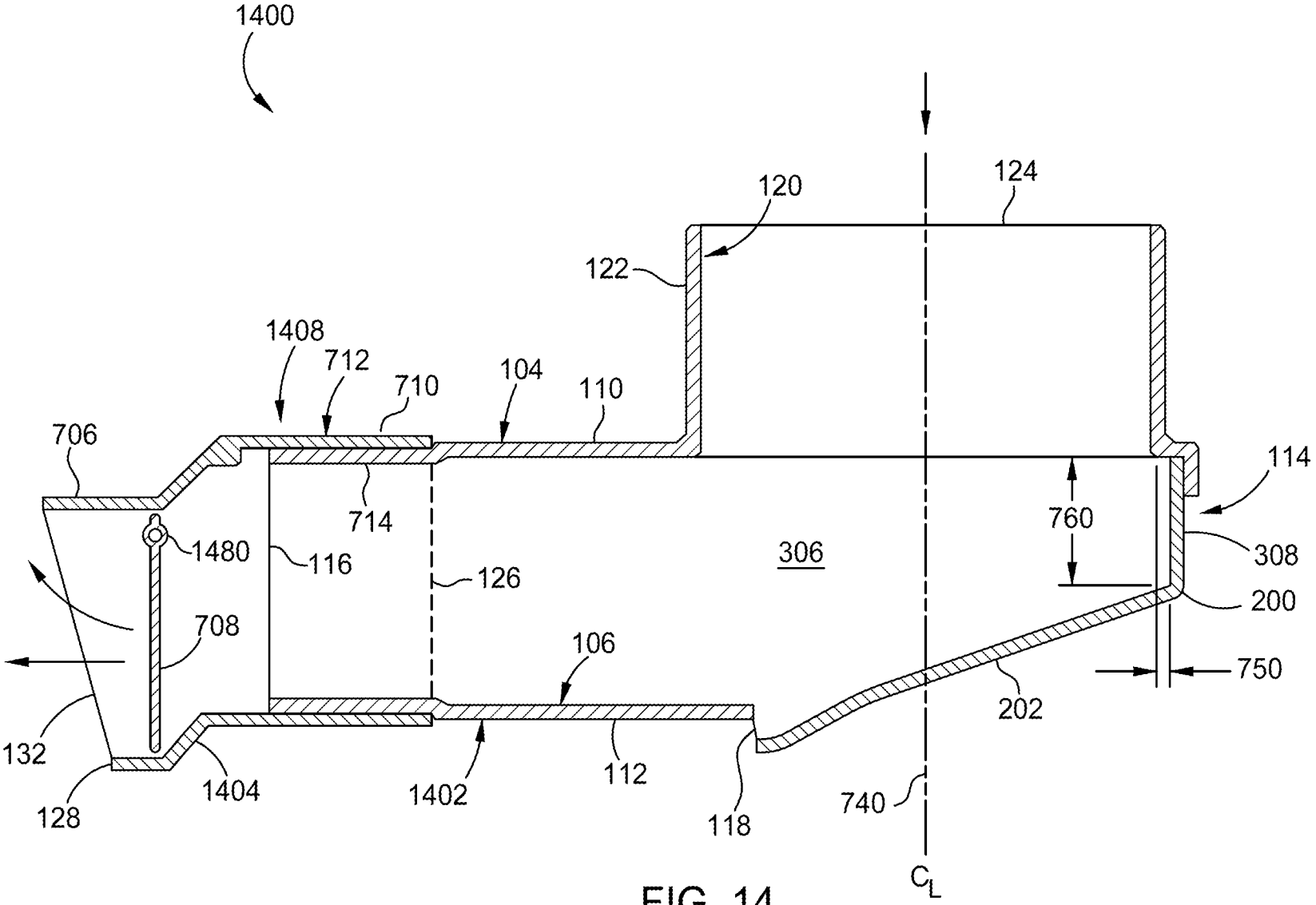
FIG. 14 is a schematic side sectional view of another example of a vent termination suitable for venting internal spaces within a building structure.
Figure 15:
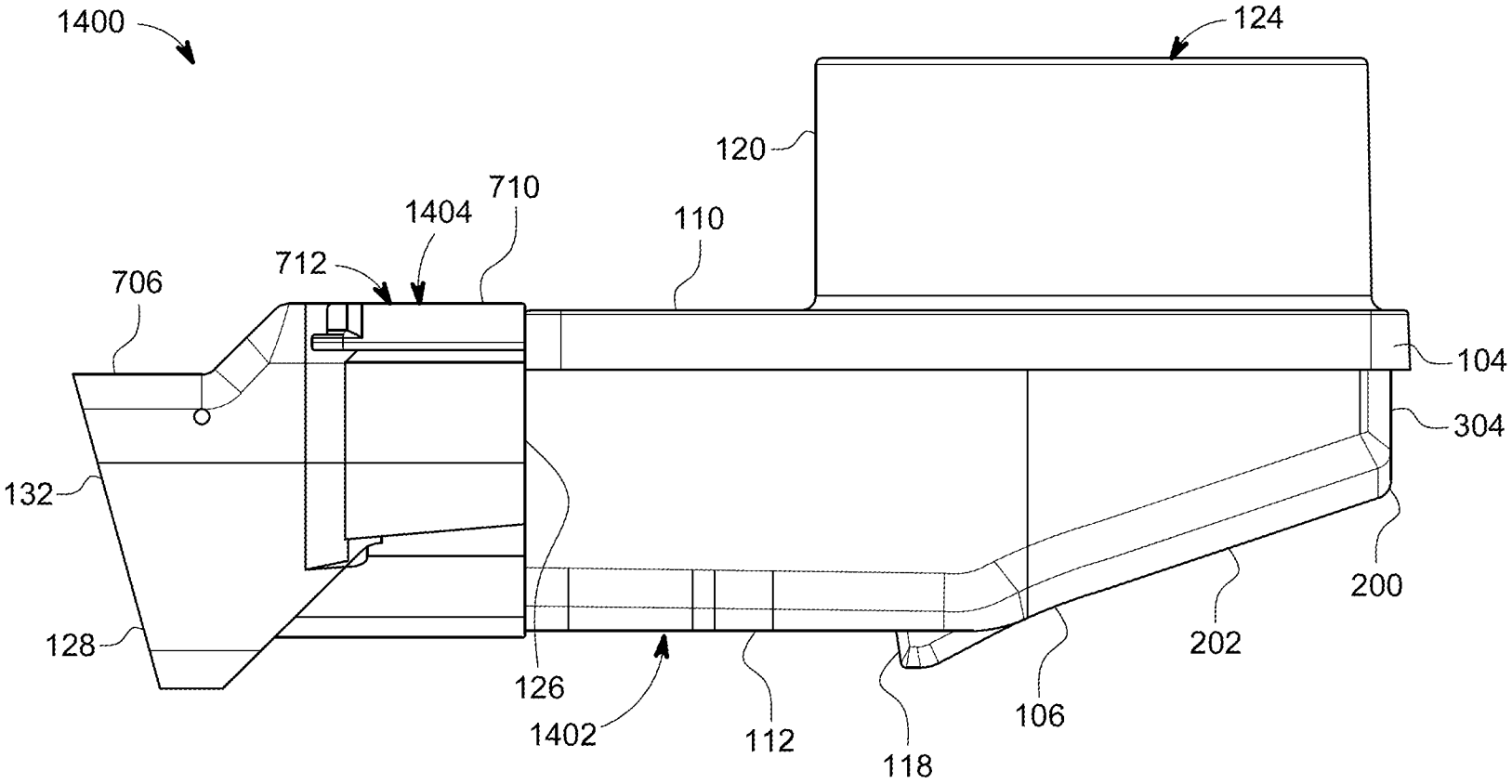
Figure 16:
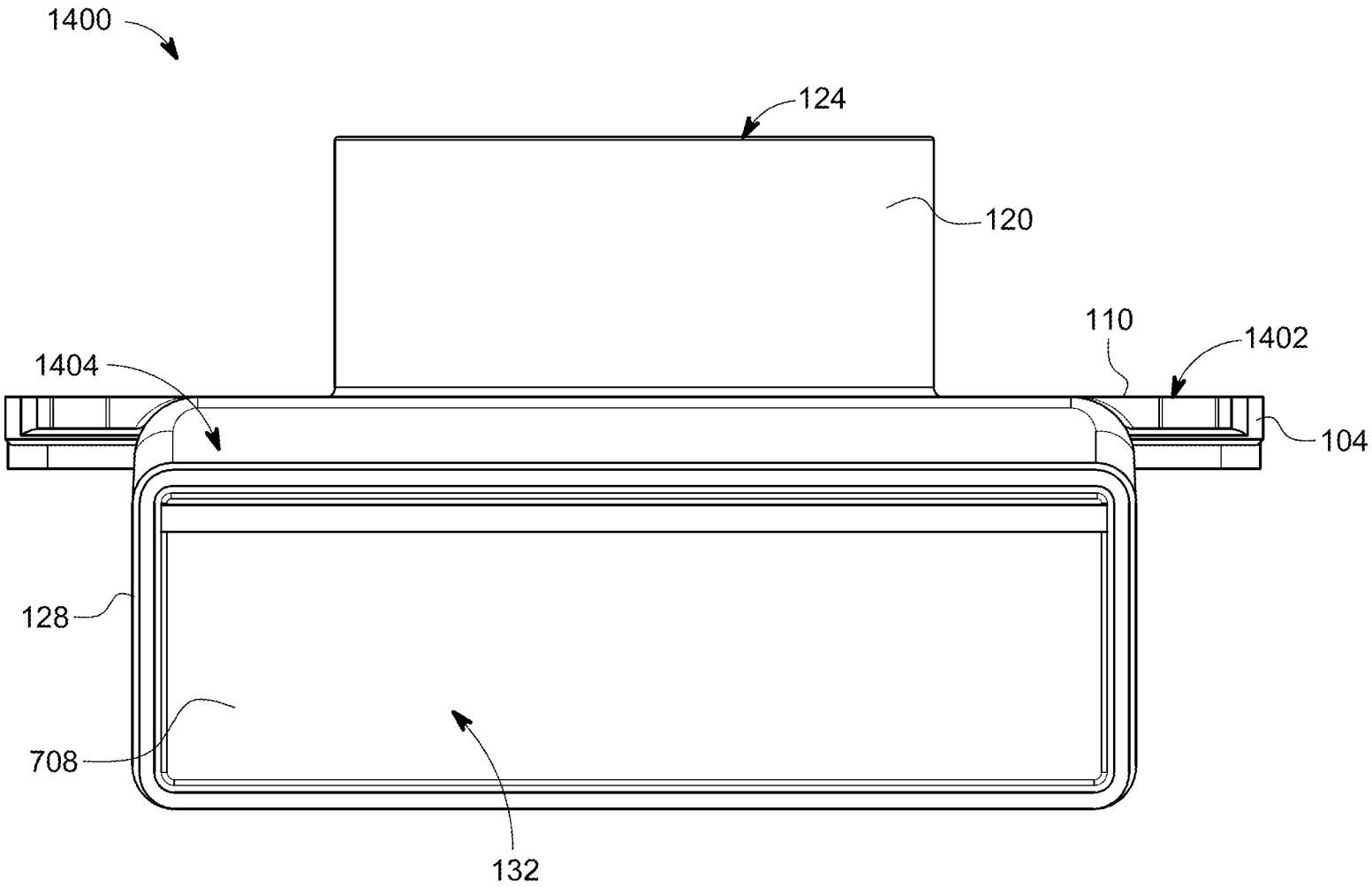
Figure 17:
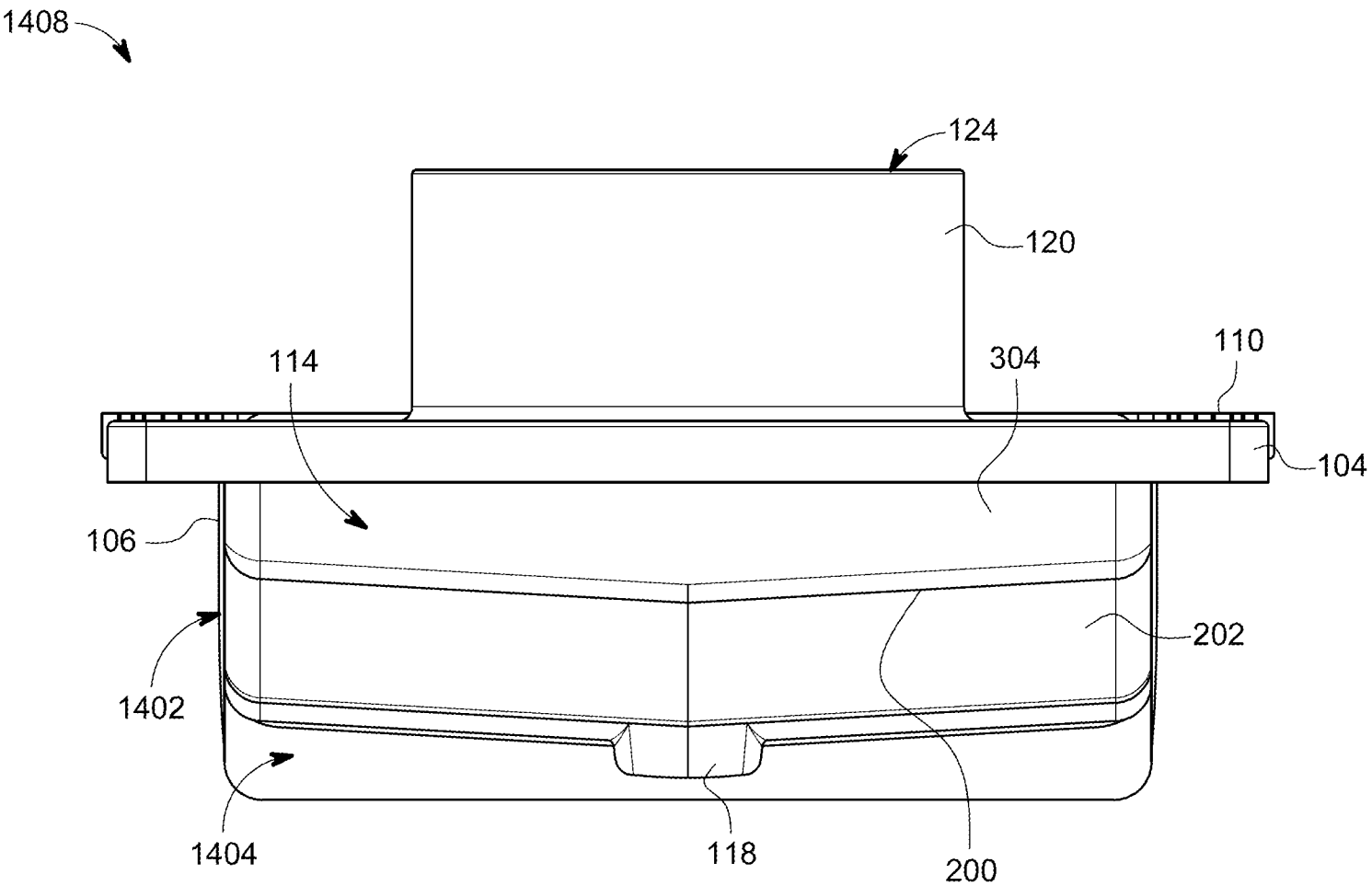
Figure 18:
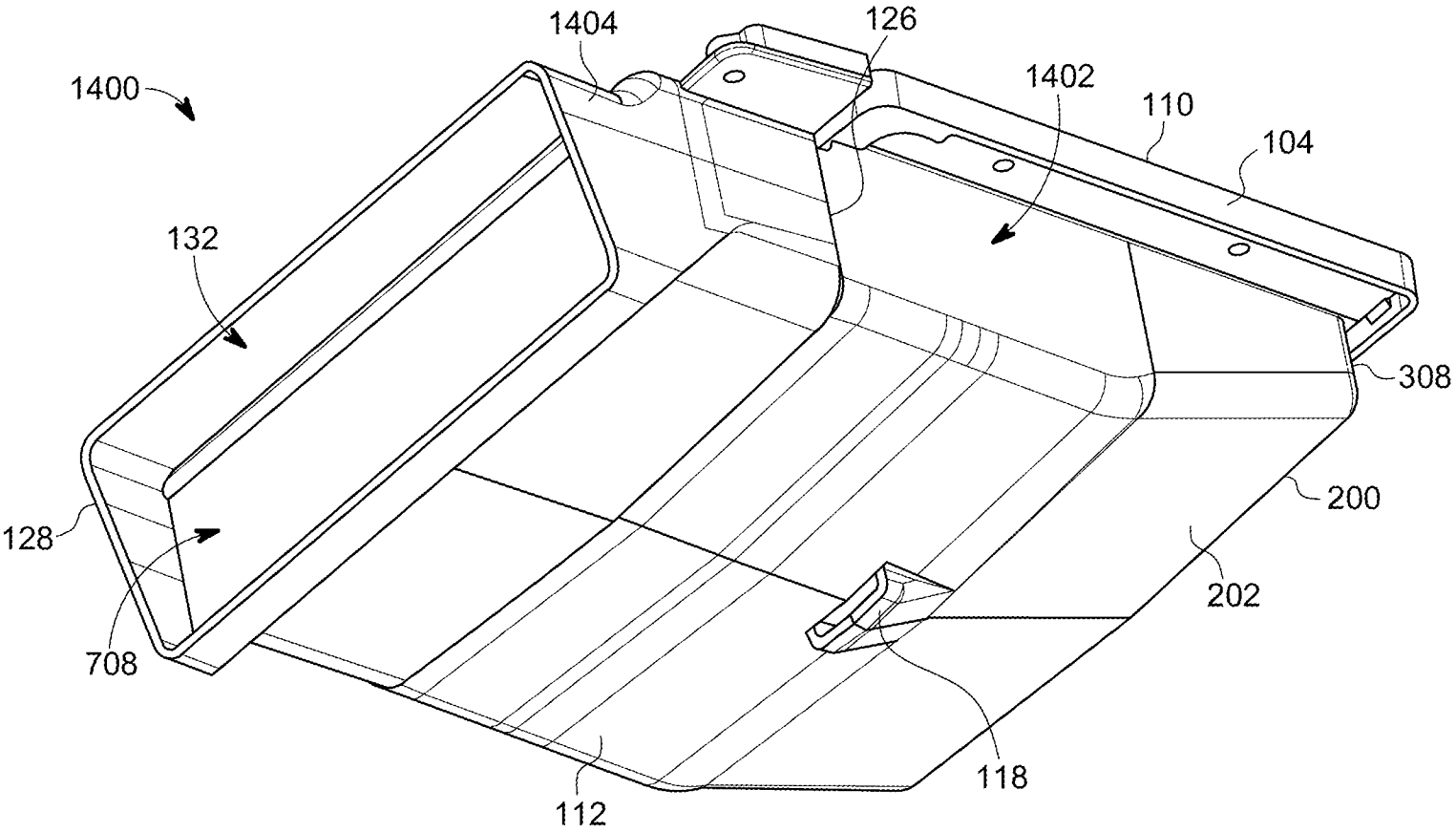
Figure 19:
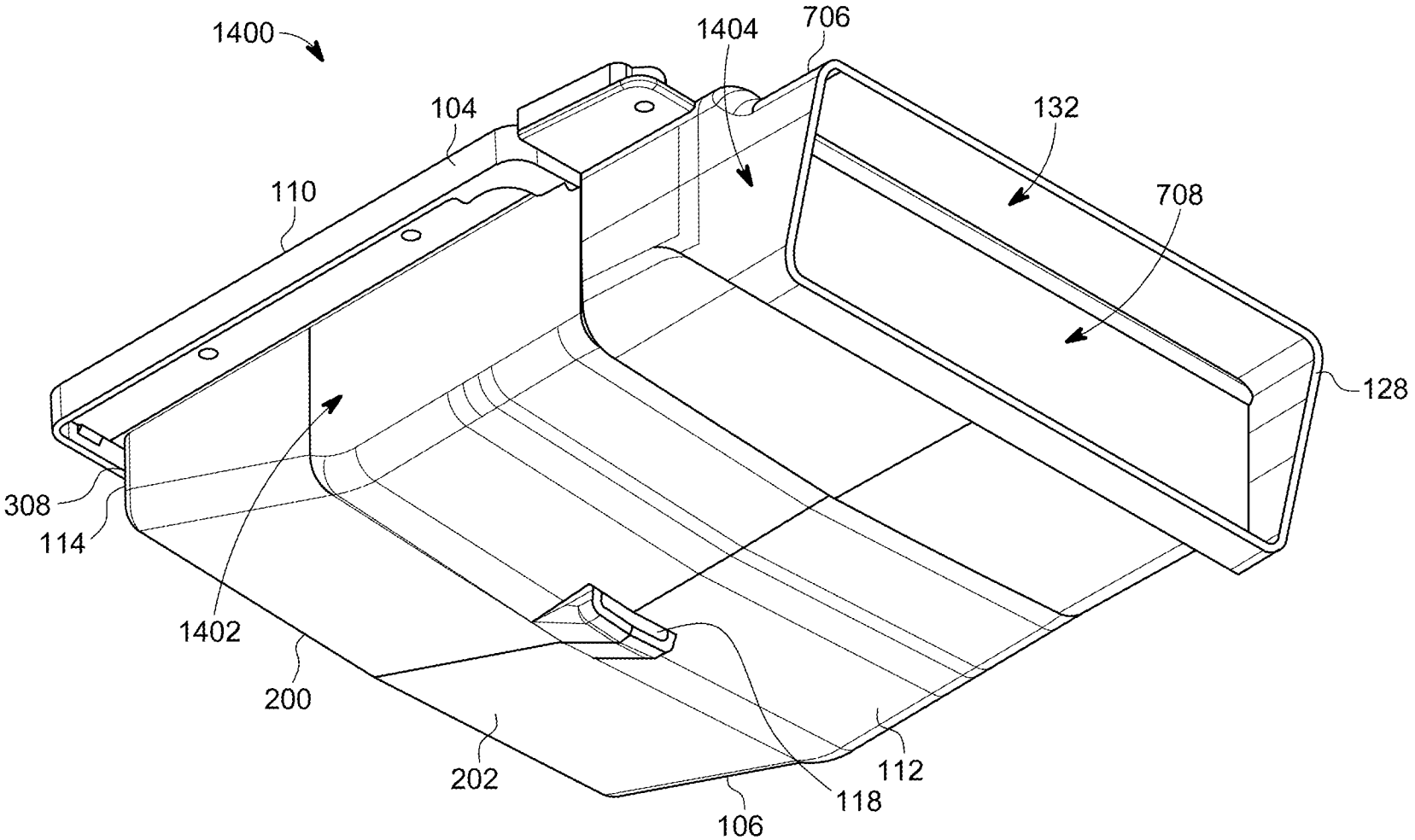
Figure 20:
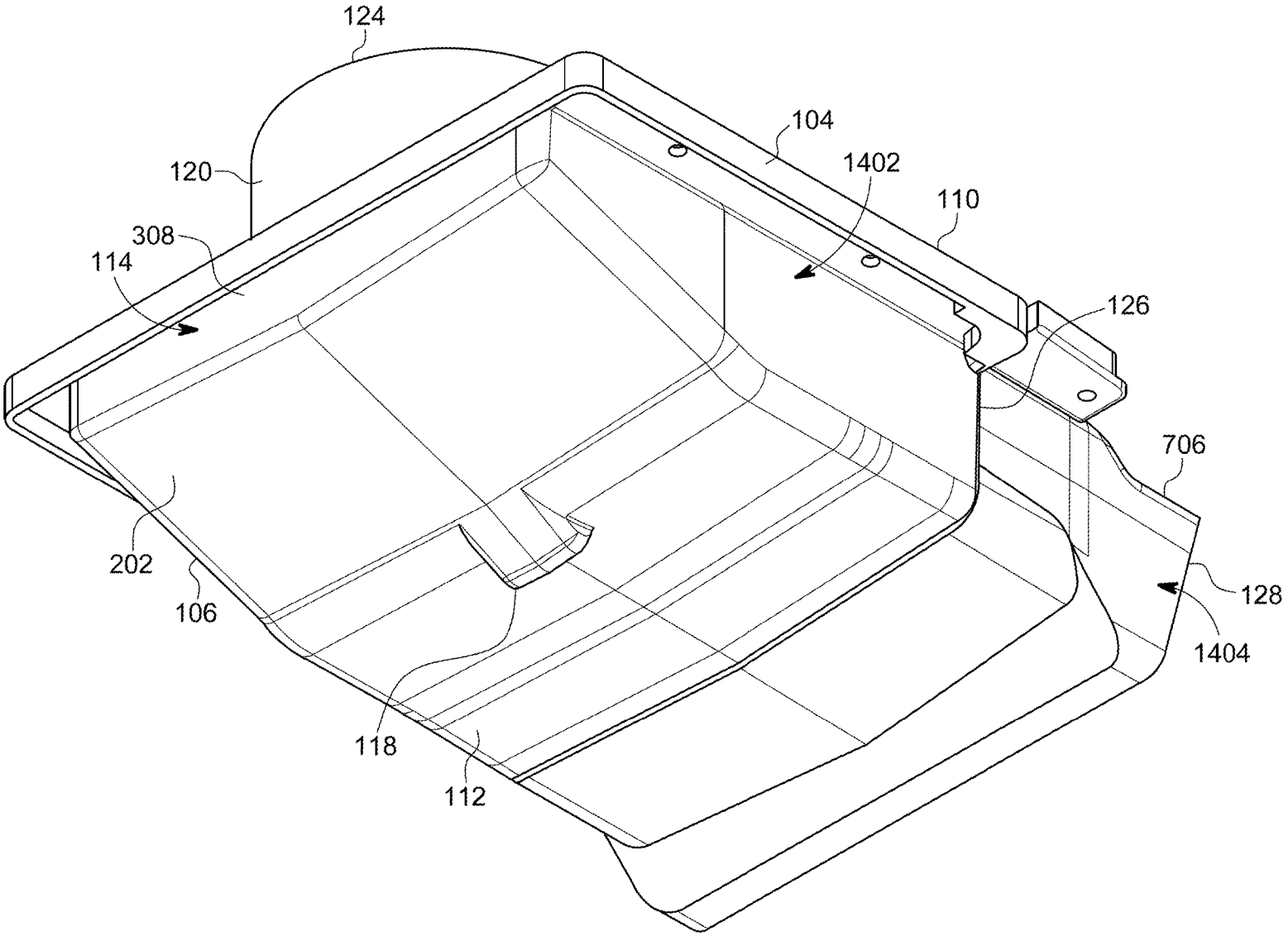
Figure 21:
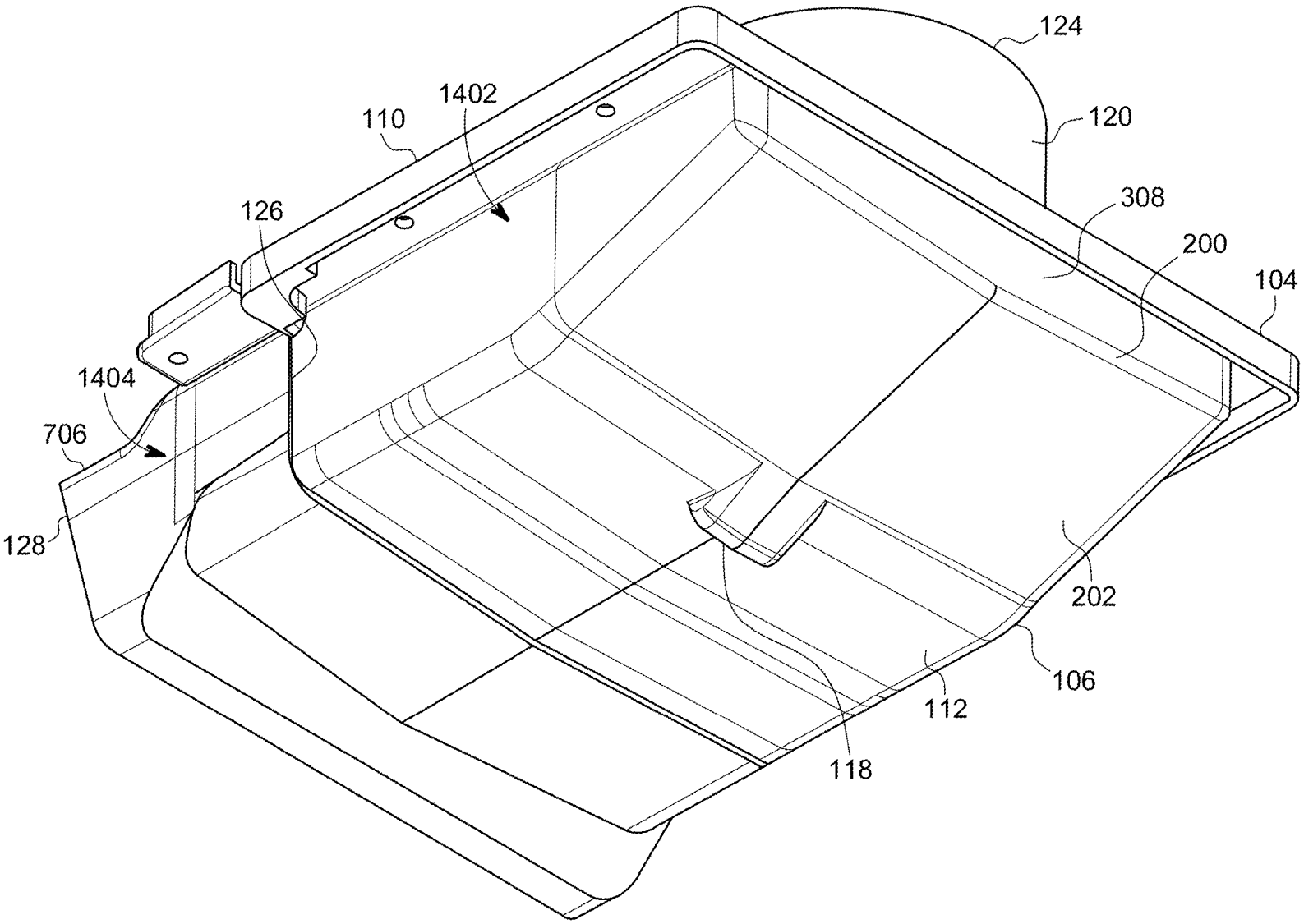
Figure 22:
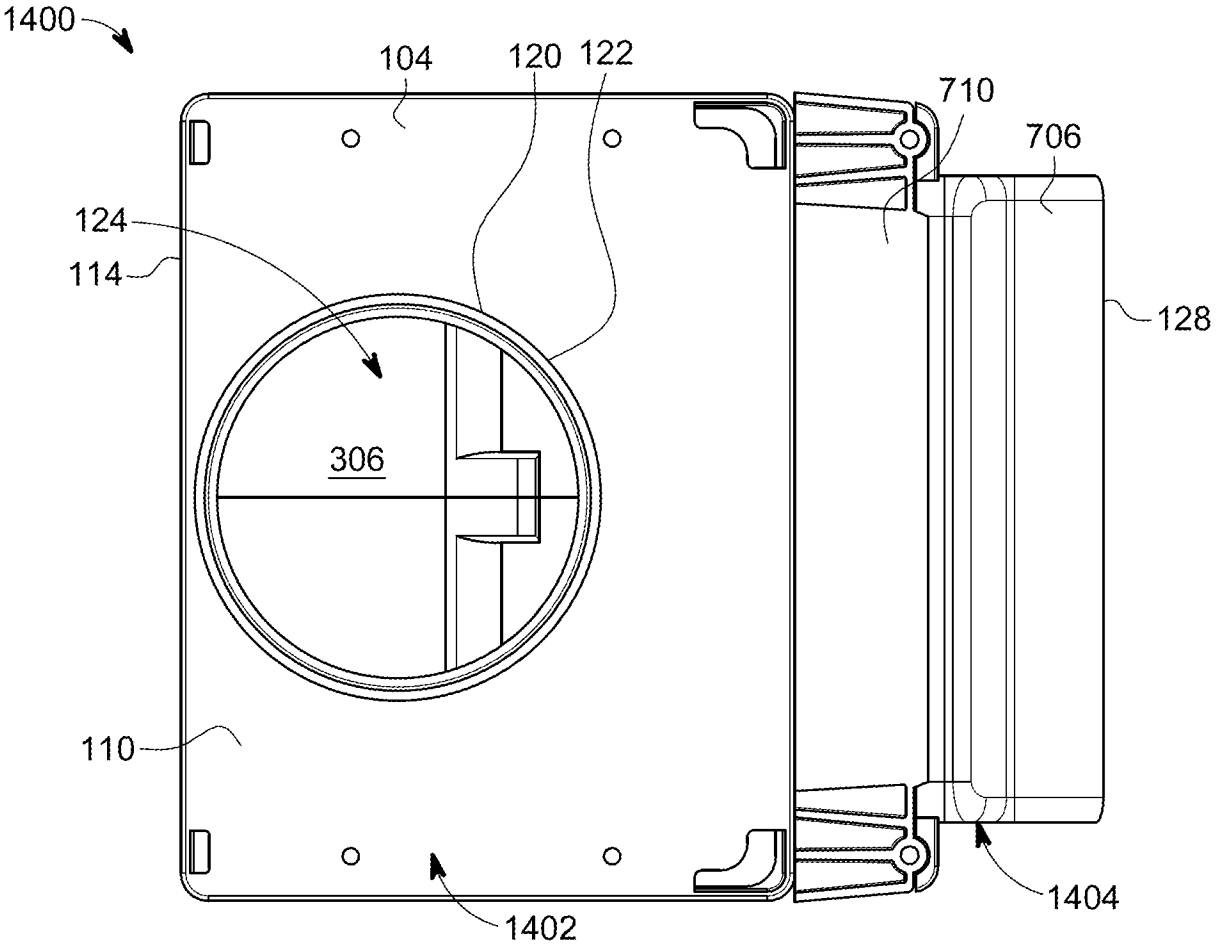
Figure 23:
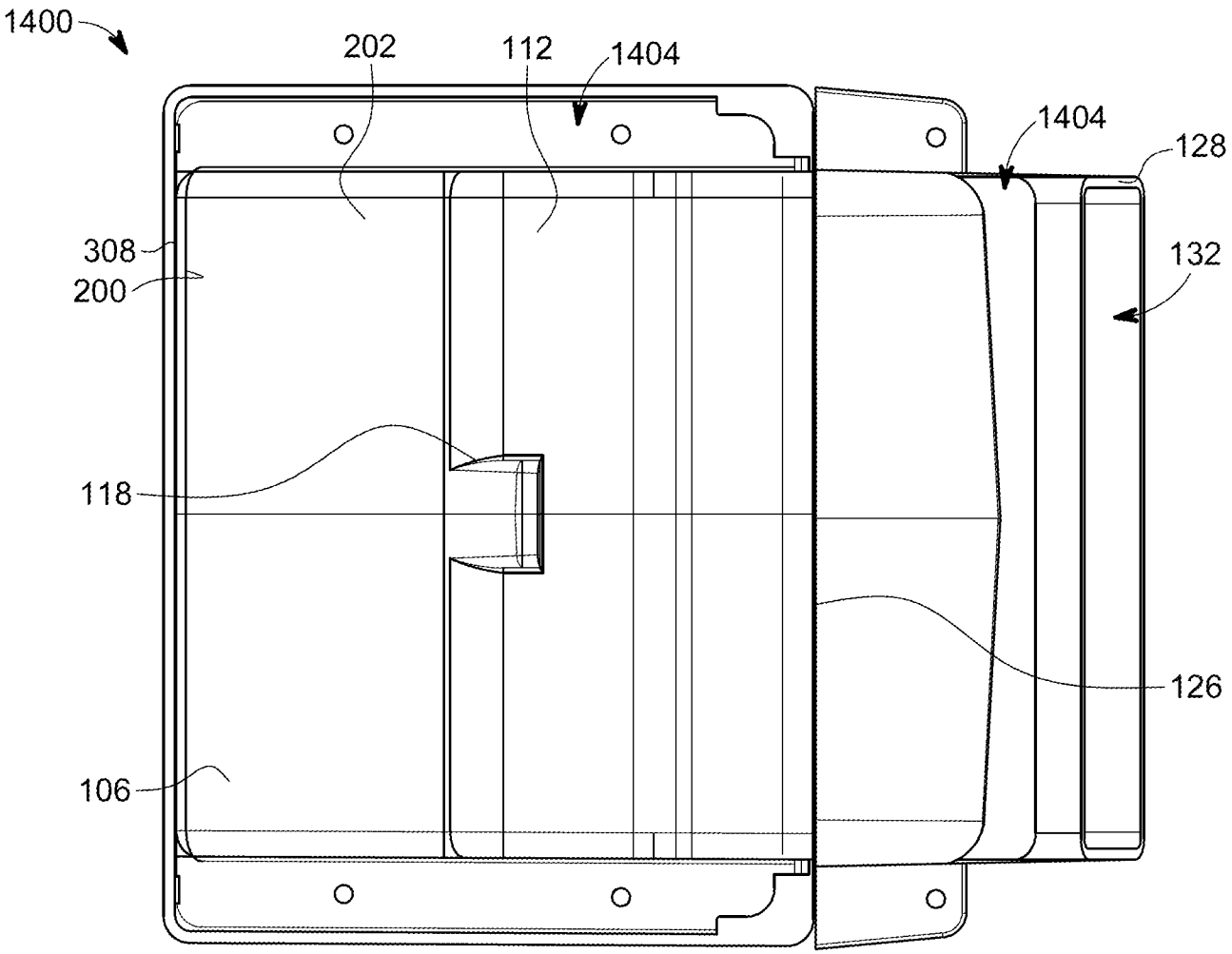

FIG. 14 depicts a sectional view of another example of a vent termination configured as a soffit vent 1400. The soffit vent 1400 includes a plenum box 1402 coupled with a nose section 1408. The plenum box 1402 and the nose section 1408 of the soffit vent 1400 is similar to the plenum box 102 and the nose section 108 of the soffit vent 100 described above except that the damper flap 708 is located in the nose section 1408 instead of the plenum box 1402. With the damper flap 708 in the nose section 1408, the grill 130 becomes optional on the soffit vent 1400. In FIG. 14, some of the reference numbers described with reference to elements of the soffit vent 100 are shown on the soffit vent 1400.

In the example illustrated in FIG. 14, the damper flap 708 is located in the nose section 1408 below a lower portion 706 of the top surface 710 of the nose section 1408 and proximate to the second side 128 and the air outlet 132. A step down transition 1404 between the front end 128 and the interior side 126 of the nose section 1408. The step down transition 1404 provides a stop for the motion of the damper flap 708 when the damper flap 708 is in the closed position.

A hinge 1480 securing the damper flap 708 to the nose section 1408 is located between the step down transition 1404 and the front end 128 of the nose section 1408. The close positon of the damper flap 708 to the front end 128 of the nose section 1408 advantageously reduces the space available for insects and animals to inference with the soffit vent 1400. In some examples, a portion of the damper flap 708 may extend out through the front end 128 of the nose section 1408 when the damper flap 708 is fully opened.

FIGS. 15-23 are side, front, back, bottom front right side isometric, bottom front left side isometric, bottom back left side isometric, bottom back right side isometric, top and bottom views of the soffit vent 1400. FIGS. 15-23 are provided to more clearly illustrate the overall look and character of the soffit vent 1400.

Figure 24B:
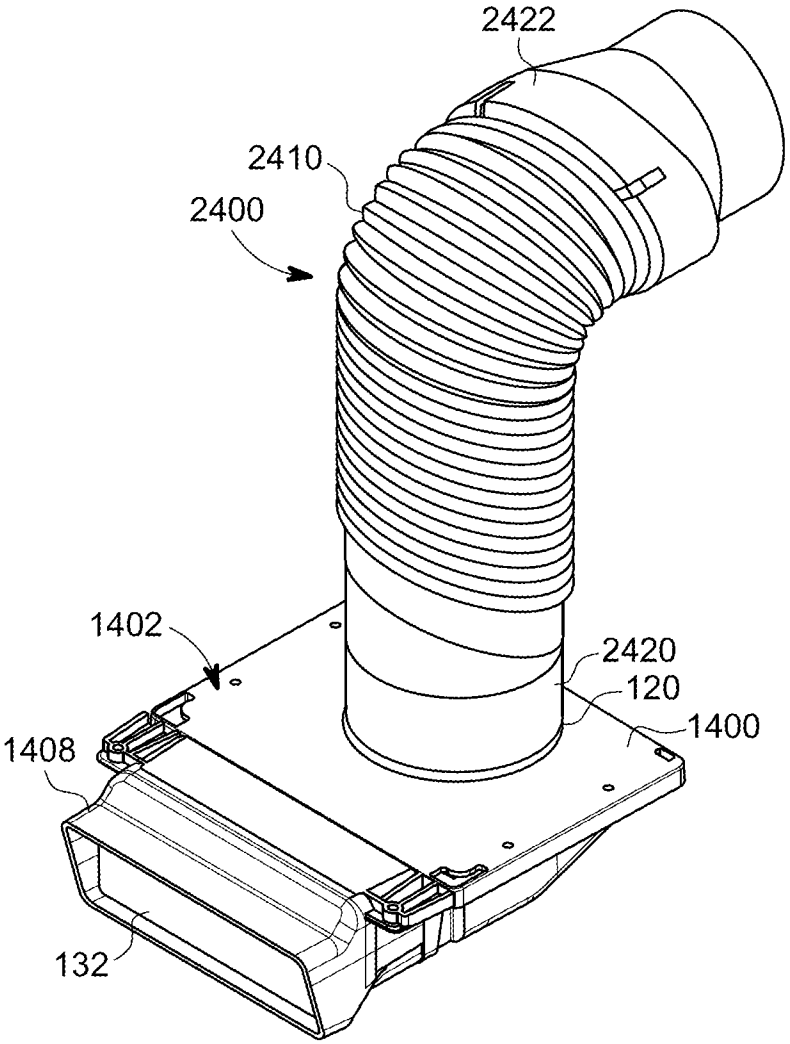
FIGS. 24A-24B are top front isometric views of an exemplary vent termination interfaced with a flexible collar extender.
Figure 24A:
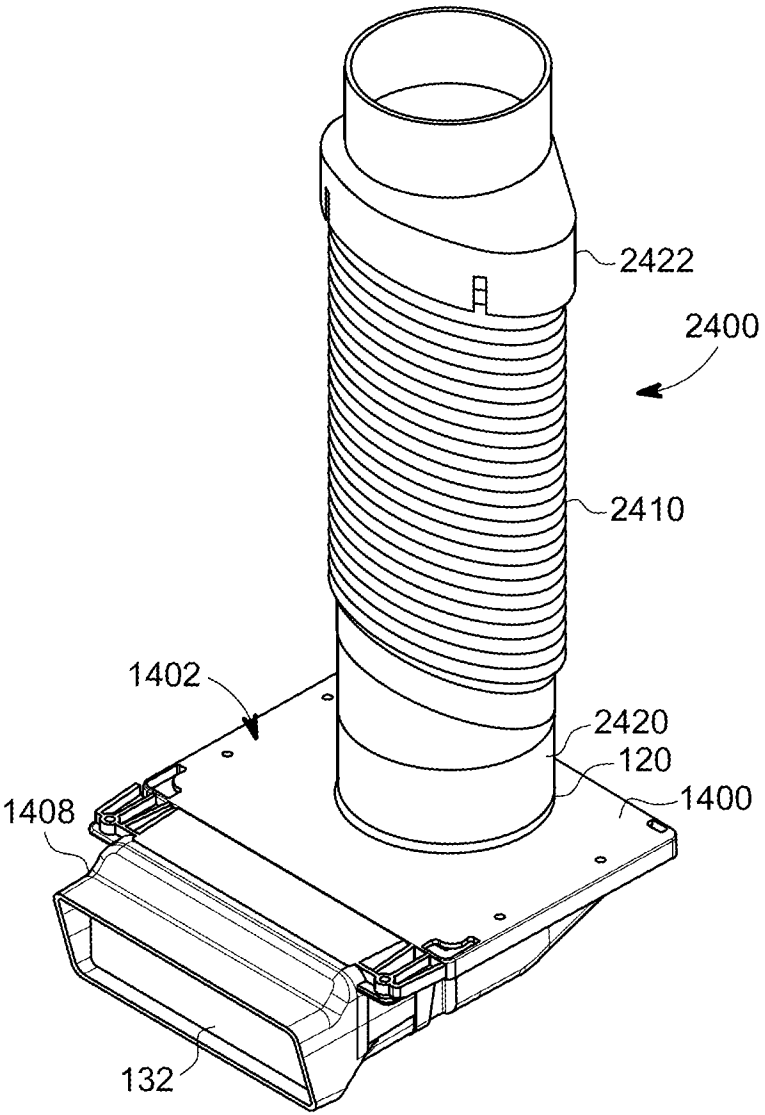
Figure 26:
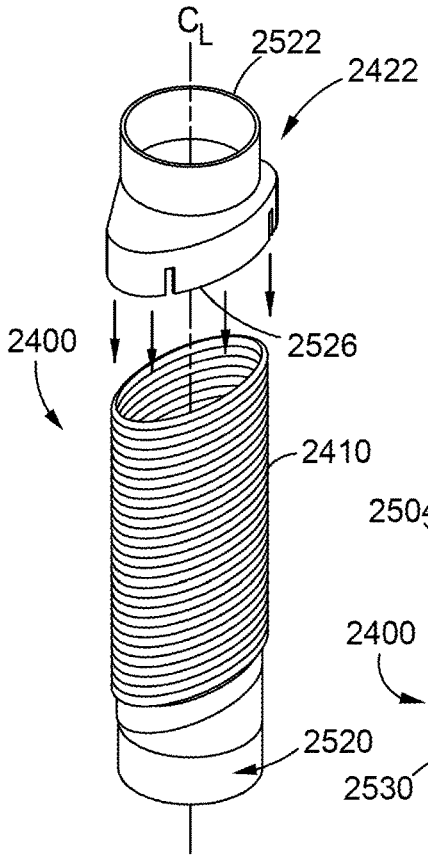
Figure 25A:
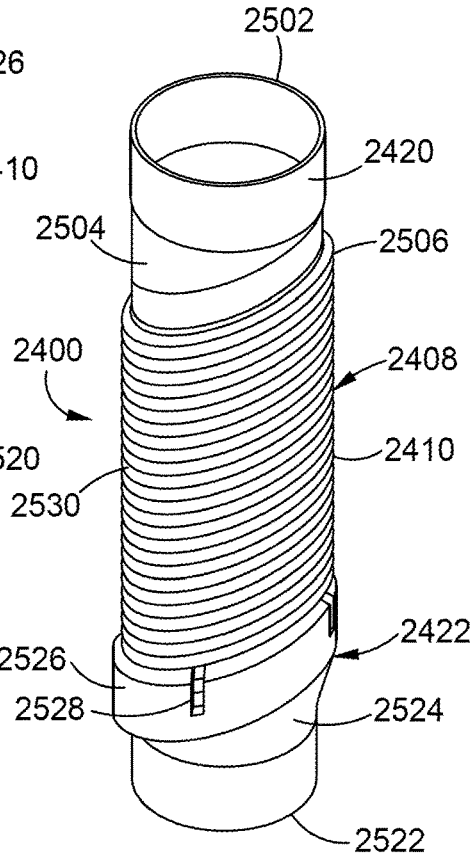
FIGS. 25A-25B are isometric side views of the flexible collar extender illustrated in FIGS. 24A-24B.
Figure 25B:
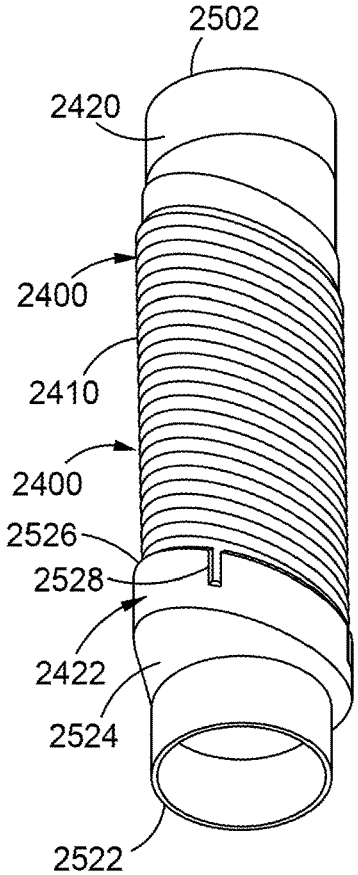
Figure 25C:
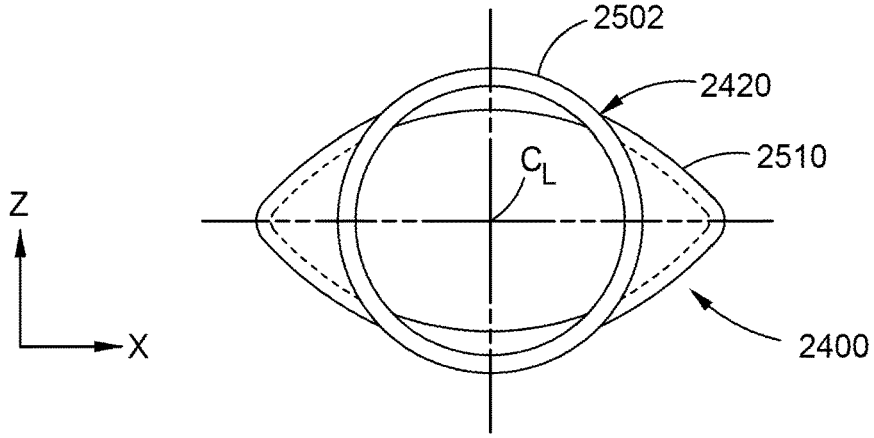
FIG. 25C is a top view of the flexible collar extender illustrated in FIG. 24B.

FIGS. 24A-24B are top front isometric views of the soffit vent 1400 interfaced with a flexible collar extender 2400. The flexible collar extender 2400 may be utilized with other vent terminations or objects having collars.

The flexible collar extender 2400 includes a flexible middle duct section 2410 terminated by a first adapter 2420 and a second adapter 2422. One or other of the adapters 2420, 2422 may be removable from the flexible middle duct section 2410. The flexible middle duct section 2410 allows the flexible collar extender 2400 to bend at least 45 degrees or even as much as 90 degrees in at least one plane. In the example depicted in FIGS. 24A-24B, the first adapter 2420 is part of the flexible middle duct section 2410, while the second adapter 2422 is removable from the flexible middle duct section 2410.

Referring now to FIGS. 25A, 25B, 25C, and 26, the flexible middle duct section 2410 generally has an oval-shaped cross section which promotes bending of the flexible middle duct section 2410 in prominently one plane, such as the y/x plane. The flexible middle duct section 2410 may be made from a naturally flexible material, or may include a bellows 2530 to allow bending of the flexible middle duct section 2410 when made from a more rigid material.

The first adapter 2420 includes a first end 2502, a transition 2504 and a second end 2506. The first end 2502 is cylindrical to allow the first end 2502 to be interfaced with conventional cylindrical ductwork or a collar of a vent termination. The first end 2502 is coupled to the transition 2504. The transition 2504 changes the circular sectional profile of the first end 2502 to an oval-shaped sectional profile. The transition 2504 is coupled to the second end 2506. The second end 2506 also has an oval-shaped sectional profile to allow the second end 2506 to connect to the flexible middle duct section 2410.

Similarly, the second adapter 2422 includes a first end 2522, a transition 2524 and a second end 2526. The first end 2522 is cylindrical to allow the first end 2522 to be interfaced with conventional cylindrical ductwork or a collar of a vent termination. The first end 2522 is coupled to the transition 2524. The transition 2524 changes the circular sectional profile of the first end 2522 to an oval-shaped sectional profile. The transition 2524 is coupled to the second end 2526. The second end 2526 also has an oval-shaped sectional profile to allow the second end 2526 to connect to the flexible middle duct section 2410. The second end 2526 may optionally include one or more slots 2528 that allow the second end 2526 to flex open and more easily receive the oval-shaped end of the flexible middle duct section 2410. The second end 2526 of the second adapter 2422 may be coupled to the end of the flexible middle duct section 2410 using fasteners, adhesive, tape or other suitable technique.

Figure 27:
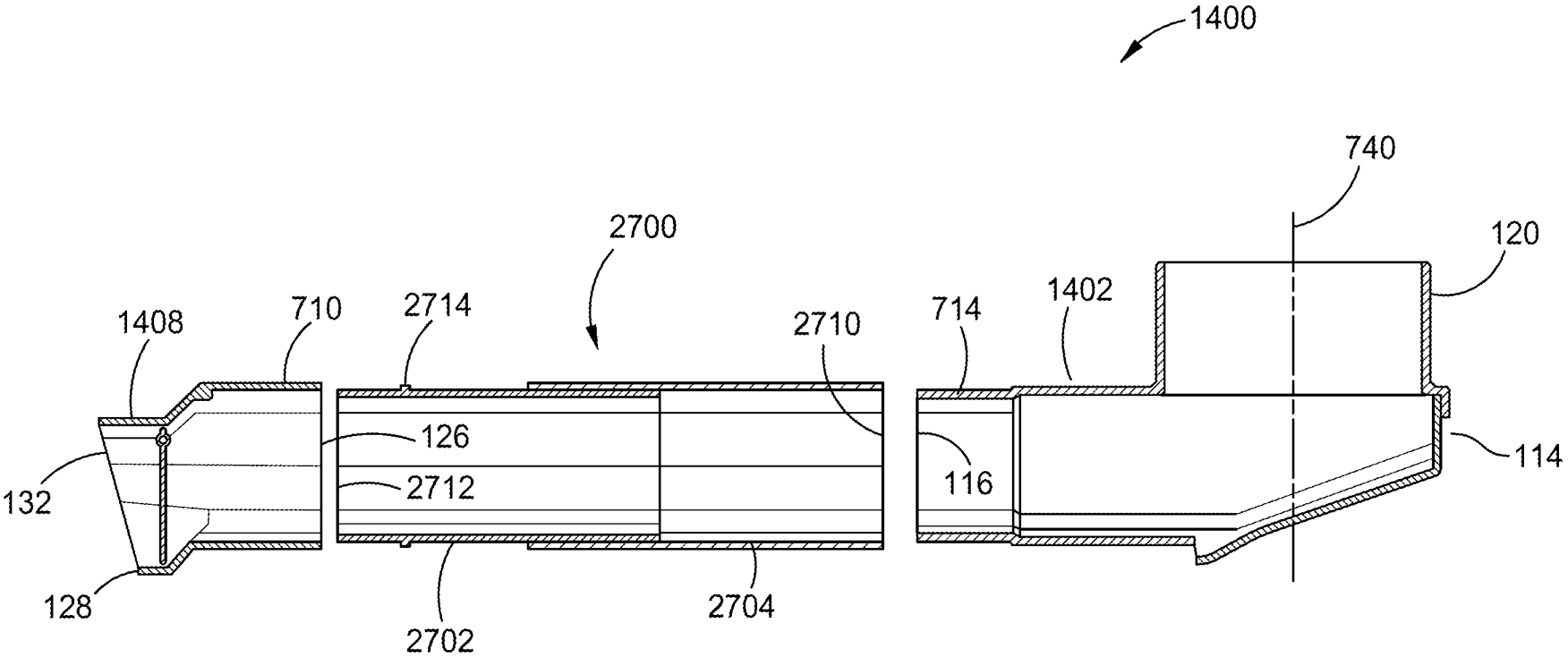

FIG. 27 is an exploded view of a vent termination that includes an extender 2700 disposed between the plenum box 1402 and the nose section 1408 of a soffit vent 1400. Although the extender 2700 is shown in use with the soffit vent 1400, the extender 2700 may be used with other vent terminations.

The extender 2700 may have a fixed length or be adjustable. The extender 2700 allows the distance between the centerline 720 of the collar 120 and the front end 128 of the nose sections 1408 to be lengthened as needed to fit the requirements of a specific installation. The extender 2700 depicted in FIG. 27 is adjustable in length. The extender 2700 generally includes an inner tube 2702 having a first end 2812 telescopically inserted through a first end 2810 of an outer sleeve 2704. The inner tube 2702 has an end 2712 that sticks out of the outer sleeve 2704, which also defines one end of the extender 2700. The outer sleeve 2704 has an end 2710 opposite the first end 2810, which also defines the other end of the extender 2700. The outside diameter of the inner tube 2702 is selected to mate with the sleeve 710 of the nose section 1408. The inner tube 2702 may optionally have a protrusion 2714, such as a ridge, that limits the distance that the inner tube 2702 may slide into the sleeve 710 of the nose section 1408.

Figure 28A:
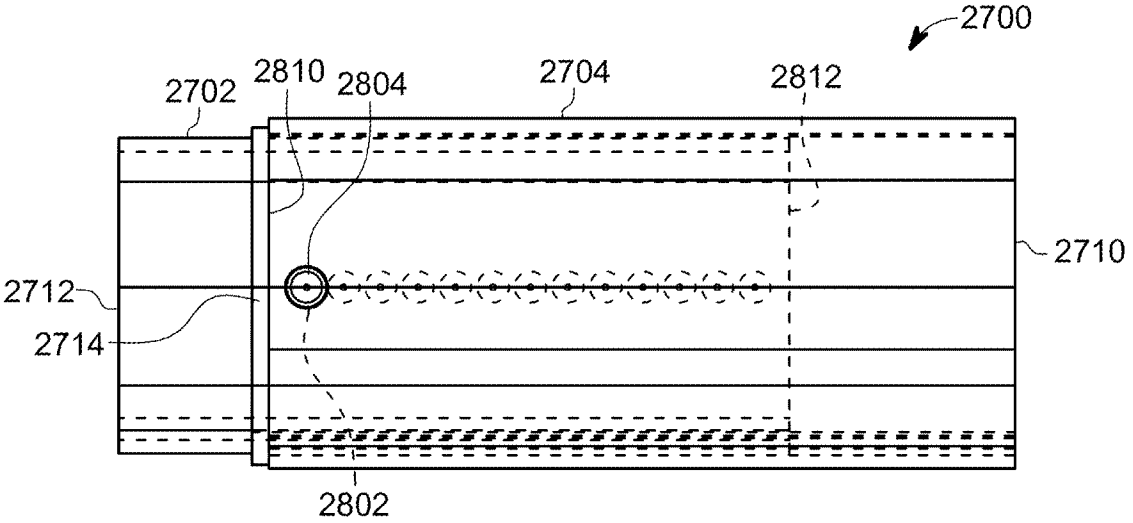
FIGS. 28A-28B are side views of the extender depicted in FIG. 27 adjusted to different lengths.
Figure 28B:
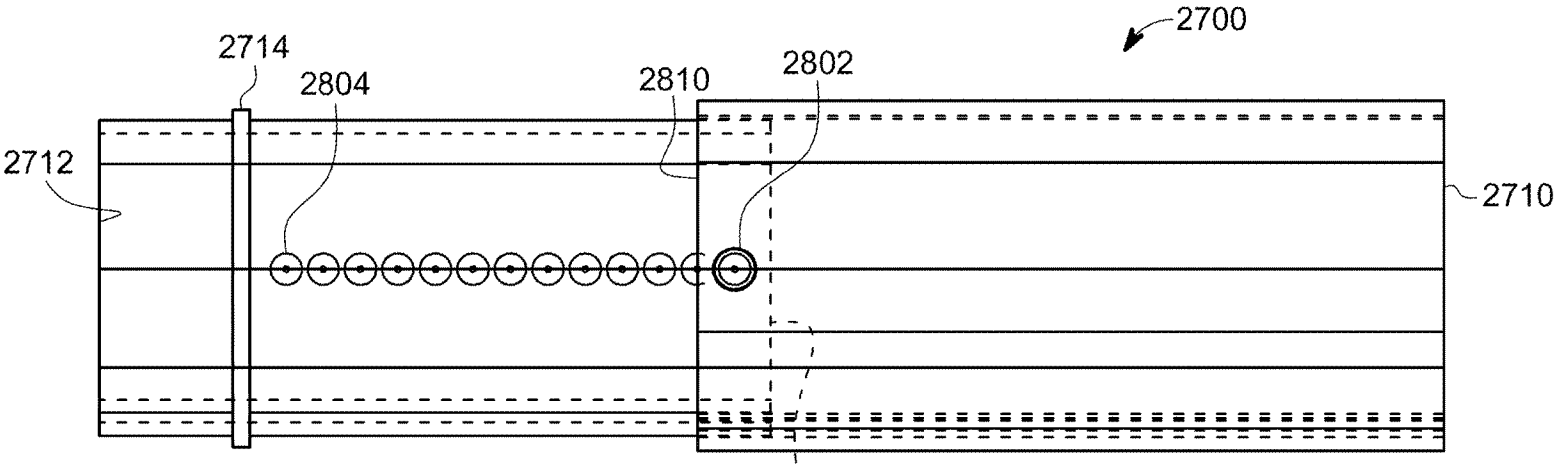

The outside diameter of the outer sleeve 2704 is selected to mate with the inner tube 714 of the plenum box 1402. The inner tube 2702 is dimensioned to slide within the outer sleeve 2704 so that a distance between the ends 2712, 2710 of the tube 2702 and sleeve 2704 may be set as desired, as depicted in FIGS. 28A-28B.

The outer sleeve 2704 may also include a depression or hole 2802. The hole 2802 is configured to receive one or a plurality of linearly aligned dimples 2804 extending from the outer surface of the inner tube 2702. The dimples 2804 are spaced so that when one of the dimples 2804 extends into and engages the hole 2808, the relative positions of the inner tube 2702 and the outer sleeve 2704 are set, thus setting the distance between the ends 2710, 2712 of the extender 2700.

Figure 29:
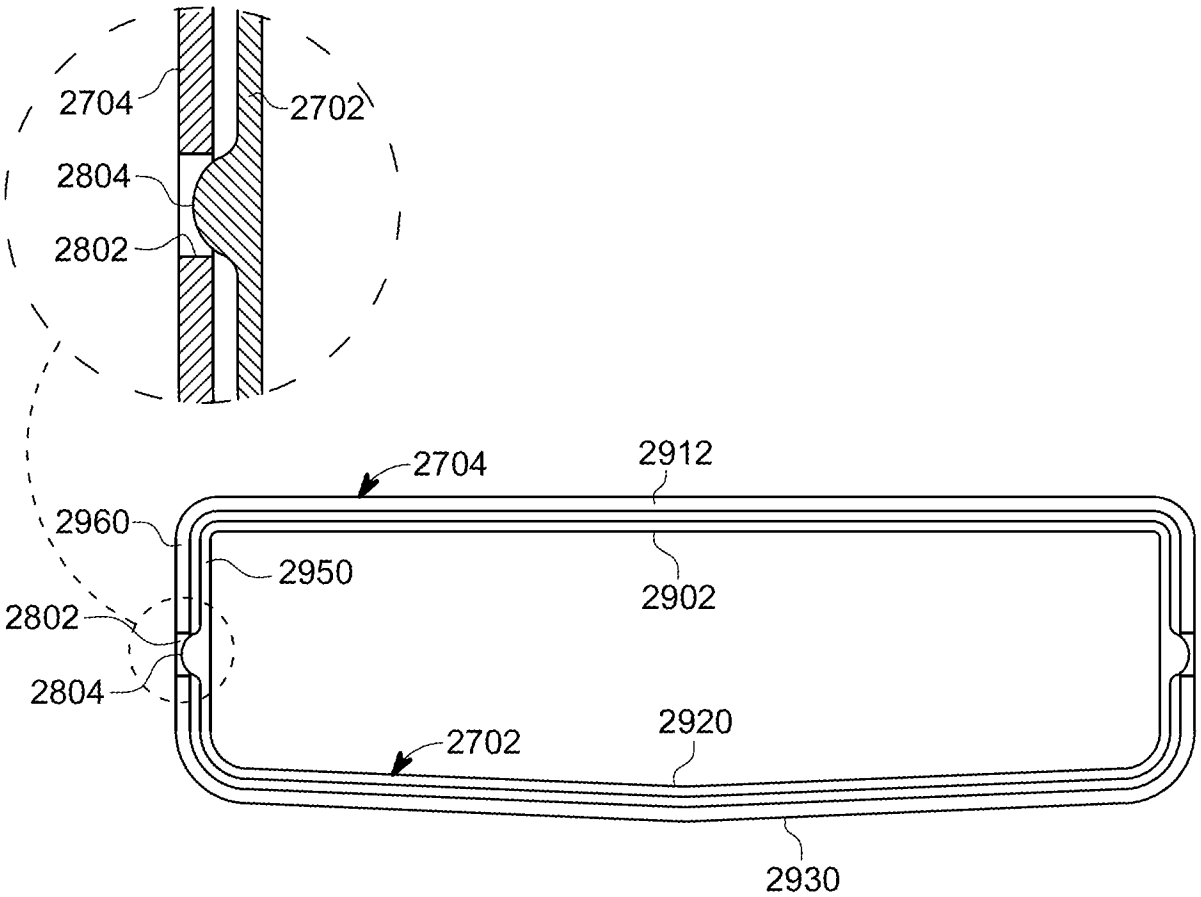

FIG. 29 is a sectional view of the extender 2700, providing an enlargement of the engagement of one of dimples 2804 with the hole 2808. Also illustrated in FIG. 29, top walls 2902, 2912 and bottom walls 2932, 2942 of the inner tube 2702 and the outer sleeve 2704. The top walls 2902, 2912 of the inner tube 2702 and the outer sleeve 2704 are generally planar or slightly convex. The bottom walls 2932, 2942 of the inner tube 2702 and the outer sleeve 2704 generally have a slight V-shape, or may be slightly convex. Alternatively, the bottom walls 2932, 2942 of the inner tube 2702 and the outer sleeve 2704 may be substantially planer. Although the dimples 2804 and the holes 2808 are illustrated on opposite sidewalls 2950, 2560, the dimples 2804 and mating hole 2808 can be on any one or more of the top, bottom or sidewalls 2902, 2912, 2932, 2942, 2950, 2960 of the inner tube 2702 and the outer sleeve 2704.

Figure 30:
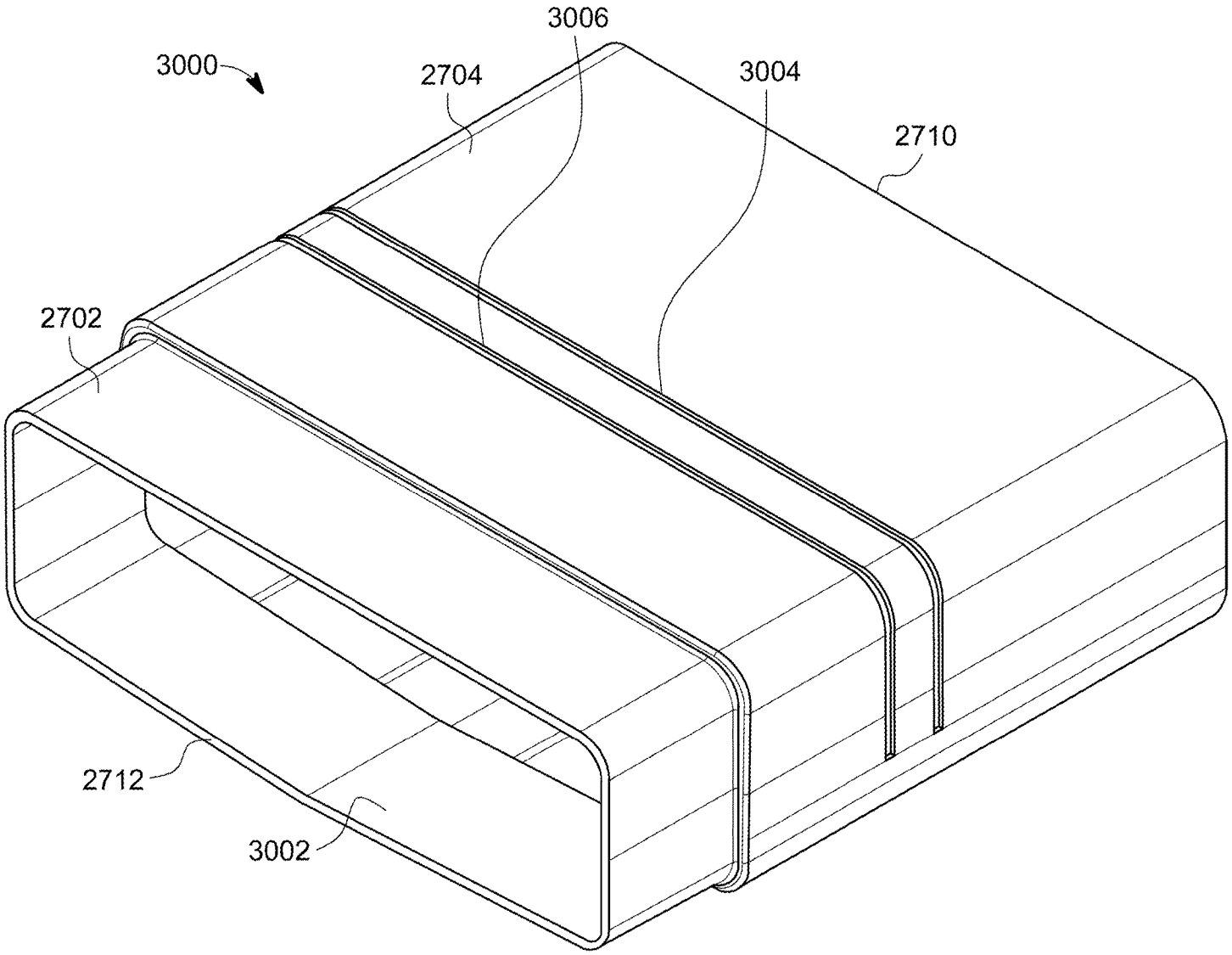

FIG. 30 is perspective view of another extender 3000 that may be disposed between a plenum box and the nose section of a soffit vent, for example, in place of the extender 2700. The extender 3000 may also be used with other vent terminations.

The extender 3000 has a fixed length between opposite ends 2712, 2710. The extender 3000 includes an inner tube 2702 at the first end 2712 and an outer sleeve 2704 at the second send 2710. The inner tube 2702 has an outside diameter selected to mate with the sleeve 710 of the nose section 1408. The outer sleeve 2704 has an outside diameter selected to mate with the inner tube 714 of the plenum box 1402. The outer sleeve 2704 may include one or more options grooves, shown in FIG. 30 as grooves 3004, 3006. The grooves 3004, 3006 are formed parallel with the end 2710 of the outer sleeve 2704. The outer sleeve 2704 may be cut in any one of the grooves 3004, 3006 to shorten the length of the extender 3000. Similar to the extender 2700, a bottom wall 3002 of the extender 3000 may have a slight V-shape, or may be slightly convex.

Figure 31:
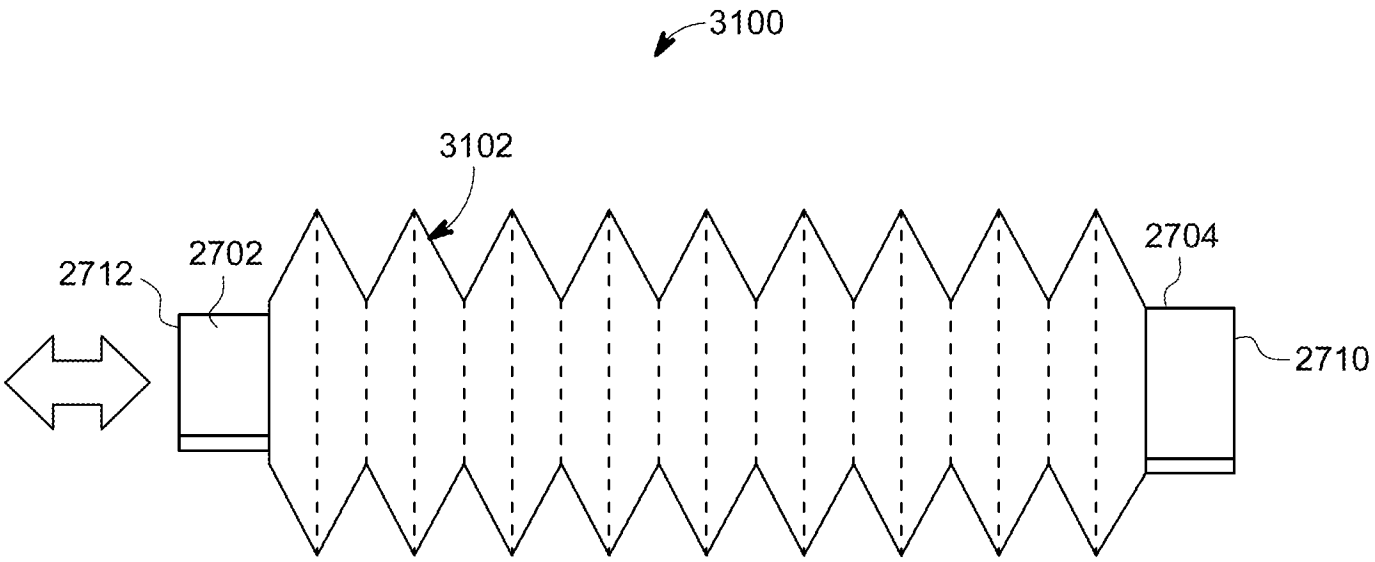

FIG. 31 is side view of another extender 3100 that may be disposed between a plenum box and the nose section of a soffit vent, for example, in place of the extender 2700. The extender 3100 may also be used with other vent terminations.

The extender 3100 has an adjustable length between opposite ends 2712, 2710. The extender 3100 includes an inner tube 2702 at the first end 2712 and an outer sleeve 2704 at the second send 2710. The inner tube 2702 has an outside diameter selected to mate with the sleeve 710 of the nose section 1408. The outer sleeve 2704 has an outside diameter selected to mate with the inner tube 714 of the plenum box 1402. The inner tube 2702 is coupled to the outer sleeve 2704 by a bellowed section 3102. The bellowed section 3102 allows the distance between the inner tube 2702 and the outer sleeve 2704, and consequently, the distance between the ends 2710, 2712 to be adjusted.

Figure 32:
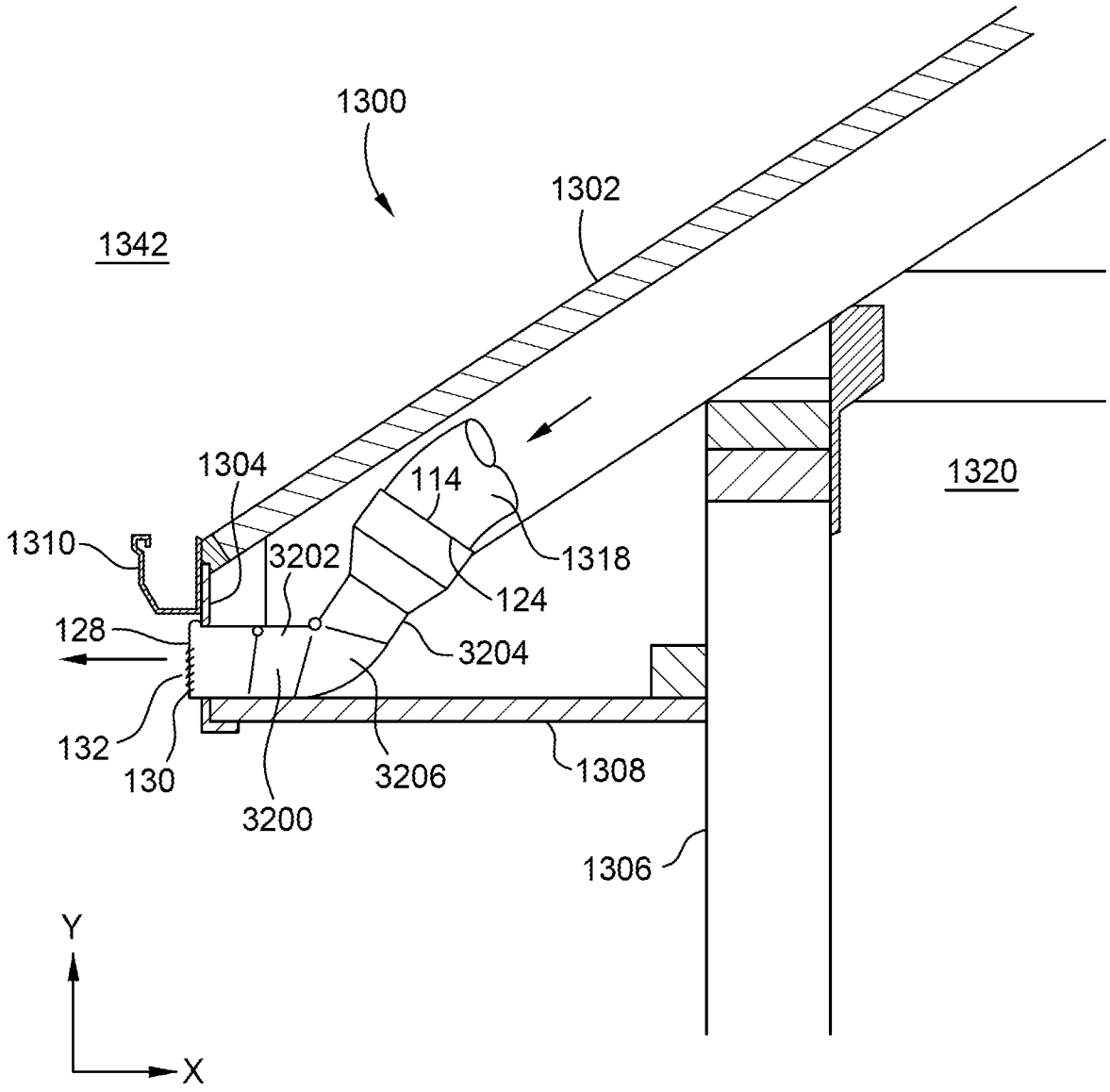

FIG. 32 depicts an example of a building structure 1300 having a vent termination 3200 configured as a through fascia termination. The building structure 1300 is generally the same as depicted in FIG. 13, except for the vent termination 3200 extending through the fascia 1304 of the building structure 1300 instead of the soffit 1308 as with the soffit vents described above. The building structure 1300 has an interior 1320 that is separated from the outside environment 1342 by the roof 1302 and exterior walls 1306 of the building structure 1300. The interior 1320 may also include an interior room 1330 (as shown in FIG. 13) to be vented and/or having appliances to be vented via the vent termination 3200. As described above, the vent termination 3200 is mounted about the soffit 1308, with a front end 128 of the vent termination 3200 extending through the fascia 1304. The vent termination 3200 extends through the fascia 1304 below the gutter 1310, allowing the gutter 1310 to shield the front end 128 from rain, snow and other elements of nature. The second end 114 of the vent termination 3200 is coupled by a duct (e.g., ductwork) 1318 to an exhaust fan 1322 operable to ventilate the interior space 1330 of the building structure 1300 or an appliance 1340 disposed within the interior 1320 the building structure 1300, just as shown in FIG. 13.

The vent termination 3200 includes a nose section 3202 coupled to a plenum box 3204 by a flexible coupling 3206. The flexible coupling 3206 allows the nose section 3202 rotate relative to the plenum box 3204 in at least one plane. In the example depicted in FIG. 32, the flexible coupling 3206 allow the nose section 3202 to rotate relative to the plenum box 3204 in the x/y plane.

Figure 33A:
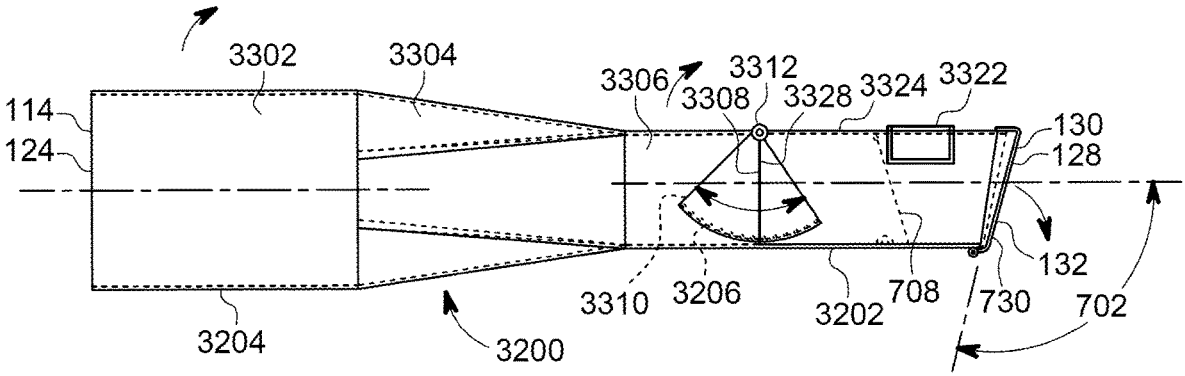
FIGS. 33A-33B are schematic side views of the vent termination of FIG. 32 illustrating how the vent termination may change shape within at least one plane.
Figure 33B:
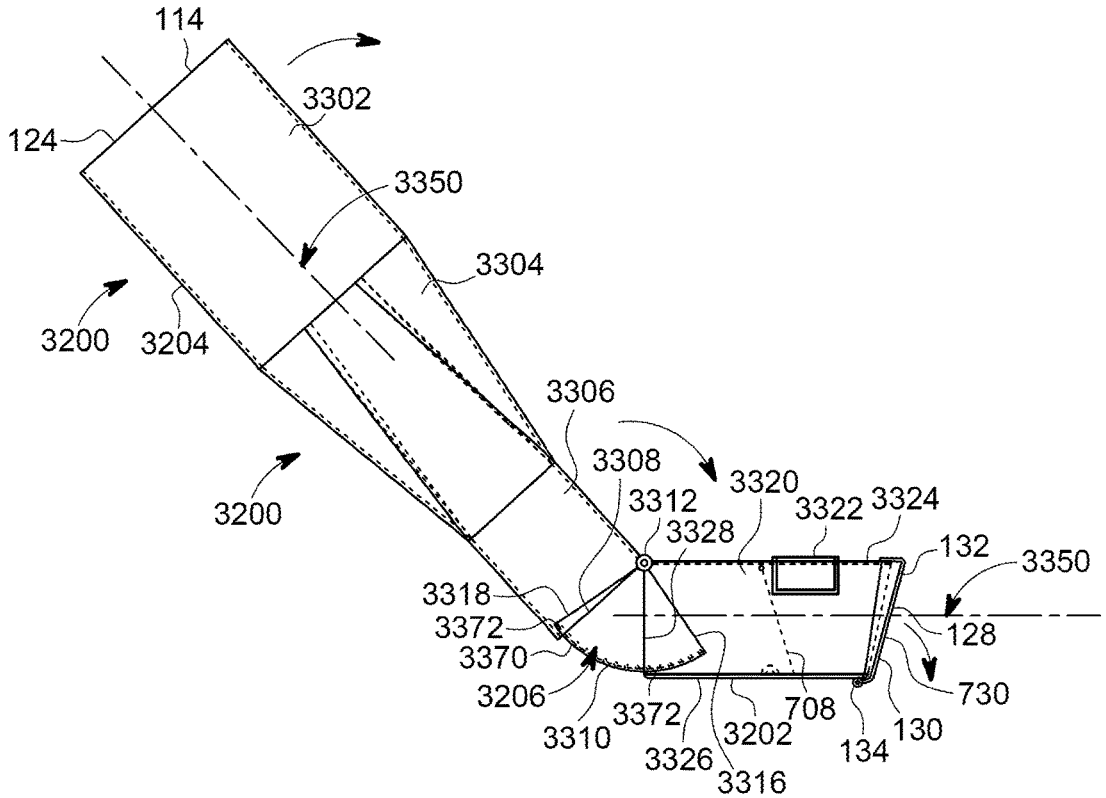
Figure 34:
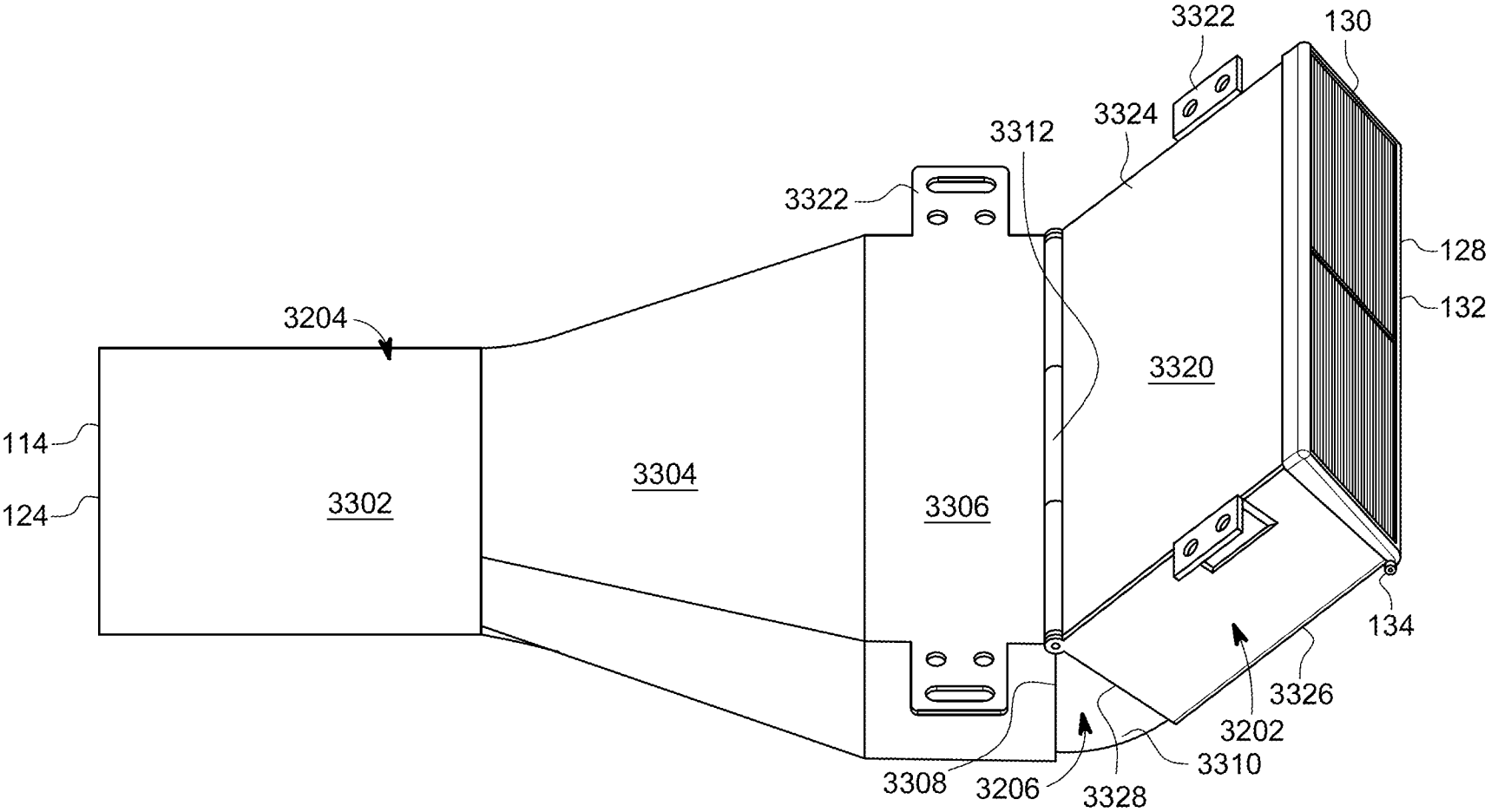
FIGS. 34-38 are various views of the vent termination depicted in FIG. 32.
Figure 35:
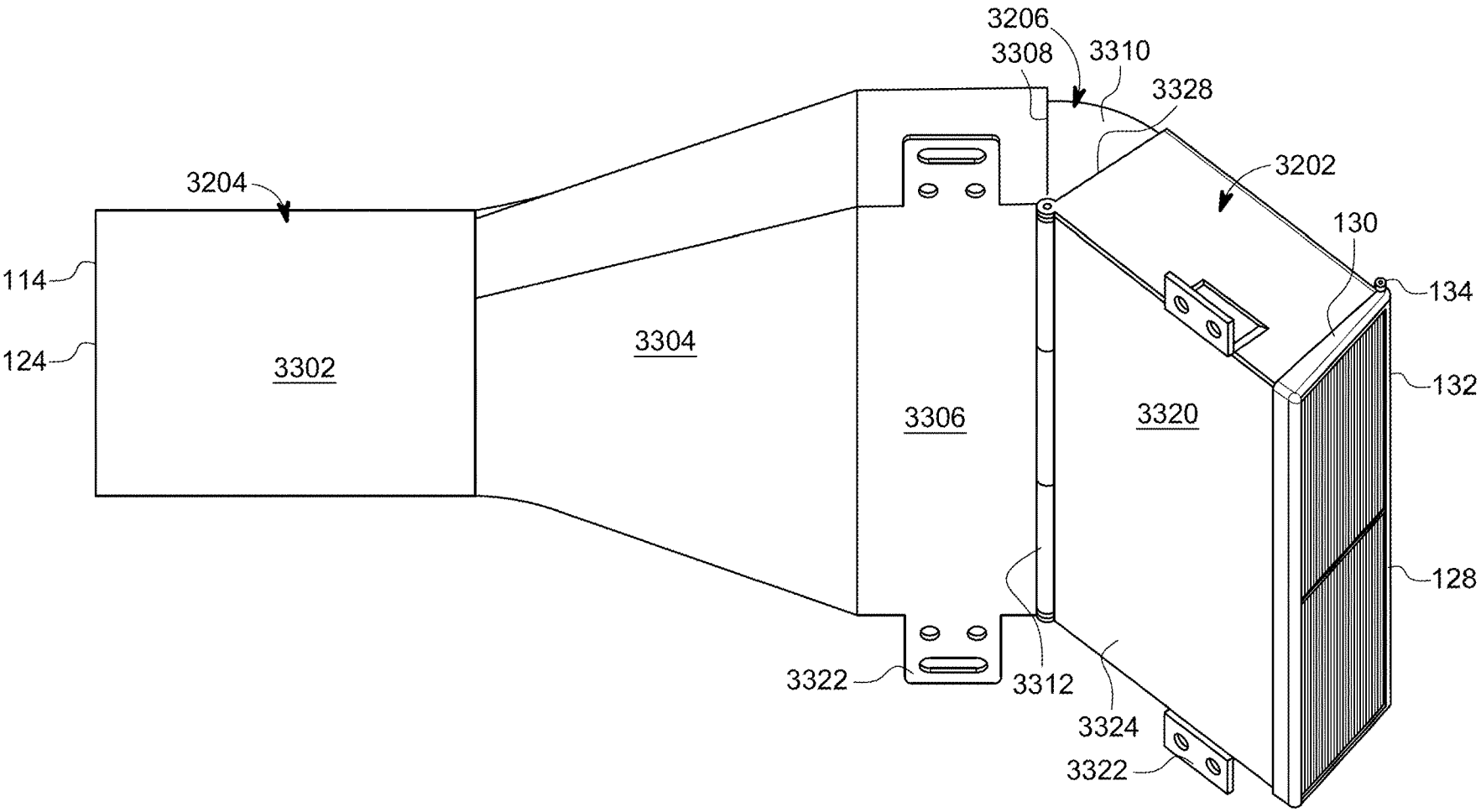
Figure 36:
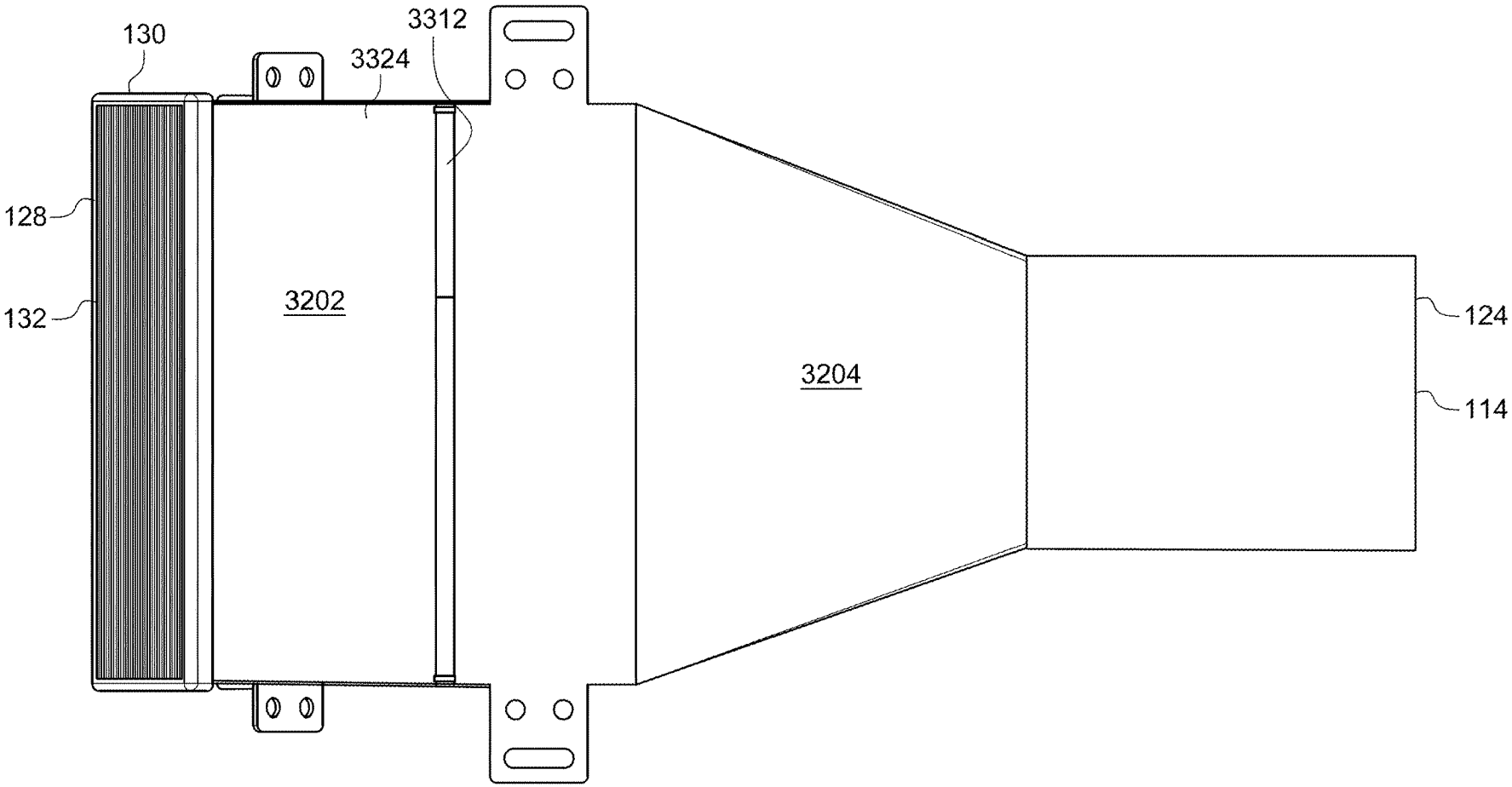
Figure 37:
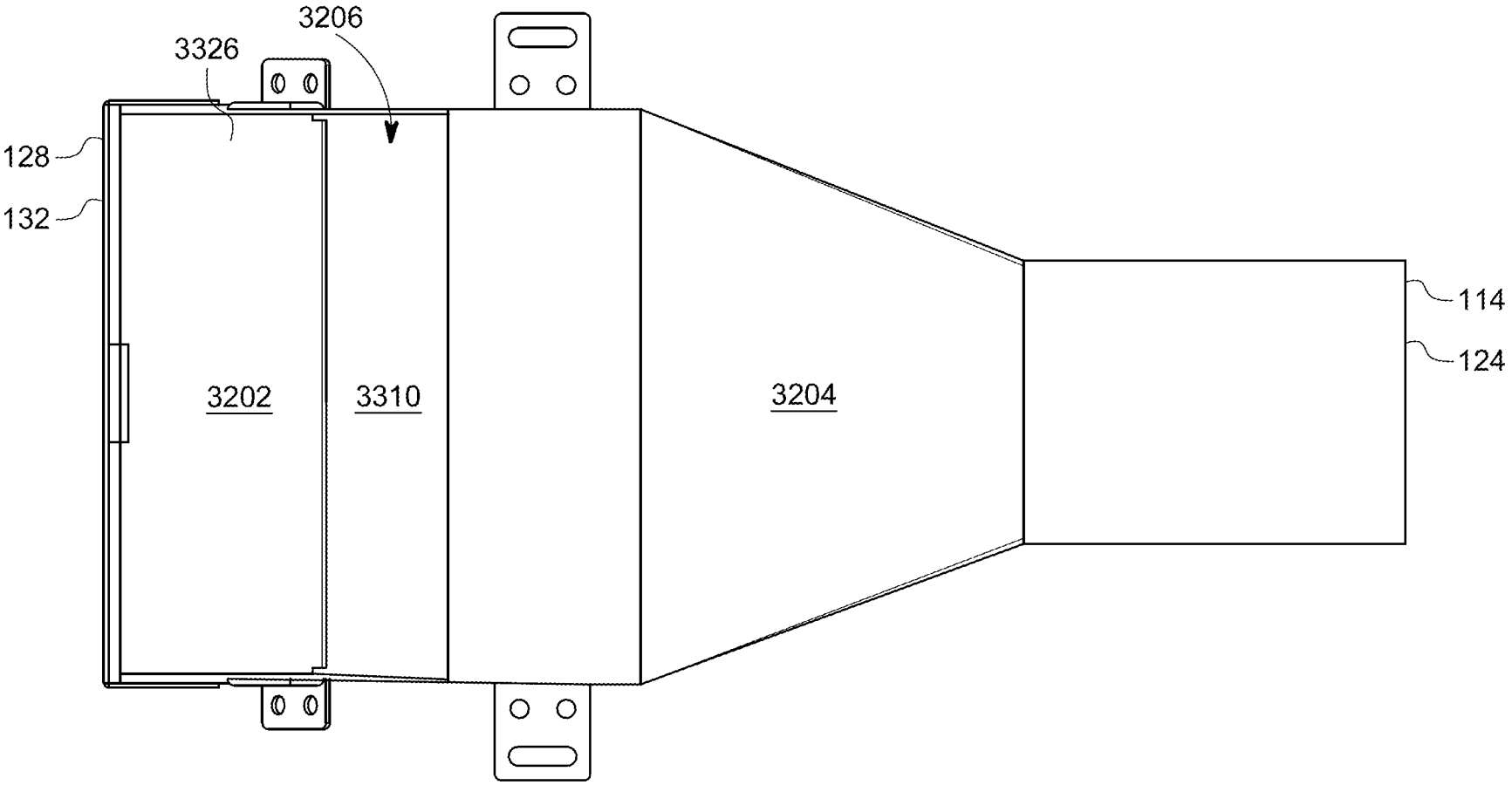
Figure 38:
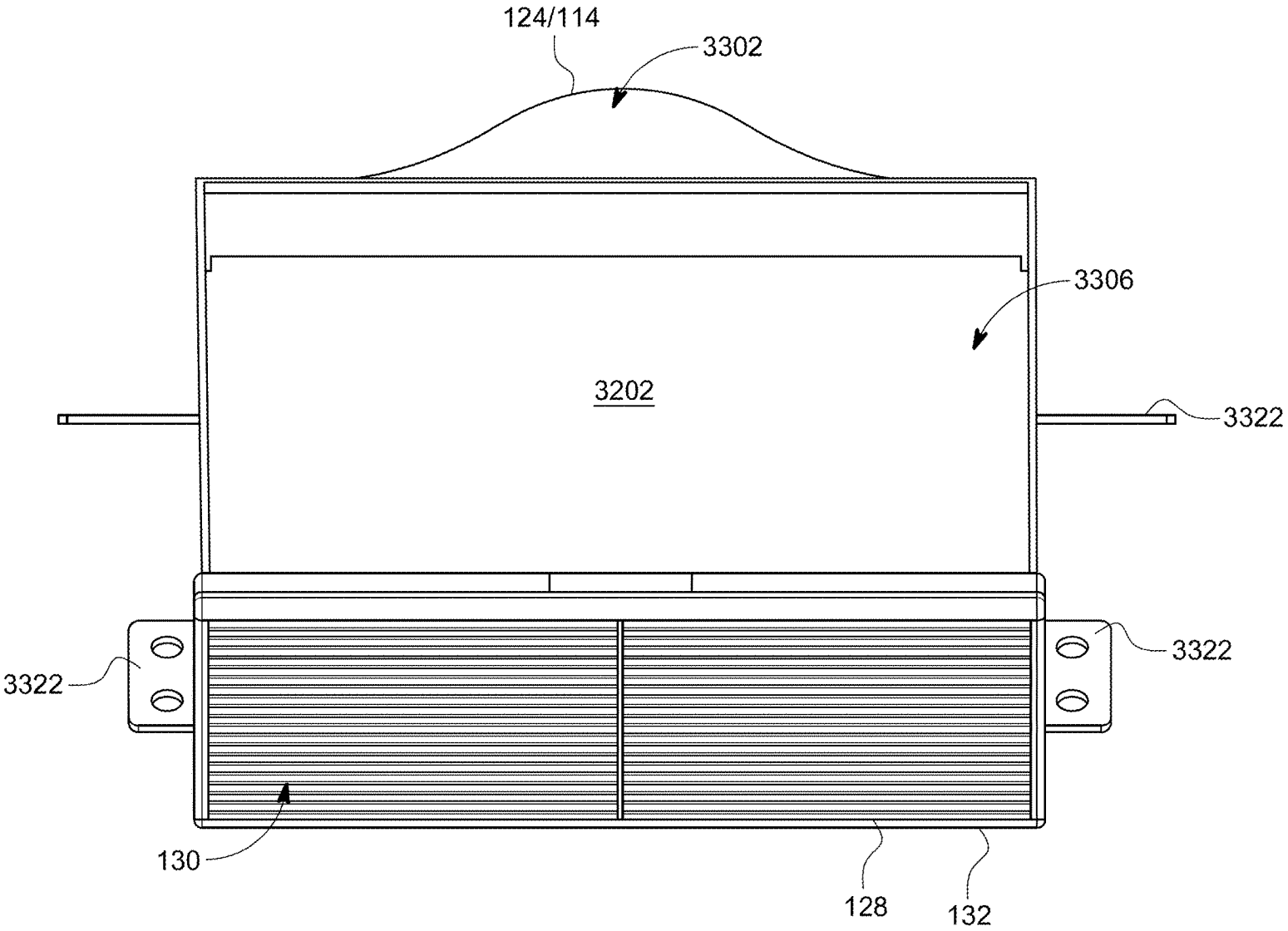

FIGS. 33A-33B are side views of the vent termination 3200 that illustrates the motion between the nose section 3202 and the plenum box 3204 in greater detail. The nose section 3202 includes a tubular body 3320. The tubular body 3320 is generally rectangular in cross section, with the short side been illustrated in FIGS. 33A-33B. The sectional area of the tubular body 3320 is at least about 12.5 square inches, such as over 13.0 square inches. The tubular body 3320 has a back end 3328, a top surface 3324, a bottom surface 3326 and a front end 128. The front end 128 of the tubular body 3320 is also the front end 128 of the vent termination 3200.

The front end 128 also includes air outlet 132. A grill 130 is coupled to the front end 128 and disposed over the air outlet 132. The grill 130 may be coupled to the front end 128 in any of the manner described above, such as a hinge 134 as shown in FIGS. 33A-33B. An exposed face 730 of the grill 130 is disposed at an angle 702 relative to the x-axis. In FIGS. 33A-33B, the x-axis is parallel to the top surface 332 of the nose section 3202. The angle 702 may be between zero and 90 degrees, and in one example, is an acute angle, such as between 45 and 75 degrees. The grates (500 as shown in FIG. 7) are disposed at an angle 704 (also shown in FIG. 7) relative to the x-axis. The angle 704 may be between-60 and 60 degrees, and in one example, is an acute angle, such as between 30 and 75 degrees. The angles 702, 704 may alternatively have other values. In an alternative example, the grates 500 can rotate to function as a damper to open and close the air outlet 132.

The nose section 3202 additionally includes a damper flap 708 positioned therein. The nose section 3202 may also mounting tabs 3322. The mounting tabs 3322 facility securing the nose section 3202 to the building structure 1300. The mounting tabs 3322 may be disposed adjacent or coplanar with the top surface 3324 or bottom surface 3326 of the nose section 3202.

The plenum box 3204 includes a collar 3302, a transition 3304 and a tubular body 3306. The tubular body 3306 may have the same sectional profile as the tubular body 3320 of the nose section 3202. The collar 3302 generally has a cylindrical cross section sided to mate with ductwork as describe above. The transition 3304 changes the cross section of the plenum box 3204 from circular at the collar 3302 to rectangular at the tubular body 3306.

As discussed above, the flexible coupling 3206 connects the nose section 3202 and the plenum box 3204 in a manner that allows the plenum box 3204 to be rotated out of the x/y plane (in the x/y plane) relative to the nose section 3202. The rotation of the plenum box 3204 allow more flexibility for coupling the ductwork within the eaves or other location within the interior 1320 of the building structure 1300, as illustrated in FIG. 32.

Continuing to refer to FIGS. 33A-33B, the flexible coupling 3206 may be a bellows or other type of living hinge. In the example depicted in FIGS. 33A-33B, the flexible coupling 3206 has a hinge 3312 that rotatably connects the nose section 3202 and the plenum box 3204 at their ends 3308, 3328. The flexible coupling 3206 also includes a wedge-shaped slider 3310. The slider 3310 is sized to slide within the interior of the tubular body 3306, 3320 with minimal air leakage. The slider 3310 may also be coupled to the hinge 3312. The wedge-shape of slider 3310 has an angle 3360 sufficient to allow the nose section 3202 to rotate relative the plenum box 3204 an angle 3350. The angles 3350, 3360 may be at least 30 degrees, such as more than 60 degrees, more than 75 degrees. The angle 3360 is selected to prevent the sides 3316, 3318 of the slider 3310 from moving out from the ends 3308, 3328 of the nose section 3202 and the plenum box 3204 to prevent air leakage.

The slider 3310 may also have a plurality of dimples 3370 arranged on a common radius. The dimples 3370 are sized to engage with holes 3372 formed near the ends 3308, 3328 of the nose section 3202 and the plenum box 3204. The dimples 3370 and holes 3372 are configure as illustrated in FIG. 29. The engagement of the dimples 3370 and holes 3372 function to selectively hold the relative angle 3350 defined between the nose section 3202 and the plenum box 3204.

As the passage from the air inlet 124 at the back end 114 of the plenum box 3204 to the air outlet 132 at the front end 128 of the nose section 3202 of the vent termination 3200 is completely swept, very little energy is required to move air through the vent termination 3200. Additionally, the completely swept passage through the vent termination 3200 reduces the probability of biological growth.

FIGS. 34, 35, 36, 37, and 38 are top front left and right side isometric, top, bottom, and front views of the vent termination 3200 illustrated in FIGS. 32 and 33A-33B. The FIGS. 34, 35, 36, 37, and 38 are provided to more clearly illustrate the overall look and character of the vent termination 3200.

Figure 39:
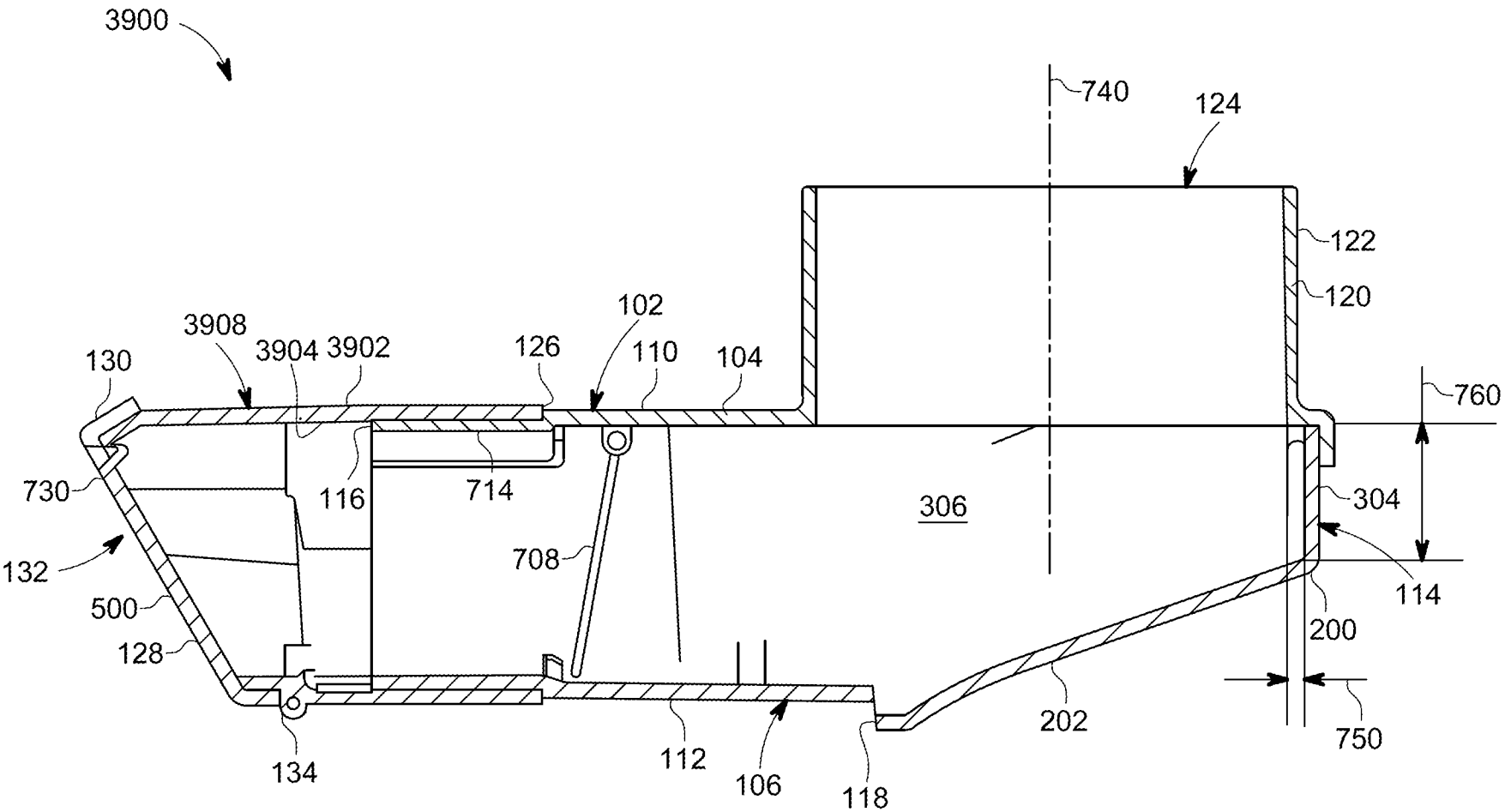
FIG. 39 is a schematic side view of yet another vent termination suitable for venting internal spaces within a building structure.
Figure 40:
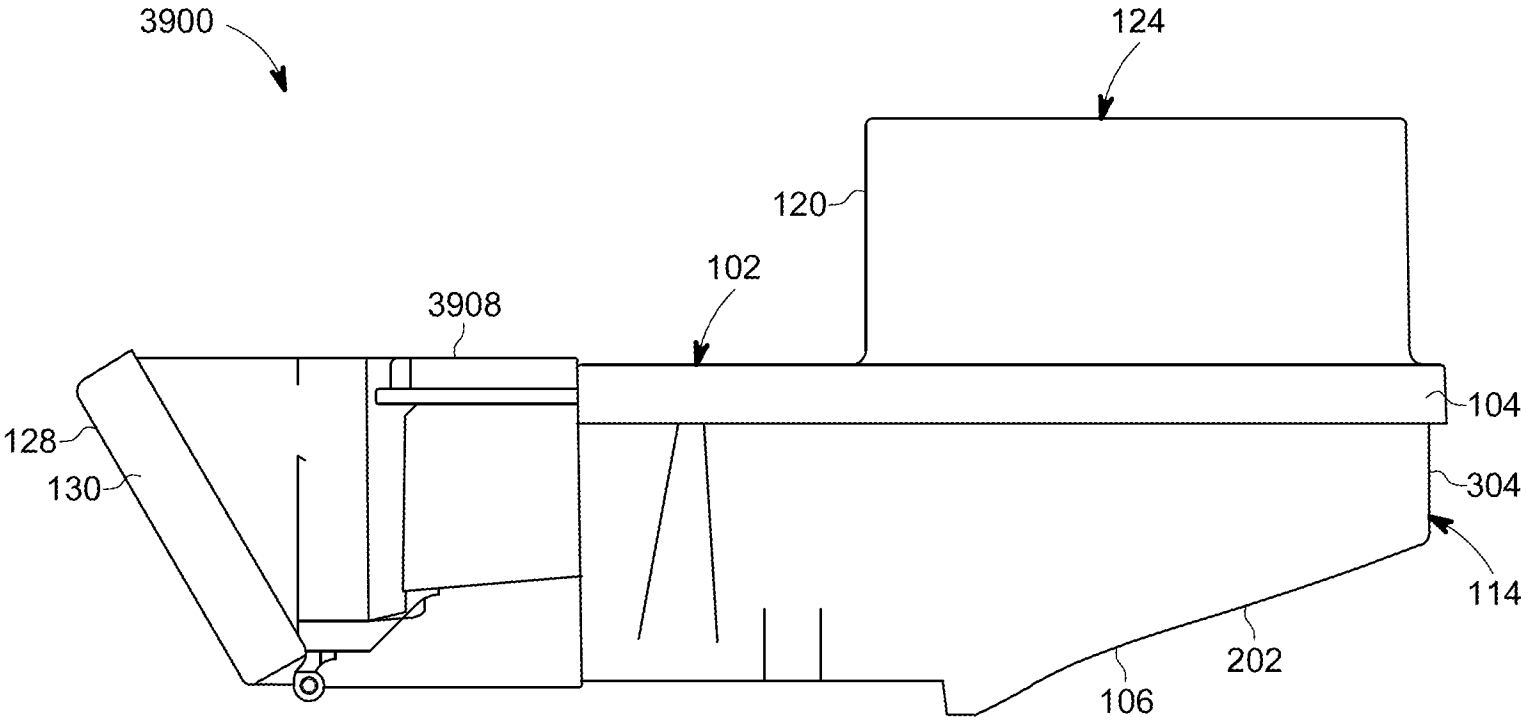
FIGS. 40-46 are various views of the vent termination depicted in FIG. 39.
Figure 41:
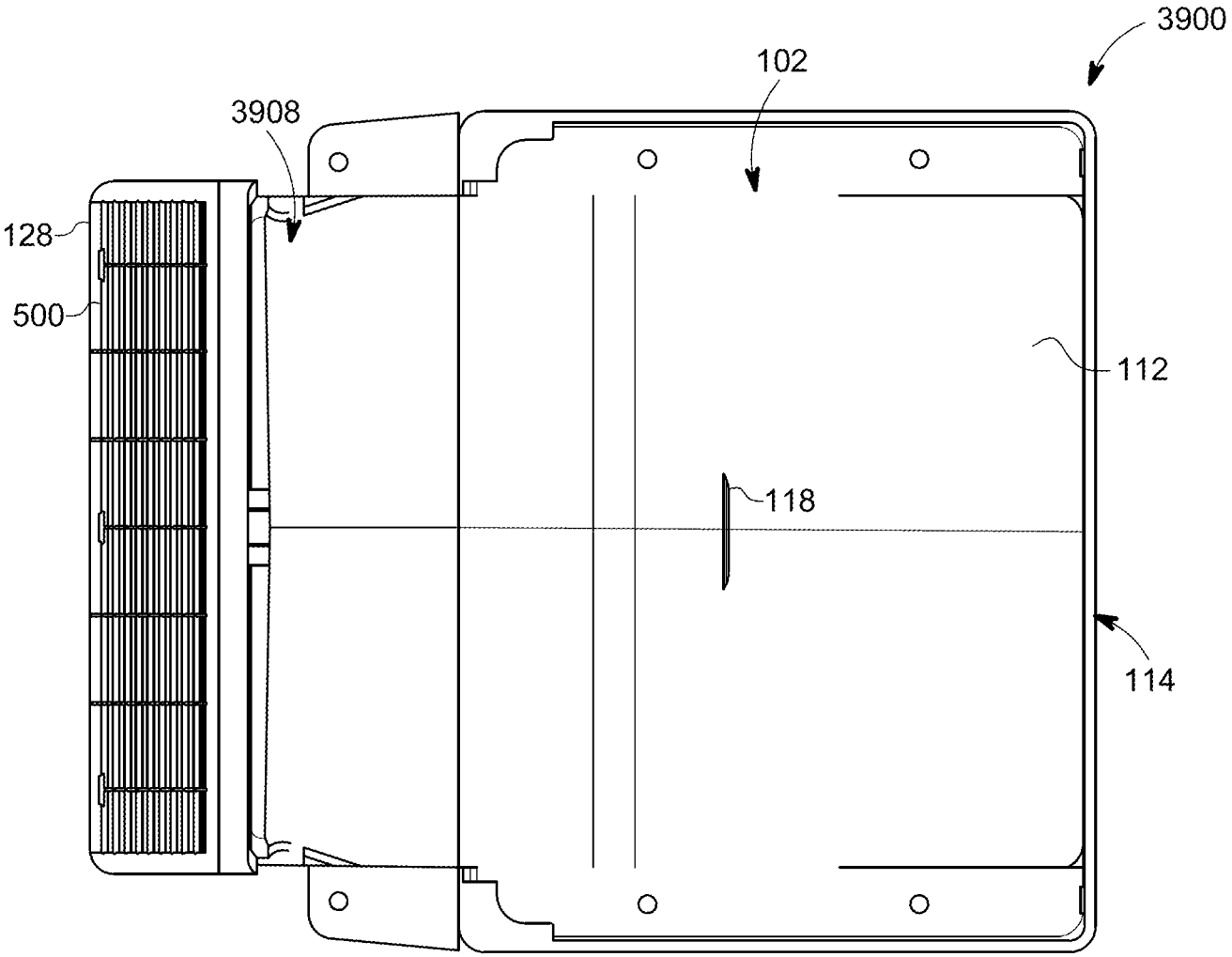
Figure 42:
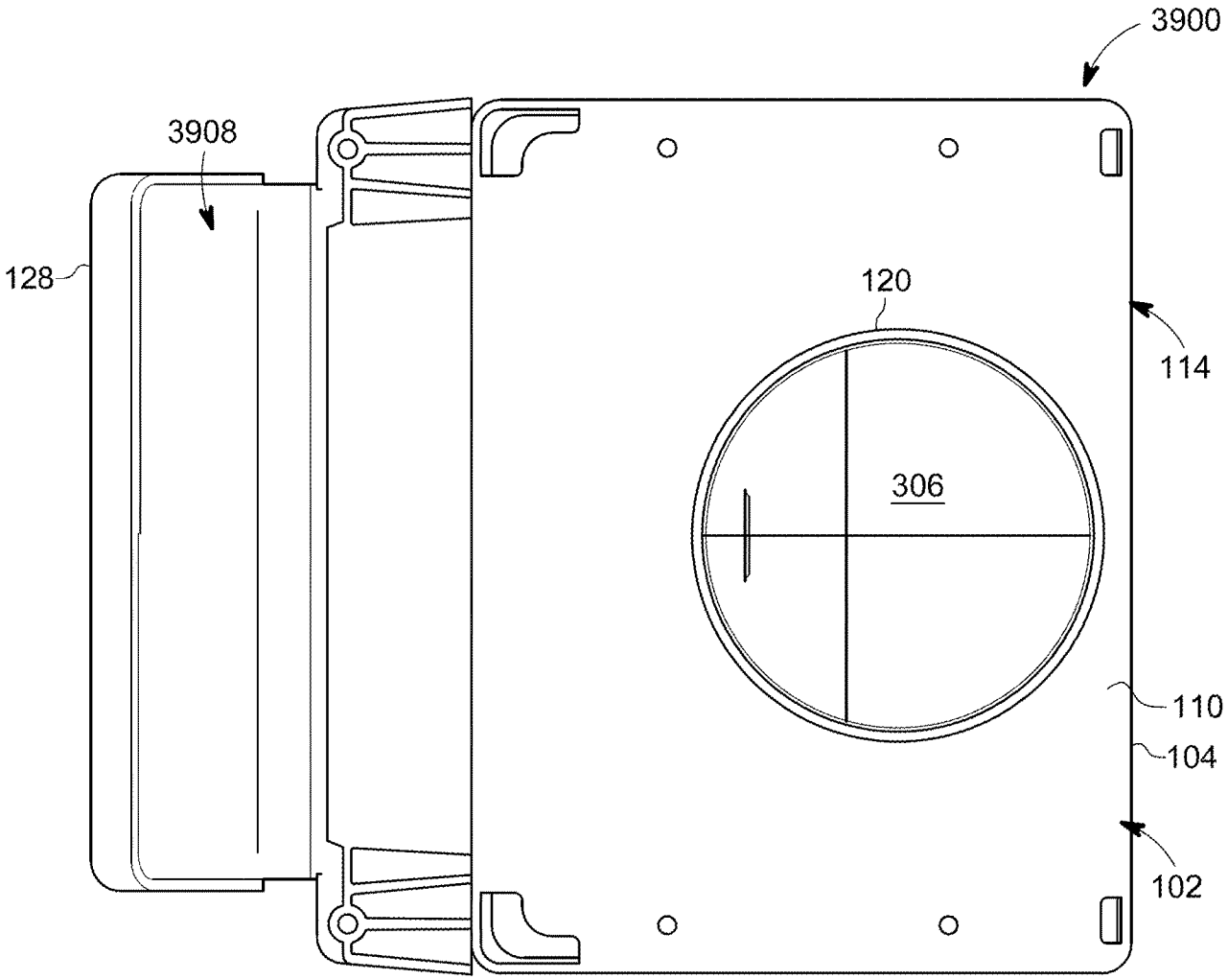
Figure 43:
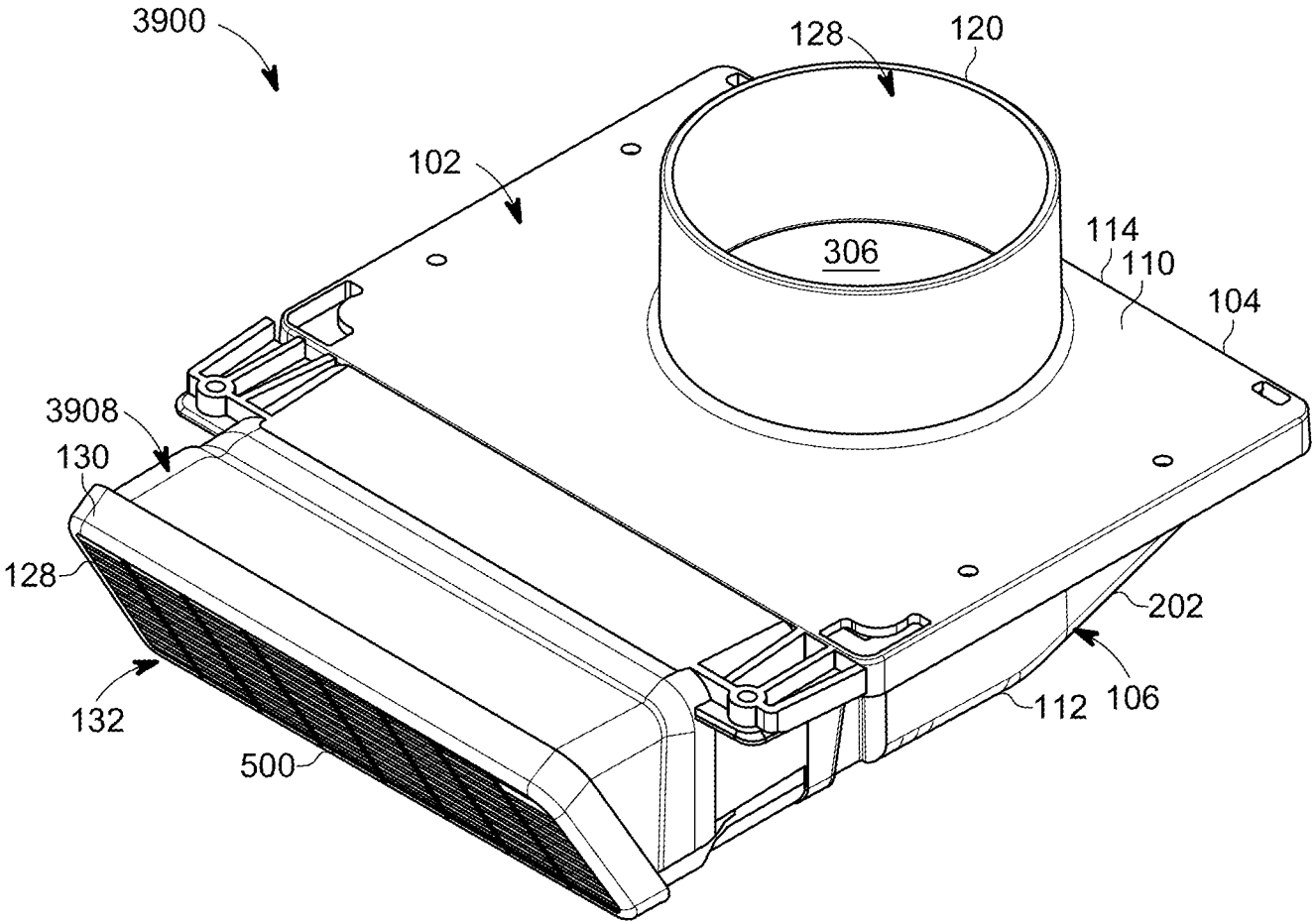
Figure 44:
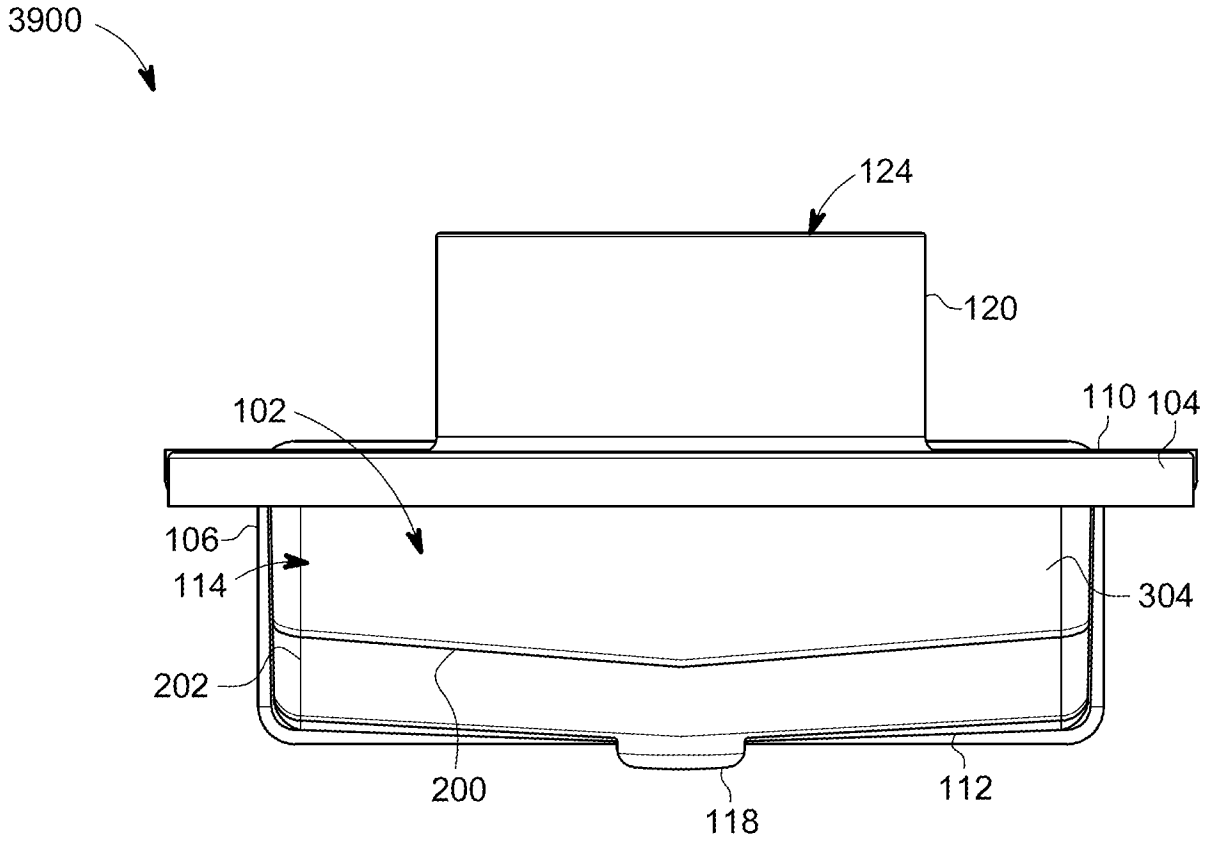
Figure 45:
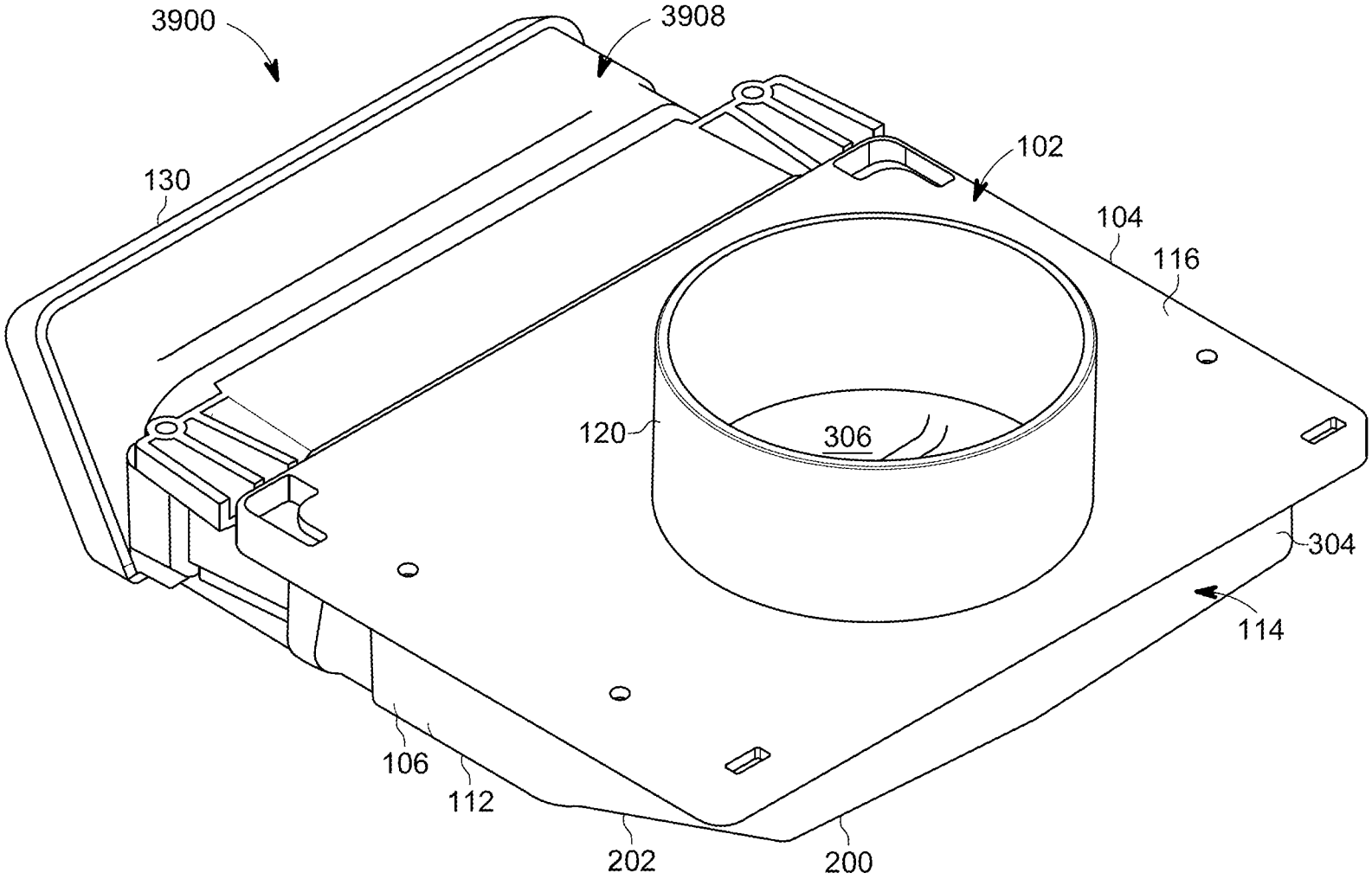
Figure 46:
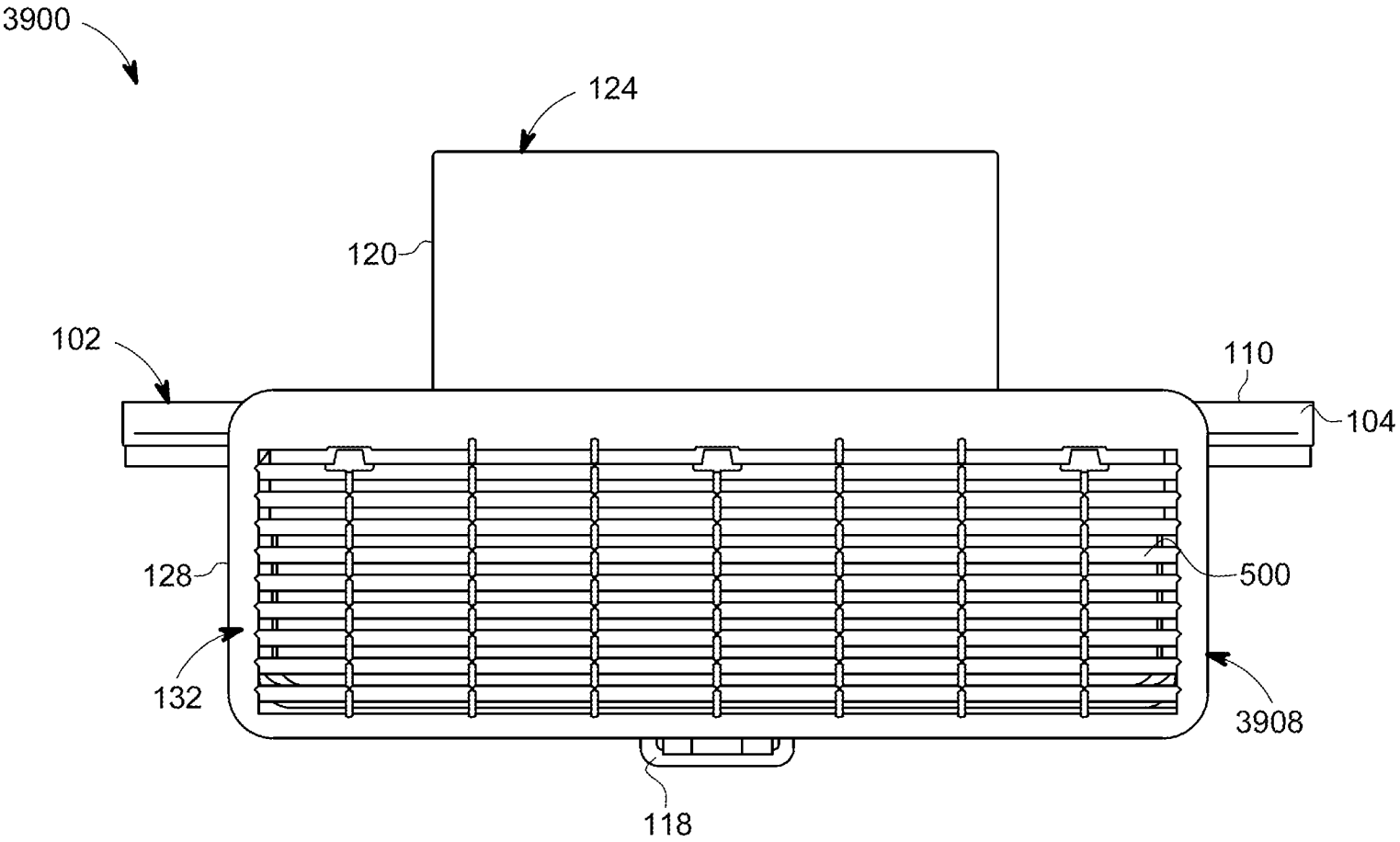

FIG. 39 is a schematic side view of yet another vent termination 3900 suitable for venting internal spaces within a building structure, such as shown in FIGS. 13 and 32, among others. The vent termination 3900 is essentially the same as the vent termination 100, except in that a nose section 3908 the vent termination 3900 has a substantially flat upper surface 3902 of a tubular body 3904 of the nose section 3908, as compared to the lower portion 706 of the top surface 710 of the nose section 108 of the vent termination 100 discussed above. The substantially flat upper surface 3902 of the nose section 3908 of the vent termination 3900 is advantageous for use in applications where the bottom of the fascia does not extend below the soffit.

FIGS. 40, 41, 42, 43, 44, and 45 are top front left and right side isometric, top, bottom, and front views of the vent termination 3900 illustrated in FIG. 39. The FIGS. 34, 35, 36, 37, and 38 are provided to more clearly illustrate the overall look and character of the vent termination 3900.

Thus, vent terminations such as through soffit and through fascia vents and building structures having vent terminations have been described above that efficiently vent air laterally away from the building structures in which the vents are mounted. The novel vent terminations have increased swept volume and lower flow conductance as compared to conventional vents that may be adapted for mounting under a soffit. As a result, less energy and smaller fan sizes are beneficially required for exhaust systems utilizing the vent terminations described herein.

While the foregoing describes exemplary vent terminations and building structures having the same, other and further examples in accordance with the one or more aspects described herein may be devised without departing from the scope hereof, which is determined by the claims that follow and equivalents thereof.

What is claimed is:

1. A vent termination comprising:

a plenum box having a top surface, a bottom surface, a front side and a back side, the plenum box having a plenum partially defined between the top and bottom surfaces, the bottom surface having a slanted portion that meets the a wall forming the back side at a transition;

a collar extending from the top surface and providing an air inlet into the plenum, the collar located closer to the back side than the front side such that a centerline of the collar projects through the slanted portion of the bottom surface of the plenum box; and a nose section having a first side and a second side, the first side connected to the front side of the plenum box, the second side of the nose section offset below the first side relative the top surface, the second side of the nose section forming an air outlet of the plenum.

2. The vent termination of claim 1 further comprising:

a grill coupled to the second side of the nose section and covering the air outlet of the plenum.

3. The vent termination of claim 2, wherein the grill is hingedly coupled to the nose section.

4. The vent termination of claim 3 further comprising:

removable spark arresting material disposed in the grill or the nose section proximate the grill.

5. The vent termination of claim 1, wherein an outside cylindrical wall of the collar located within 1 inch of the back side of the plenum box.

6. The vent termination of claim 1, wherein the transition between a wall forming the back side and the bottom surface of the plenum is at least 0.75 inches from the top surface of the plenum box.

7. The vent termination of claim 1, wherein the transition between a wall forming the back side and the bottom surface of the plenum is at least 1.0 inches from the top surface of the plenum box.

8. The vent termination of claim 1, wherein the transition between a wall forming the back side and the bottom surface of the plenum is at least 1.06 inches from the top surface of the plenum box.

9. The vent termination of claim 6, wherein the sloped portion of the bottom surface is closer to the top surface at the transition than at the centerline of the collar.

10. A building structure comprising:

an interior of the building structure;

a soffit defining a portion of an exterior of the building structure; and a vent termination coupled by a duct to a fan operable to ventilate the interior of the building structure or an appliance disposed in the building structure, the vent termination comprising:

a plenum box having a top surface, a bottom surface, a front side and a back side, the plenum box having a plenum partially defined between the top and bottom surfaces, the bottom surface having a slanted portion that meets the a wall forming the back side at a transition, the top surface mounted to the soffit of the building structure;

a collar extending through the soffit from the top surface and providing an air inlet into the plenum, the collar coupled to the duct and located closer to the back side than the front side such that a centerline of the collar projects through the slanted portion of the bottom surface of the plenum box; and a nose section having a first side and a second side, the first side connected to the front side of the plenum box, the second side of the nose section offset below the first side relative the top surface, the second side of the nose section forming an air outlet of the plenum.

11. The building structure of claim 10, wherein the second side of the nose section extend less than 2 inches from a fascia of the building structure.

12. The building structure of claim 10 further comprising:

a gutter mounted to a fascia of the building structure, wherein the second side of the nose section does not extend beyond the gutter.

13. The building structure of claim 10, wherein the second side of the nose section extend less than 2 inches from a fascia of the building structure.

14. The building structure of claim 10 further comprising:

a grill coupled to the second side of the nose section and covering the air outlet of the plenum, the grill having grates orientated to direct air exiting the air outlet in a direction laterally outward of a fascia of the building structure and below a plane of the soffit.

15. The building structure of claim 14, wherein the grill is hingedly coupled to the nose section.

16. The building structure of claim 14 further comprising:

removable spark arresting material disposed in the grill or the nose section proximate the grill.

17. The building structure of claim 10, wherein an outside cylindrical wall of the collar located within 1 inch of the back side of the plenum box.

18. The building structure of claim 10, wherein the transition is at least 0.75 inches from the top surface of the plenum box.

19. The building structure of claim 10, wherein the transition is at least 1.0 inches from the top surface of the plenum box.

20. The building structure of claim 10, wherein the transition is at least 1.06 inches from the top surface of the plenum box.

21. The building structure of claim 10, wherein the bottom surface is closer to the top surface at the transition than at the centerline of the collar.

* * * * *